US008286715B2

(12) United States Patent
Bailey et al.

(10) Patent No.: US 8,286,715 B2
(45) **Date of Patent: *Oct. 16, 2012**

(54) COATED SLEEVED OIL AND GAS WELL PRODUCTION DEVICES

(75) Inventors: Jeffrey Roberts Bailey, Houston, TX (US); Erika Ann Ooten Biediger, Houston, TX (US); Narasimha-Rao Venkata Bangaru, Pittstown, NJ (US); Swarupa Soma Bangaru, legal representative, Pittstown, NJ (US); Adnan Ozekcin, Bethlehem, PA (US); Hyun-Woo Jin, Easton, PA (US); Mehmet Deniz Ertas, Bethlehem, PA (US); Raghavan Ayer, Basking Ridge, NJ (US); William Curtis Elks, The Woodlands, TX (US); Charles Shiao-Hsiung Yeh, Spring, TX (US); Michael David Barry, The Woodlands, TX (US); Michael Thomas Hecker, Tomball, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 340 days.

This patent is subject to a terminal disclaimer.

(21) Appl. No.: 12/660,179

(22) Filed: Feb. 22, 2010

(65) Prior Publication Data

US 2011/0042069 A1 Feb. 24, 2011

Related U.S. Application Data

(63) Continuation-in-part of application No. 12/583,302, filed on Aug. 18, 2009, and a continuation-in-part of application No. 12/583,292, filed on Aug. 18, 2009.

(60) Provisional application No. 61/207,814, filed on Feb. 17, 2009, provisional application No. 61/189,530, filed on Aug. 20, 2008.

(51) Int. Cl.
*E21B 17/10* (2006.01)

(52) U.S. Cl. ..... 166/380; 166/242.4; 166/902

(58) Field of Classification Search ..... 166/902, 166/380, 242.4; 175/226
See application file for complete search history.

(56) References Cited

U.S. PATENT DOCUMENTS 3,392,700 A 7/1968 Mallory et al.

(Continued)

FOREIGN PATENT DOCUMENTS

EP 1 788 104 B1 11/2005

(Continued)

OTHER PUBLICATIONS

U.S. Appl. No. 12/583,302, filed Aug. 18, 2009.

(Continued)

*Primary Examiner* — Willam P Neuder
(74) *Attorney, Agent, or Firm* — Robert A. Migliorini

(57) ABSTRACT

Provided are coated sleeved oil and gas well production devices and methods of making and using such coated sleeved devices. In one form, the coated sleeved oil and gas well production device includes an oil and gas well production device including one or more bodies and one or more sleeves proximal to the outer or inner surface of the one or more bodies, and a coating on at least a portion of the inner sleeve surface, outer sleeve surface, or a combination thereof, wherein the coating is chosen from an amorphous alloy, a heat-treated electroless or electro plated based nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof. The coated sleeved oil and gas well production devices may provide for reduced friction, wear, erosion, corrosion, and deposits for well construction, completion and production of oil and gas.

162 Claims, 21 Drawing Sheets

U.S. PATENT DOCUMENTS

| | | | | |
|---|---|---|---|---|
| 4,162,619 | A | 7/1979 | Nixon, Jr. | |
| 4,171,560 | A | 10/1979 | Garrett | |
| 4,665,996 | A | 5/1987 | Foroulis et al. | |
| 4,743,513 | A | 5/1988 | Scruggs | |
| 4,945,991 | A | 8/1990 | Jones | |
| 5,113,935 | A | 5/1992 | Jones et al. | |
| 5,163,524 | A | 11/1992 | Newton, Jr. et al. | |
| 5,541,003 | A | 7/1996 | Nakayama et al. | |
| 5,551,959 | A | 9/1996 | Martin et al. | |
| 5,626,963 | A | 5/1997 | Hirano et al. | |
| 5,629,086 | A | 5/1997 | Hirano et al. | |
| 5,653,812 | A | 8/1997 | Petrmichl et al. | |
| 5,692,563 | A | 12/1997 | Krueger et al. | |
| 5,707,717 | A | 1/1998 | Shibahara | |
| 5,803,193 | A | 9/1998 | Krueger | |
| 5,873,420 | A | 2/1999 | Gearhart | |
| 5,998,307 | A | 12/1999 | Lam et al. | |
| 6,165,616 | A | 12/2000 | Lemelson | |
| 6,209,185 | B1 | 4/2001 | Scott | |
| 6,250,405 | B1 | 6/2001 | Moore | |
| 6,378,633 | B1 | 4/2002 | Moore | |
| 6,450,271 | B1 | 9/2002 | Tibitts et al. | |
| 6,548,173 | B2 | 4/2003 | Erdemir et al. | |
| 6,708,783 | B2 | 3/2004 | Moore et al. | |
| 6,742,586 | B2 | 6/2004 | Lauritzen et al. | |
| 6,764,714 | B2 | 7/2004 | Wei et al. | |
| 7,028,788 | B2 | 4/2006 | Strand et al. | |
| 7,052,736 | B2 | 5/2006 | Wei et al. | |
| 7,228,922 | B1 | 6/2007 | DeVall | |
| 7,234,541 | B2 | 6/2007 | Scott et al. | |
| 7,300,684 | B2 | 11/2007 | Boardman et al. | |
| 7,361,411 | B2 | 4/2008 | Daemen et al. | |
| 7,444,955 | B2 | 11/2008 | Boardman et al. | |
| 7,464,752 | B2 | 12/2008 | Dale et al. | |
| 7,487,840 | B2 | 2/2009 | Gammage et al. | |
| 7,541,069 | B2 | 6/2009 | Tudhope et al. | |
| 7,556,668 | B2 | 7/2009 | Eason et al. | |
| 7,673,679 | B2 * | 3/2010 | Harrison et al. | 166/250.01 |
| 2001/0039305 | A1 | 11/2001 | Nakamaru et al. | |
| 2003/0107217 | A1 | 6/2003 | Daigle et al. | |
| 2004/0031624 | A1 | 2/2004 | Scott et al. | |
| 2004/0188147 | A1 | 9/2004 | Mitchell et al. | |
| 2004/0256236 | A1 | 12/2004 | Minevski et al. | |
| 2005/0103497 | A1 * | 5/2005 | Gondouin | 166/302 |
| 2005/0146086 | A1 * | 7/2005 | Pope et al. | 264/602 |
| 2005/0211443 | A1 | 9/2005 | Helms et al. | |
| 2006/0102354 | A1 | 5/2006 | Gammage et al. | |
| 2007/0092740 | A1 | 4/2007 | Shi et al. | |
| 2007/0209839 | A1 | 9/2007 | Arnoldy | |
| 2008/0127475 | A1 | 6/2008 | Griffo | |
| 2008/0166287 | A1 | 7/2008 | Venkatraman et al. | |
| 2008/0236842 | A1 | 10/2008 | Bhavsar et al. | |
| 2008/0292806 | A1 | 11/2008 | Wei et al. | |
| 2008/0302534 | A1 | 12/2008 | Carter et al. | |
| 2008/0314646 | A1 * | 12/2008 | Lockwood et al. | 175/374 |
| 2009/0017317 | A1 * | 1/2009 | Lancsek et al. | 428/457 |
| 2010/0038407 | A1 | 2/2010 | Keshavan et al. | |

FOREIGN PATENT DOCUMENTS

| | | | |
|---|---|---|---|
| EP | 2 090 741 | A1 | 8/2009 |
| GB | 2122224 | A | 1/1984 |
| WO | WO 02/103161 | A2 | 12/2002 |
| WO | WO 2005/111264 | | 11/2005 |
| WO | WO 2007/091054 | A1 | 8/2007 |
| WO | WO 2007/092082 | | 8/2007 |
| WO | WO 2007/092083 | | 8/2007 |
| WO | WO 2007/126496 | | 11/2007 |
| WO | WO 2008/060479 | | 5/2008 |
| WO | WO 2008/138957 | A2 | 11/2008 |
| WO | WO 2009/011801 | A1 | 1/2009 |
| WO | 2009101507 | | 8/2009 |

OTHER PUBLICATIONS

Dudman, Rick A., West, Cory and Hubbard, Jeff, "Low-Stress Level PinUp Drillstring Optimizes Drilling of 20,000 ft. Slim-Hole in Southern Oklahoma", SPE/IADC Drilling Conference, Amsterdam, Holland, Mar. 9-11, 1999.

Dudman, R. A., Stull, T., and Keane, T., "Pin-up Drillstring Technology: Design, Application, and Case Histories", SPE/IADC Drilling Conference, New Orleans, Louisiana, Feb. 28-Mar. 3, 1989.

Chen et al., "Surface Atomic Properties of Tetrahedral Amorphous Carbon", Diamonds & Related Materials, 15 (2006), 936-938, 2006.

* cited by examiner

COATED SLEEVED OIL AND GAS WELL PRODUCTION DEVICES

CROSS-REFERENCE TO RELATED APPLICATIONS

This application is a Continuation-in-Part of U.S. patent application Ser. No. 12/583,302, filed Aug. 18, 2009, and U.S. patent application Ser. No. 12/583,292, filed Aug. 18, 2009, and claims priority of U.S. Provisional Application Ser. No. 61/207,814, filed Feb. 17, 2009, and U.S. Provisional Application Ser. No. 61/189,530, filed Aug. 20, 2008, the contents of each are hereby incorporated by reference.

FIELD

The present disclosure relates to the field of oil and gas well production operations. It more particularly relates to the use of coated sleeved devices to reduce friction, wear, corrosion, erosion, and deposits in oil and gas well production operations. Such coated sleeved oil and gas well production devices may be used in drilling rig equipment, marine riser systems, tubular goods (casing, tubing, and drill strings), wellhead, trees, and valves, completion strings and equipment, formation and sandface completions, artificial lift equipment, and well intervention equipment.

BACKGROUND

Oil and gas well production suffers from basic mechanical problems that may be costly, or even prohibitive, to correct, repair, or mitigate. Friction is ubiquitous in the oilfield, devices that are in moving contact wear and lose their original dimensions, and devices are degraded by erosion, corrosion, and deposits. These are impediments to successful operations that may be mitigated by selective use of coated sleeved oil and gas well production devices as described below.

Drilling Rig Equipment:

Following the identification of a specific location as a prospective hydrocarbon area, production operations commence with the mobilization and operation of a drilling rig. In rotary drilling operations, a drill bit is attached to the end of a bottom hole assembly, which is attached to a drill string comprising drill pipe and tool joints. The drill string may be rotated at the surface by a rotary table or top drive unit, and the weight of the drill string and bottom hole assembly causes the rotating bit to bore a hole in the earth. As the operation progresses, new sections of drill pipe are added to the drill string to increase its overall length. Periodically during the drilling operation, the open borehole is cased to stabilize the walls, and the drilling operation is resumed. As a result, the drill string usually operates both in the open borehole ("open-hole") and within the casing which has been installed in the borehole ("cased-hole"). Alternatively, coiled tubing may replace drill string in the drilling assembly. The combination of a drill string and bottom hole assembly or coiled tubing and bottom hole assembly is referred to herein as a drill stem assembly. Rotation of the drill string provides power through the drill string and bottom hole assembly to the bit. In coiled tubing drilling, power is delivered to the bit by the drilling fluid. The amount of power which can be transmitted by rotation is limited to the maximum torque a drill string or coiled tubing can sustain.

In an alternative and unusual drilling method, the casing itself is used to drill into the earth formations. Cutting elements are affixed to the bottom end of the casing, and the casing may be rotated to turn the cutting elements. In the discussion that follows, reference to the drill stem assembly will include a "drilling casing string" that is used to drill the earth formations in this "casing-while-drilling" method.

During the drilling of a borehole through underground formations, the drill stem assembly undergoes considerable sliding contact with both the steel casing and rock formations. This sliding contact results primarily from the rotational and axial movements of the drill stem assembly in the borehole. Friction between the moving surface of the drill stem assembly and the stationary surfaces of the casing and formation creates considerable drag on the drill stem and results in excessive torque and drag during drilling operations. The problem caused by friction is inherent in any drilling operation, but it is especially troublesome in directionally drilled wells or extended reach drilling (ERD) wells. Directional drilling or ERD is the intentional deviation of a wellbore from the vertical. In some cases the inclination (angle from the vertical) may be as great as ninety degrees. Such wells are commonly referred to as horizontal wells and may be drilled to a considerable depth and considerable distance from the drilling platform.

In all drilling operations, the drill stem assembly has a tendency to rest against the side of the borehole or the well casing, but this tendency is much greater in directionally drilled wells because of the effect of gravity. The drill stem may also locally rest against the borehole wall or casing in areas where the local curvature of the borehole wall or casing is high. As the drill string increases in length or degree of vertical deflection, the amount of friction created by the rotating drill stem assembly also increases. Areas of increased local curvature may increase the amount of friction generated by the rotating drill stem assembly. To overcome this increase in friction, additional power is required to rotate the drill stem assembly. In some cases, the friction between the drill stem assembly and the casing wall or borehole exceeds the maximum torque that can be tolerated by the drill stem assembly and/or maximum torque capacity of the drill rig and drilling operations must cease. Consequently, the depth to which wells can be drilled using available directional drilling equipment and techniques is ultimately limited by friction.

One string of pipe in sliding contact motion relative to an outer pipe, or more generally, an inner cylinder moving within an outer cylinder, is a common geometric configuration in several of these operations. One prior art method for reducing the friction caused by the sliding contact between strings of pipe is to improve the lubricity of the annular fluid. In industry operations, attempts have been made to reduce friction through, mainly, using water and/or oil based mud solutions containing various types of expensive and often environmentally unfriendly additives. For many of these additives the increased lubricity gained from these additives decreases as the temperature of the borehole increases. Diesel and other mineral oils are also often used as lubricants, but there may be problems with the disposal of the mud, and these fluids also lose lubricity at elevated temperatures. Certain minerals such as bentonite are known to help reduce friction between the drill stem assembly and an open borehole. Materials such as Teflon have been used to reduce sliding contact friction, however these lack durability and strength. Other additives include vegetable oils, asphalt, graphite, detergents, glass beads, and walnut hulls, but each has its own limitations.

Another prior art method for reducing the friction between pipes is to use aluminum material for the drill string because aluminum is lighter than steel. However, aluminum is expensive and may be difficult to use in drilling operations, it is less abrasion-resistant than steel, and it is not compatible with many fluid types (e.g. fluids with high pH). Additionally, the industry has developed means to "float" an inner casing string within an outer string to run casing and liner at high inclinations, but circulation is restricted during this operation and it is not amenable to the hole-making process.

Yet another method for reducing the friction between strings of pipe is to use a hard facing material on the inner string (also referred to herein as hardbanding or hardfacing). U.S. Pat. No. 4,665,996, herein incorporated by reference in its entirety, discloses the use of hardfacing applied to the principal bearing surface of a drill pipe, with an alloy having the composition of: 50-65% cobalt, 25-35% molybdenum, 1-18% chromium, 2-10% silicon and less than 0.1% carbon for reducing the friction between a string and the casing or rock. As a result, the torque needed for the rotary drilling operation, especially directional drilling, is decreased. The disclosed alloy also provides excellent wear resistance on the drill string while reducing the wear on the well casing. Another form of hardbanding is WC-cobalt cermets applied to the drill stem assembly. Other hardbanding materials include TiC, Cr-carbide, and other mixed carbide and nitride systems. A tungsten carbide containing alloy, such as Stellite 6 and Stellite 12 (trademark of Cabot Corporation), has excellent wear resistance as a hardfacing material but may cause excessive abrading of the opposing device. Hardbanding may be applied to portions of the drill stem assembly using weld overlay or thermal spray methods. In a drilling operation, the drill stem assembly, which has a tendency to rest on the well casing, continually abrades the well casing as the drill string rotates.

In addition to hardbanding on tool joints, certain sleeve devices have been used in the industry. A polymer-steel based wear device is disclosed in U.S. Pat. No. 4,171,560 (Garrett, "Method of Assembling a Wear Sleeve on a Drill Pipe Assembly.") Western Well Tool subsequently developed and currently offers Non-Rotating Protectors to control contact between pipe and casing in deviated wellbores, holding U.S. Pat. Nos. 5,803,193, 6,250,405, and 6,378,633.

Strand et al. have patented a metal "Wear Sleeve" device (U.S. Pat. No. 7,028,788) that is a means to deploy hardbanding material on removable sleeves. This device is a ring that is typically of less than one-half inch in wall thickness that is threaded onto the pin connection of a drill pipe tool joint over a portion of the pin that is of reduced diameter, up to the bevel diameter of the connection. The ring has internal threads over a portion of the inner surface that are of left-hand orientation, opposite to that of the tool joint. Threaded this way, the ring does not bind against the pin connection body, but instead it drifts down to the box-pin connection face as the drill string turns to the right. Arnco markets this device under the trade name "WearSleeve." After several years of availability in the market and at least one field test, this system has not been used widely. The methods disclosed herein provide significant advantages over the WearSleeve device.

Arnco has devised a fixed hardbanding system typically located in the middle of a joint of drill pipe as described in U.S. Patent Application 2007/0209839 A1, "System and Method for Reducing Wear in Drill Pipe Sections."

Separately, a tool joint configuration in which the pin connection is held in the slips has been deployed in the field, as opposed to the standard petroleum industry configuration in which the box connection is held by the slips. Certain benefits have been claimed, as documented in exemplary publications SPE 18667 (1989) Dudman, R. A. et. al, "Pin-up Drillstring Technology: Design, Application, and Case Histories," and SPE 52848 (1999) Dudman, R. A. et. al, "Low-Stress Level PinUp Drillstring Optimizes Drilling of 20,000 ft Slim-Hole in Southern Oklahoma." Dudman discloses larger pipe diameters and connection sizes for certain hole sizes than may be used in the standard pin-down convention, because the pin connection diameter can be made smaller than the box connection diameter and still satisfy fishing requirements.

There are many additional pieces of equipment that have metal-to-metal contact on a drilling rig that are subject to friction, wear, erosion, corrosion, and/or deposits. These devices include but are not limited to the following list: valves, pistons, cylinders, and bearings in pumping equipment; wheels, skid beams, skid pads, skid jacks, and pallets for moving the drilling rig and drilling materials and equipment; topdrive and hoisting equipment; mixers, paddles, compressors, blades, and turbines; and bearings of rotating equipment and bearings of roller cone bits.

Certain operations other than hole-making are often conducted during the drilling process, including logging of the open-hole (or of the cased-hole section) to evaluate formation properties, coring to remove portions of the formation for scientific evaluation, capture of formation fluids at downhole conditions for fluids analyses, placing tools against the wellbore to record acoustic signals, and other operations and methods known to those skilled in the art. Most of these operations comprise the axial or torsional motion of one body relative to another, wherein the two bodies are in mechanical contact with a certain contact force and contact friction that resists the relative motion, causing friction and wear.

Marine Riser Systems:

In a marine environment, a further complication is that the wellhead tree may be "dry" (located above sea level on the platform) or "wet" (located on the seafloor). In either case, conductor pipes known as "risers" are placed between the surface and seafloor, with drill stem equipment run internal to the riser and with drilling fluid returns in the annular space. Risers may be particularly susceptible to the issues associated with rotating an inner pipe within an outer stationary pipe since the risers are not fixed but may also move due to contact with not only the drill string but also the sea environment. Drag and vortex shedding of a marine riser causes loads and vibrations that are due in part to frictional resistance of the ocean current around the outer surface of the marine riser.

Operations within marine riser systems often involve the axial or torsional motion of one body relative to another, wherein the two bodies are in mechanical contact with a certain contact force and contact friction that resists the relative motion causing friction and wear.

Tubular Goods:

Oil-country tubular goods (OCTG) comprise drill stem equipment, casing, tubing, work strings, coiled tubing, and risers. Common to most OCTG (but not coiled tubing) are threaded connections, which are subject to potential failure resulting from improper thread and/or seal interference, leading to galling in the mating connectors that can inhibit use or reuse of the entire joint of pipe due to a damaged connection. Threads may be shot-peened, cold-rolled, and/or chemically treated (e.g., phosphate, copper plating, etc.) to improve their anti-galling properties, and application of an appropriate pipe thread compound provides benefits to connection usage. However, there are still problems today with thread galling and interference issues, particularly with the more costly OCTG material alloys for extreme service requirements.

Operations using OCTG often involve the axial or torsional motion of one body relative to another, wherein the two bodies are in mechanical contact with a certain contact force and contact friction that resists the relative motion causing friction and wear. Such motion may be required for installation after which the device may be substantially stationary, or for repeated applications to perform some operation.

Wellhead, Trees, and Valves:

At the top of the casing, the fluids are contained by wellhead equipment, which typically includes multiple valves and blowout preventers (BOP) of various types. Subsurface safety valves are critical pieces of equipment that must function properly in the event of an emergency or upset condition. Subsurface safety valves are installed downhole, usually in the tubing string, and may be closed to prevent flow from the subsurface. Chokes and flowlines connected to the wellhead (particularly joints and elbows) are subject to friction, wear, corrosion, erosion, and deposits. Chokes may be cut out by sand flowback, for example, rendering the measurement of flow rates inaccurate.

Many of these devices rely on seals and very close mechanical tolerances, including both metal-to-metal and elastomeric seals. Many devices (sleeves, pockets, nipples, needles, gates, balls, plugs, crossovers, couplings, packers, stuffing boxes, valve stems, centrifuges, etc.) are subject to friction and mechanical degradation due to corrosion and erosion, and even potential blockage resulting from deposits of scale, asphaltenes, paraffins, and hydrates. Some of these devices may be installed downhole or on the sea floor, and it may be impossible or very costly at best to gain service access for repair or restoration.

Operations involving wellhead, trees, and valves often involve the axial or torsional motion of one body relative to another, wherein the two bodies are in mechanical contact with a certain contact force and contact friction that resists the relative motion causing friction and wear. Such motion may be required for installation after which the device may be substantially stationary, or for repeated applications to perform some operation. Several of these systems also establish static or dynamic seals which require close tolerances and smooth surfaces for leak resistance.

Completion Strings and Equipment:

With the drill well cased to prevent hole collapse and uncontrolled fluid flow, the completion operation must be performed to make the well ready for production. This operation involves running equipment into and out of the wellbore to perform certain operations such as cementing, perforating, stimulating, and logging. Two common means of conveyance of completion equipment are wireline and pipe (drill pipe, coiled tubing, or tubing work strings). These operations may include running logging tools to record formation and fluid properties, perforating guns to make holes in the casing to allow hydrocarbon production or fluid injection, temporary or permanent plugs to isolate fluid pressure, packers to facilitate setting pipe to provide a seal between the pipe interior and annular areas, and additional types of equipment needed for cementing, stimulating, and completing a well. Wireline tools and work strings may include packers, straddle packers, and casing patches, in addition to packer setting tools, devices to install valves and instruments in sidepockets, and other types of equipment to perform a downhole operation. The placement of these tools, particularly in extended-reach wells, may be impeded by friction drag. The final completion string left in the hole for production is commonly referred to as the production tubing string.

Installation and use of completion strings and equipment often involves the axial or torsional motion of one body relative to another, wherein the two bodies are in mechanical contact with a certain contact force and contact friction that resists the relative motion causing friction and wear. Such motion may be required for installation after which the device may be substantially stationary, or for repeated applications to perform some operation.

Formation and Sandface Completions:

In many wells, there is a tendency for sand or formation material to flow into the wellbore. To prevent this from occurring, "sand screens" are placed in the well across the completion interval. This operation may involve deploying a special-purpose large diameter assembly comprising one of several types of sand screen mesh designs over a central "base pipe." The screen and basepipe are frequently subject to erosion and corrosion and may fail due to sand "cutout." Also, in high inclination wells, the frictional drag resistance encountered while running screens into the wellbore may be excessive and limit the application of these devices, or the length of the wellbore may be limited by the maximum depth to which screen running operations may be conducted due to friction resistance.

In those wells that require sand control, a sand-like propping material, "proppant," is pumped in the annular area between the screen and formation to prevent the formation grains from flowing through the screens. This operation is called a "gravel pack" or, if conducted at fracturing conditions, may be called a "frac pack." In many other formations, often in wellbores without sand screens, fracture stimulation treatments may be conducted in which this same or different type of propping material is injected at fracturing conditions to create large propped fracture wings extending a significant distance away from the wellbore to increase the production or injection rate. Frictional resistance occurs while pumping the treatment as the proppant particles contact each other and the constraining walls. Furthermore, the proppant particles are subject to crushing and generating "fines" that increase the resistance to fluid flow during production. The proppant properties, including the strength, friction coefficient, shape, and roughness of the grain, are important to the successful execution of this treatment and the ultimate increase in well productivity or injectivity.

Installation of sand screens and subsequent workover operations often involves the axial or torsional motion of one body relative to another, wherein the two bodies are in mechanical contact with a certain contact force and contact friction that resists the relative motion causing friction and wear. Such motion may be required for installation after which the device may be substantially stationary, or for repeated applications to perform some operation.

Artificial Lift Equipment:

When production from a well is initiated, it may flow at satisfactory rates under its own pressure. However, many wells at some point in their life require assistance in lifting fluids out of the wellbore. Many methods are used to lift fluids from a well, including: sucker rod, Corod™, and electric submersible pumps to remove fluids from the well, plunger lifts to displace liquids from a predominantly gas well, and "gas lift" or injection of a gas along the tubing to reduce the density of a liquid column. Alternatively, specialty chemicals may be injected through valves spaced along the tubing to prevent buildup of scale, asphaltene, paraffin, or hydrate deposits.

The production tubing string may include devices to assist fluid flow. Several of these devices may rely on seals and very close mechanical tolerances, including both metal-to-metal and elastomeric seals. Interfaces between parts (sleeves, pockets, plugs, packers, crossovers, couplings, bores, mandrels, etc.) are subject to friction and mechanical degradation due to corrosion and erosion, and even potential blockage or mechanical fit interference resulting from deposits of scale, asphaltenes, paraffins, and hydrates. In particular, gas lift, submersible pumps, and other artificial lift equipment may include valves, seals, rotors, stators, and other devices that may fail to operate properly due to friction, wear, corrosion, erosion, or deposits.

Installation and operation of artificial lift equipment and subsequent workover operations often involves the axial or torsional motion of one body relative to another, wherein the two bodies are in mechanical contact with a certain contact force and contact friction that resists the relative motion causing friction and wear.

Well Intervention Equipment:

Downhole operations on a wellbore near the reservoir formation interval are often required to gather data or to initiate, restore, or increase production or injection rate. These operations involve running equipment into and out of the wellbore. Two common means of conveyance of completion equipment and tools are wireline and pipe. These operations may include running logging tools to record formation and fluid properties, perforating guns to make holes in the casing to allow hydrocarbon production or fluid injection, temporary or permanent plugs to isolate fluid pressure, packers to facilitate a seal between intervals of the completion, and additional types of highly specialized equipment. The operation of running equipment into and out of a well involves sliding contact due to the relative motion of two bodies, thus creating frictional drag resistance.

Workover operations often involve the axial or torsional motion of one body relative to another, wherein the two bodies are in mechanical contact with a certain contact force and contact friction that resists the relative motion causing friction and wear.

Related Art:

In addition to the prior art disclosed above, U.S. Patent Application 2008/0236842, "Downhole Oilfield Apparatus Comprising a Diamond-Like Carbon Coating and Methods of Use," discloses applicability of DLC coatings to downhole devices with internal surfaces that are exposed to the downhole environment. This reference does not disclose the use of external coatings on sleeved devices and, in particular, this reference does not discuss external application to drilling tool joint components.

Saenger and Desroches describe in EP 2090741 A1 a "coating on at least a portion of the surface of a support body" for downhole tool operation. The types of coatings that are disclosed include DLC, diamond carbon, and Cavidur (a proprietary DLC coating from Bekaert). The coating is specified as "an inert material selected for reducing friction." Specific applications to logging tools and O-rings are described. Specific benefits that are cited include friction and corrosion reduction. Although a drill string is shown in the figures of the application, there is no reference to applying the coating to the drill string or tool joints in this application.

Van Den Brekel et al. disclose in WO 2008/138957 A2 a drilling method in which the casing material is 1 to 5 times harder than the drill string material, and friction reducing additives are used in the drilling fluid. The drill string may have poly-tetra-fluor-ethene (PTFE) applied as a friction-reducing outer layer. This disclosure is different from the present invention in that the coatings to be applied have hardness values greater than that of the casing material, and no specifications for the drilling fluid are provided in the present invention.

Wei et al. also discloses the use of coatings on the internal surfaces of tubular structures (U.S. Pat. No. 6,764,714, "Method for Depositing Coatings on the Interior Surfaces of Tubular Walls," and U.S. Pat. No. 7,052,736, "Method for Depositing Coatings on the Interior Surfaces of Tubular Structures"). Tudhope et al. also have developed means to coat internal surfaces of an object, including for example U.S. Pat. No. 7,541,069, "Method and System for Coating Internal Surfaces Using Reverse-Flow Cycling."

Griffo discloses the use of superabrasive nanoparticles on bits and bottom-hole assembly components in U.S. Patent Application 2008/0127475, "Composite Coating with Nanoparticles for Improved Wear and Lubricity in Downhole Tools."

Gammage et al. discloses spray metal application to the external surface of downhole tool components in U.S. Pat. No. 7,487,840.

Thornton discloses the use of Tungsten Disulphide ($WS_2$) on downhole tools in WO 2007/091054, "Improvements In and Relating to Downhole Tools."

The use of coatings on bits and bit seals has been disclosed, for example in U.S. Pat. No. 7,234,541, "DLC Coating for Earth-Boring Bit Seal Ring," U.S. Pat. No. 6,450,271, "Surface Modifications for Rotary Drill Bits," and U.S. Pat. No. 7,228,922, "Drill Bit."

In addition, the use of DLC coatings in non-oilfield applications has been disclosed in U.S. Pat. No. 6,156,616, "Synthetic Diamond Coatings with Intermediate Bonding Layers and Methods of Applying Such Coatings" and U.S. Pat. No. 5,707,717, "Articles Having Diamond-Like Protective Film."

Need for the Disclosure:

Given the expansive nature of these broad requirements for production operations, there is a need for the application of new coating material technologies that protect devices from friction, wear, corrosion, erosion, and deposits resulting from sliding contact between two or more devices and fluid flowstreams that may contain solid particles traveling at high velocities. This need requires novel materials that combine high hardness with a capability for low coefficient of friction (COF) when in contact with an opposing surface. Furthermore, the use of sleeved devices is a practical and economic means to deploy such coatings in oil and gas well production equipment. If such coating material can also provide a low energy surface and low friction coefficient against the borehole wall, then this novel material coating may enable ultra-extended reach drilling, reliable and efficient operations in difficult environments, including offshore and deepwater applications, and generate cost reduction, safety, and operational improvements throughout oil and gas well production operations. As envisioned, the use of these coatings on sleeved well production devices could have widespread application and provide significant improvements and extensions to well production operations.

Therefore, there exists a need for coated sleeved oil and gas well production devices. First, the methods to apply the inventive coatings on production devices may require that the body be enclosed in a chamber. This may be a very restrictive requirement for many oilfield components. For example, the geometry of long pipe sections is cumbersome for such chambers. This is also not likely to be very efficient since the surface area to be coated may be a small fraction of the total surface area of the main body. Coated sleeve elements of a coated sleeved device can be transported to the field location and installed on the production equipment with less cost than alternative means of deploying such low-friction coatings. Also, in certain applications for which either the sleeve element or the coating needs to be replaced or refurbished, a sleeved system configuration is economical, with minimal transportation requirements and equipment downtime. The sleeve element itself may be comprised of different material than the body to which it is proximal. The sleeve element may be subjected to high temperatures and other environmental conditions during the coating process that would cause damage to the other elements of the system. Sleeve elements of a coated sleeved device can be coated with low friction materials more efficiently and with a broader range of possible coating types than attempting to coat larger pieces of equipment, facilitating utilization of low-friction coatings to improve the effective mechanical properties of these devices. The prior art does not disclose an efficient means to address these problems, and the inventive methods will enable the use of low-friction coatings in oil and gas well production devices.

SUMMARY

According to the present disclosure, an advantageous coated sleeved oil and gas well production device comprising: one or more cylindrical bodies, one or more sleeves proximal to the outer diameter or inner diameter of the one or more cylindrical bodies, and a coating on at least a portion of the inner sleeve surface, the outer sleeve surface, or a combination thereof of the one or more sleeves, wherein the coating is chosen from an amorphous alloy, a heat-treated electroless or electro plated based nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof.

A further aspect of the present disclosure relates to an advantageous coated sleeved oil and gas well production device comprising: an oil and gas well production device including one or more bodies with the proviso that the one or more bodies does not include a drill bit, one or more sleeves proximal to the outer surface or the inner surface of the one or more bodies, and a coating on at least a portion of the inner sleeve surface, the outer sleeve surface, or a combination thereof of the one or more sleeves, wherein the coating is chosen from an amorphous alloy, a heat-treated electroless or electro plated based nickel-phosphorous based composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof.

A still further aspect of the present disclosure relates to an advantageous method of using a coated sleeved oil and gas well production device comprising: providing a coated oil and gas well production device including one or more cylindrical bodies with one or more sleeves proximal to the outer diameter or the inner diameter of the one or more cylindrical bodies, and a coating on at least a portion of the inner sleeve surface, the outer sleeve surface, or a combination thereof of the one or more sleeves, wherein the coating is chosen from an amorphous alloy, a heat-treated electroless or electro plated based nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof, and utilizing the coated sleeved oil and gas well production device in well construction, completion, or production operations.

A still yet further aspect of the present disclosure relates to an advantageous method of using a coated sleeved oil and gas well production device comprising: providing a coated oil and gas well production device including one or more bodies with the proviso that the one or more bodies does not include a drill bit, with one or more sleeves proximal to the outer surface or the inner surface of the one or more bodies, and a coating on at least a portion of the inner sleeve surface, the outer sleeve surface, or a combination thereof of the one or more sleeves, wherein the coating is chosen from an amorphous alloy, a heat-treated electroless or electro plated based nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof, utilizing the coated sleeved oil and gas well production device in well construction, completion, or production operations.

These and other features and attributes of the disclosed coated sleeved oil and gas well production devices, and methods of using such sleeved devices for reducing friction, wear, corrosion, erosion, and deposits in such application areas, and their advantageous applications and/or uses will be apparent from the detailed description which follows, particularly when read in conjunction with the figures appended hereto.

BRIEF DESCRIPTION OF DRAWINGS

To assist those of ordinary skill in the relevant art in making and using the subject matter hereof, reference is made to the appended drawings, wherein.

DEFINITIONS

Figure 1A:
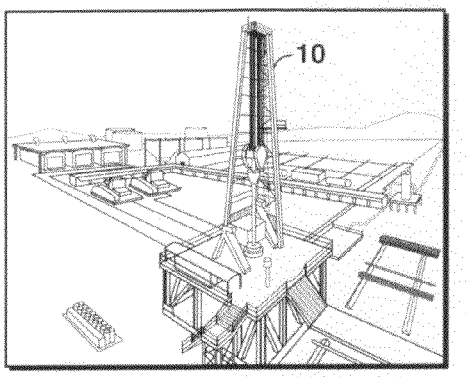
FIG. 1 depicts an oil and gas well production system that employs well production devices in the individual well construction, completion, stimulation, workover, and production phases of the overall production process.

"Annular isolation valve" is a valve at the surface to control flow from the annular space between casing and tubing.

"Asphaltenes" are heavy hydrocarbon chains that may be deposited on the walls of pipes and other flow equipment and therefore create a flow restriction.

"Basepipe" is a liner that serves as the load-bearing device of a sand control screen. The screens are attached to the outside of the basepipe. At least a portion of the basepipe may be pre-perforated, slotted, or equipped with an inflow control device. The basepipe is fabricated in jointed sections that are threaded for makeup while running in hole.

"Bearings and bushings" are used to provide a low friction surface for two devices to move relative to each other in sliding contact, especially to allow relative rotational motion.

"Blast joints" are thicker-walled pipe used across flowing perforations or in a wellhead across a fluid inlet during a stimulation treatment. The greater wall thickness and/or material hardness resists being completely eroded through due to sand or proppant impingement.

"Bottom hole assembly" (BHA) is comprised of one or more devices, including but not limited to: stabilizers, variable-gauge stabilizers, back reamers, drill collars, flex drill collars, rotary steerable tools, roller reamers, shock subs, mud motors, logging while drilling (LWD) tools, measuring while drilling (MWD) tools, coring tools, under-reamers, hole openers, centralizers, turbines, bent housings, bent motors, drilling jars, acceleration jars, crossover subs, bumper jars, torque reduction tools, float subs, fishing tools, fishing jars, washover pipe, logging tools, survey tool subs, non-magnetic counterparts of any of these devices, and combinations thereof and their associated external connections.

"Casing" is pipe installed in a wellbore to prevent the hole from collapsing and to enable drilling to continue below the bottom of the casing string with higher fluid density and without fluid flow into the cased formation. Typically, multiple casing strings are installed in the wellbore of progressively smaller diameter.

"Casing centralizers" are banded to the outside of casing as it is being run in hole. Centralizers are often equipped with steel springs or metal fingers that push against the formation to achieve standoff from the formation wall, with an objective to centralize the casing to provide a more uniform annular space around the casing to achieve a better cement seal. Centralizers may include finger-like devices to scrape the wellbore to dislodge drilling fluid filtercake that may inhibit direct cement contact with the formation.

"Casing-while-drilling" refers to a relatively new and unusual method to drill using the casing instead of a removable drill string. When the hole section has reached depth, the casing is left in position, an operation is performed to remove or displace the cutting elements at the bottom of the casing, and a cement job may then be pumped.

"Chemical injection system" is used to inject chemical inhibitors into the wellbore to prevent buildup of scale, methane hydrates, or other deposits in the wellbore that would restrict production.

"Choke" is a device to restrict the rate of flow. Wells are commonly tested on a specific choke size, which may be as simple as a plate with a hole of specified diameter. When sand or proppant flow through a choke, the hole may be eroded and the choke size may change, rendering inaccurate flow rate measurements.

"Coaxial" refers to two or more objects having axes which are substantially identical or along the same line. "Non-coaxial" refers to objects which have axes that may be offset but substantially parallel or may otherwise not be along the same line.

"Completion sliding sleeves" are devices that are installed in the completion string that selectively enable orifices to be opened or closed, allowing productive intervals to be put into communication with the tubing or not, depending on the state of the sleeve. In long term use, the success of operating sliding sleeves depends on the resistance to operating the sleeve due to friction, wear, deposits, erosion, and corrosion.

"Complex geometry" refers to an object that is not substantially comprised of a single primitive geometry such as a sphere, cylinder, or cube. Complex geometries may be comprised of multiple simple geometries, such as a cylinder, cube, or sphere with many different radii, or may be comprised of simple primitives and other complex geometries.

"Connection pin" is a piece of pipe with the threads on the external surface of the pipe.

"Connection box" is a piece of pipe with the threads on the internal surface of the pipe.

"Contact rings" are devices attached to components of logging tools to achieve standoff of the tool from the wall of the casing or formation. For example, contact rings may be installed at joints in a perforating gun to achieve a standoff of the gun from the casing wall, for example in applications such as "Just-In-Time Perforating" (PCT Application No. WO2002/103161A2).

"Contiguous" refers to objects which are adjacent to one another such that they may share a common edge or face. "Non-contiguous" refers to objects that do not have a common edge or face because they are offset or displaced from one another. For example, tool joints are larger diameter cylinders that are non-contiguous because a smaller diameter cylinder, the drill pipe, is positioned between the tool joints.

"Control lines" and "conduits" are small diameter tubing that may be run external to a tubing string to provide hydraulic pressure, electrical voltage or current, or a fiberoptic path, to one or more downhole devices. Control lines are used to operate subsurface safety values, chokes, and valves. An injection line is similar to a control line and may be used to inject a specialty chemical to a downhole valve for the purpose of inhibition of scale, asphaltene, paraffin, or hydrate formation, or for friction reduction.

"Corod™" is a continuous coiled tubular used as a sucker rod in rod pumping production operations.

"Coupling" is a connecting device between two pieces of pipe, often but not exclusively a separate piece that is threadably adapted to two longer pieces that the coupling joins together. For example, a coupling is used to join two pieces of sucker rods in artificial lift rod pumping equipment.

"Cylinder" is (1) a surface or solid bounded by two parallel planes and generated by a straight line moving parallel to the given planes and tracing a curve bounded by the planes and lying in a plane perpendicular or oblique to the given planes, and/or (2) any cylinderlike object or part, whether solid or hollow (source: www.dictionary.com).

"Downhole tools" are devices that are often run retrievably into a well, or possibly fixed in a well, to perform some function in the wellbore. Some downhole tools may be run on a drill stem, such as Measurement While Drilling (MWD) devices, whereas other downhole tools may be run on wireline, such as formation logging tools or perforating guns. Some tools may be run on either wireline or pipe. A packer is a downhole tool that may be run on pipe or wireline to be set in the wellbore to block flow, and it may be removable or fixed. There are many downhole tool devices that are commonly used in the industry.

"Drill collars" are heavy wall pipe in the bottom hole assembly near the bit. The stiffness of the drill collars help the bit to drill straight, and the weight of the collars are used to apply weight to the bit to drill forward.

"Drill stem" is defined as the entire length of tubular pipes, composed of the kelly (if present), the drill pipe, and drill collars, that make up the drilling assembly from the surface to the bottom of the hole. The drill stem does not include the drill bit. In the special case of casing-while-drilling operations, the casing string that is used to drill into the earth formations will be considered part of the drill stem.

"Drill stem assembly" is defined as a combination of a drill string and bottom hole assembly or coiled tubing and bottom hole assembly. The drill stem assembly does not include the drill bit.

"Drill string" is defined as the column, or string of drill pipe with attached tool joints, transition pipe between the drill string and bottom hole assembly including tool joints, heavy weight drill pipe including tool joints and wear pads that transmits fluid and rotational power from the top drive or kelly to the drill collars and the bit. In some references, but not in this document, the term "drill string" includes both the drill pipe and the drill collars in the bottomhole assembly.

"Elastomeric seal" is used to provide a barrier between two devices, usually metal, to prevent flow from one side of the seal to the other. The elastomeric seal is chosen from one of a class of materials that are elastic or resilient.

"Elbows, tees, and couplings" are commonly used pipe equipment for the purpose of connecting flowlines to complete a flowpath for fluids, for example to connect a wellbore to surface production facilities.

"Expandable tubulars" are tubular goods such as casing strings and liners that are slightly undergauge while running in hole. Once in position, a larger diameter tool, or expansion mandrel, is forced down the expandable tubular to deform it to a larger diameter.

"Gas lift" is a method to increase the flow of hydrocarbons in a wellbore by injecting gas into the tubing string through gas lift valves. This process is usually applied to oil wells, but could be applied to gas wells with high fractions of water production. The added gas reduces the hydrostatic head of the fluid column.

"Glass fibers" are often run in small control lines, both downhole and return to surface, for the measurement of downhole properties, such as temperature or pressure. Glass fibers may be used to provide continuous readings at fine spatial samplings along the wellbore. The fiber is often pumped down one control line, through a "turnaround sub," and up a second control line. Friction and resistance passing through the turnaround sub may limit some fiberoptic installations.

"Inflow control device" (ICD) is an adjustable orifice, nozzle, or flow channel in the completion string across the formation interval to enable the rate of flow of produced fluids into the wellbore. This may be used in conjunction with additional measurements and automation in a "smart" well completion system.

"Jar" is a downhole tool that is used to apply a large axial load, or shock, when triggered by the operator. Some jars are fired by setting weight down, and others are fired when pulled up. The firing of the jar is usually done to move pipe that has become stuck in the wellbore.

"Kelly" is a flat-sided polygonal piece of pipe that passes through the drilling rig floor on rigs equipped with older rotary table equipment. Torque is applied to this four-, six-, or perhaps eight-sided piece of pipe to rotate the drill pipe that is connected below.

"Logging tools" are instruments that are typically run in a well to make measurements, for example during drilling on the drill stem or in open or cased hole on wireline. The instruments are installed in a series of carriers configured to run into a well, such as cylindrical-shaped devices, that provide environmental isolation for the instruments.

"Makeup" is the process of screwing together the pin and box of a pipe connection to effect a joining of two pieces of pipe and to make a seal between the inner and outer portions of the pipe.

"Mandrel" is a cylindrical bar or shaft that fits within an outer cylinder. A mandrel may be the main actuator in a packer that causes the gripping units, or "slips," to move outward to contact the casing. The term mandrel may also refer to the tool that is forced down an expandable tubular to deform it to a larger diameter. Mandrel is a generic term used in several types of oilfield devices.

"Metal mesh" for a sand control screen is comprised of woven metal filaments that are sized and spaced in accordance with the corresponding formation sand grain size distribution. The screen material is generally corrosion resistant alloy (CRA) or carbon steel.

"Mazeflo™" completion screens are sand screens with redundant sand control and baffled compartments. MazeFlo self-mitigates any mechanical failure of the screen to the local compartment maze, while allowing continued hydrocarbon flow through the undamaged sections. The flow paths are offset so that the flow makes turns to redistribute the incoming flow momentum (for example, refer to U.S. Pat. No. 7,464,752).

"Moyno™ pumps" and "progressive cavity pumps" are long cylindrical pumps installed in downhole motors that generate rotary torque in a shaft as the fluid flows between the external stator and the rotor attached to the shaft. There is usually one more lobe on the stator than the rotor, so the force of the fluid traveling to the bit forces the rotor to turn. These motors are often installed close to the bit. Alternatively, in a downhole pumping device, power can be applied to turn the rotor and thereby pump fluid.

"Packer" is a tool that may be placed in a well on a work string, coiled tubing, production string, or wireline. Packers provide fluid pressure isolation of the regions above and below the packer. In addition to providing a hydraulic seal that must be durable and withstand severe environmental conditions, the packer must also resist the axial loads that develop due to the fluid pressure differential above and below the packer.

"Packer latching mechanism" is used to operate a packer, to make it release and engage the slips by axial movement of the pipe to which it is connected. When engaged, the slips are forced outwards into the casing wall, and the teeth of the slips are pressed into the casing material with large forces. A wireline packer is run with a packer setting tool that pulls the mandrel to engage the slips, after which the packer setting tool is disengaged from the packer and retrieved to the surface.

"MP35N" is a metal alloy consisting primarily of nickel, cobalt, chromium, and molybdenum. MP35N is considered highly corrosion resistant and suitable for hostile downhole environments.

"Paraffin" is a waxy component of some crude hydrocarbons that may be deposited on the walls of wellbores and flowlines and thereby cause flow restrictions.

"Pin-down connection" is currently the standard drilling configuration in which the box connection is held by the slips at the surface and the pin connection is facing down during connection makeup.

"Pin-up connection" is a drilling tool assembly that is oriented such that the pin connection is held in the slips at surface while making a connection, instead of the standard configuration in which the box connection is held by the slips. This reconfiguration may or may not require a change in the thread direction of the connection, i.e. left-handed or right-handed threads.

"Pistons" and "piston liners" are cylinders that are used in pumps to displace fluids from an inlet to an outlet with corresponding fluid pressure increase. The liner is the sleeve within which the piston reciprocates. These pistons are similar to the pistons found in the engine of a car.

"Plunger lift" is a device that moves up and down a tubing string to purge the tubing of water, similar to a pipeline "pigging" operation. With the plunger lift at the bottom of the tubing, the pig device is configured to block fluid flow, and therefore it is pushed uphole by fluid pressure from below. As it moves up the wellbore it displaces water because the water is not allowed to separate and flow past the plunger lift. At the top of the tubing, a device triggers a change in the plunger lift configuration such that it now bypasses fluids, whereupon gravity pulls it down the tubing against the upwards flowstream. Friction and wear are important parameters in plunger lift operation. Friction reduces the speed of the plunger lift falling or rising, and wear of the outer surface provides a gap that reduces the effectiveness of the device when traveling uphole.

"Production device" is a broad term defined to include any device related to the drilling, completion, stimulation, workover, or production of an oil and/or gas well. A production device includes any device described herein used for the purpose of oil or gas production. For convenience of terminology, injection of fluids into a well is defined to be production at a negative rate. Therefore, references to the word "production" will include "injection" unless stated otherwise.

"Reciprocating seal assembly" is a seal that is designed to maintain pressure isolation while two devices are displaced axially.

"Roller cone bit" is an earth-boring device equipped with conical shaped cutting elements, usually three, to make a hole in the ground.

"Rotating seal assembly" is a seal that is designed to maintain pressure isolation while two devices are displaced in rotation.

"Sand probe" is a small device inserted into a flowstream to assess the amount of sand content in the stream. If the sand content is high, the sand probe may be eroded.

"Scale" is a deposit of minerals (e.g. calcium carbonate) on the walls of pipes and other flow equipment that may build up and cause a flow restriction.

"Service tools" for gravel pack operations include a packer crossover tool and tailpipe to circulate down the workstring, around the liner and tailpipe, and back to the annulus. This permits placement of slurry opposite the formation interval. More generally, the gravel pack service tool is a group of tools that carry the gravel pack screens to TD, sets and tests the packer, and controls the flow path of the fluids pumped during gravel pack operations. The service tool includes the setting tool, the crossover, and the seals that seal into a packer bore. It can include an anti-swab device and a fluid loss or reversing valve.

"Shock sub" is a modified drill collar that has a shock absorbing spring-like element to provide relative axial motion between the two ends of the shock sub. A shock sub is sometimes used for drilling very hard formations in which high levels of axial shocks may occur.

"Shunt tubes" are external or internal tubes run in a sand control screen to divert the gravel pack slurry flow over long or multi-zone completion intervals until a complete gravel pack is achieved. See, for example, U.S. Pat. Nos. 4,945,991, 5,113,935, and PCT Patent Publication Nos. WO2007/092082, WO2007/092083, WO2007/126496, and WO2008/060479.

"Sidepocket" is an offset heavy-wall sub in the tubing for placing gas lift valves, temperature and pressure probes, injection line valves, etc.

"Sleeve" is a tubular part designed to fit over another part. The inner and outer surfaces of the sleeve may be circular or non-circular in cross-section profile. The inner and outer surfaces may generally have different geometries, i.e. the outer surface may be cylindrical with circular cross-section, whereas the inner surface may have an elliptical or other non-circular cross-section. Alternatively, the outer surface may be elliptical and the inner surface circular, or some other combination. More generally, a sleeve may be considered to be a generalized hollow cylinder with one or more radii or varying cross-sectional profiles along the axial length of the cylinder.

"Sliding contact" refers to frictional contact between two bodies in relative motion, whether separated by fluids or solids, the latter including particles in fluid (bentonite, glass beads, etc) or devices designed to cause rolling to mitigate friction. A portion of the contact surface of two bodies in relative motion will always be in a state of slip, and thus sliding.

"Smart well" is a well equipped with devices, instrumentation, and controls to enable selective flow from specified intervals to maximize production of desirable fluids and minimize production of undesirable fluids. The flow rates may be adjusted for additional reasons, such as to control the drawdown or pressure differential for geomechanics reasons.

"Stimulation treatment" lines are pipe used to connect pumping equipment to the wellhead for the purpose of conducting a stimulation treatment.

"Subsurface safety valve" is a valve installed in the tubing, often below the seafloor in an offshore operation, to shut off flow. Sometimes these valves are set to automatically close if the rate exceeds a set value, for instance if containment was lost at the surface.

"Sucker rods" are steel rods that connect a beam-pumping unit at the surface with a sucker-rod pump at the bottom of a well. These rods may be jointed and threaded or they may be continuous rods that are handled like coiled tubing. As the rods reciprocate up and down, there is friction and wear at the locations of contact between the rod and tubing.

"Surface flowlines" are pipe used to connect the wellhead to production facilities, or alternatively, for discharge of fluid to the pits or flare stack.

"Threaded connection" is a means to connect pipe sections and achieve a hydraulic seal by mechanical interference between interlaced threaded, or machined (e.g., metal-to-metal seal), parts. A threaded connection is made up, or assembled, by rotating one device relative to another. Two pieces of pipe may be adapted to thread together directly, or a connector piece referred to as a coupling may be screwed onto one pipe, followed by screwing a second pipe into the coupling.

"Tool joint" is a tapered threaded coupling element for pipe that is usually made of a special steel alloy wherein the pin and box connections (externally and internally threaded, respectively) are fixed to either ends of the pipe. Tool joints are commonly used on drill pipe but may also be used on work strings and other OCTG, and they may be friction welded to the ends of the pipe.

"Top drive" is a method and equipment used to rotate the drill pipe from a drive system located on a trolley that moves up and down rails attached to the drilling rig mast. Top drive is the preferred means of operating drill pipe because it facilitates simultaneous rotation and reciprocation of pipe and circulation of drilling fluid. In directional drilling operations, there is often less risk of sticking the pipe when using top drive equipment.

"Tubing" is pipe installed in a well inside casing to allow fluid flow to the surface.

"Valve" is a device that is used to control the rate of flow in a flowline. There are many types of valve devices, including check valve, gate valve, globe valve, ball valve, needle valve, and plug valve. Valves may be operated manually, remotely, or automatically, or a combination thereof. Valve performance is highly dependent on the seal established between close-fitting mechanical devices.

"Valve seat" is the static surface upon which the dynamic seal rests when the valve is operated to prevent flow through the valve. For example, a flapper of a subsurface safety valve will seal against the valve seat when it is closed.

"Wash pipe" in a sand control operation is a smaller diameter pipe that is run inside the basepipe after the screens are placed in position across the formation interval. The wash pipe is used to facilitate annular slurry flow across the entire completion interval, take the return flow during the gravel packing treatment, and leave gravel pack in the screen-wellbore annulus.

"Washer" is typically a flat ring that is used to prevent leakage, distribute pressure, or make a joint tight, as under the head of a nut or bolt, or perhaps in a threaded connection of another part, such as a valve. A washer may be considered as a degenerate form of a sleeve in which the diametral dimension is greater than the axial dimension.

"Wireline" is a cable that is used to run tools and devices in a wellbore. Wireline is often comprised of many smaller strands twisted together, but monofilament wireline, or "slick line," also exists. Wireline is usually deployed on large drums mounted on logging trucks or skid units.

"Work strings" are jointed pieces of pipe used to perform a wellbore operation, such as running a logging tool, fishing materials out of the wellbore, or performing a cement squeeze job.

(Note: Several of the above definitions are from *A Dictionary for the Petroleum Industry*, Third Edition, The University of Texas at Austin, Petroleum Extension Service, 2001.)

DETAILED DESCRIPTION

All numerical values within the detailed description and the claims herein are modified by "about" or "approximately" the indicated value, and take into account experimental error and variations that would be expected by a person having ordinary skill in the art.

Reconfiguration of equipment to utilize sleeves at designated locations, such as the point of contact between two or more bodies, facilitates the use of this low-friction technology. The use of coatings on sleeve elements provides a small piece that can be readily placed into a manufacturing device or chamber to apply such coating, with improved economics. Removable sleeves may be replaced more readily within the context of ongoing field operations, using small components that can be readily moved between manufacturing facilities and field locations. Furthermore, for metallurgical considerations, a wider selection of coatings and substrate materials are available for these devices that may not be primary stress members of the oil and gas production operations system. Coatings applied at elevated temperatures would incur additional manufacturing complexities because such operations could adversely affect the heat treatment of such materials.

Additionally and alternatively, the design configuration of the downhole equipment may be modified to facilitate the use of sleeves. For example, the orientation of the tooljoints of a drilistring or workstring may optionally be altered such that the externally-threaded pin connection is held at the surface during tool joint connection operations, instead of the internally-threaded box connection. This reconfiguration facilitates the use of sleeves because the sleeve does not fall down the hole or to the ground when the connection is broken during pipe tripping operations. With this design, there is no need for threading of the sleeve element as specified in U.S. Pat. No. 7,028,788 ("Wear Sleeve").

In one embodiment of the disclosure, the axis of the sleeve element may be substantially parallel to the axis of the cylinder to which it is proximal. The sleeve element may be free in one or more degrees of freedom or it may be fixed relative to the proximal object (cylinder or body) using an appropriate attachment mechanism or geometric means to provide restraint. Typically, the sleeve element would be constrained to move at least axially with the proximal object, but it may be constrained or free in rotation. The use of elliptical or non-circular cross-sections at the interface between the sleeve and the proximal object would be one of several possible means to constrain the sleeve to rotate with the proximal object. Furthermore, the sleeve element may be inside or outside of the proximal object depending on the specific characteristics and use of the sleeved oil and gas production device.

The sleeve may be made of any load bearing material such as metals, alloys, ceramics, cermets, polymers, any type of steel (carbon steel, alloy steel, and any type of stainless steel), WC based hard metals, and any of the combination of materials mentioned. The sleeve material may be subject to local, lateral loads, but usually not to the typically much larger axial loads experienced by the body that it is proximal to. Thus, the sleeve material and geometry is not as limited by strength and toughness requirements compared to the body. This allows selection of the material for the sleeve to be based on, but not limited to, conditions such as the type of the coating and its processing temperature.

Similar reconfigurations for other oil and gas production devices are feasible within the scope of the disclosure to facilitate the use of sleeves which may be coated with the materials that have been identified.

Figure 1B:
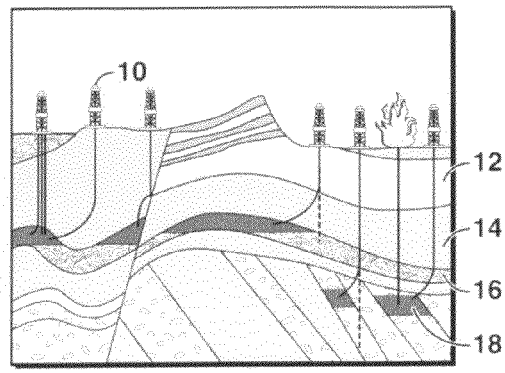
Figure 1C:
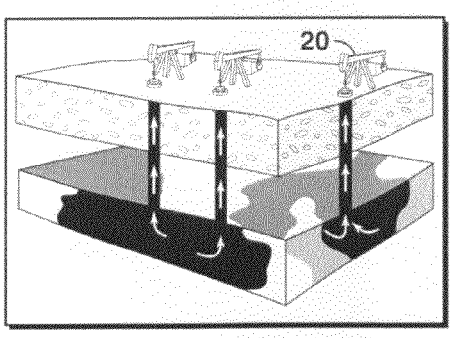
Figure 1D:
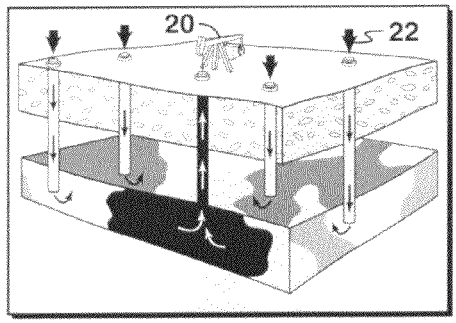
Figure 1E:
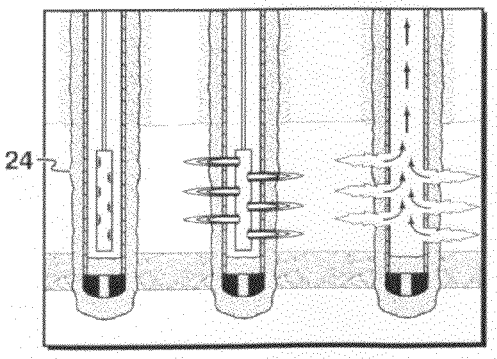
Figure 1F:
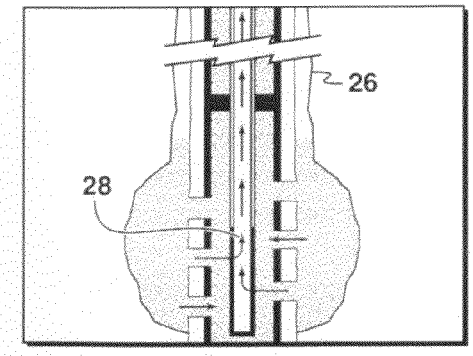

Disclosed herein are coated sleeved oil and gas well production devices and methods of making and using such coated sleeved devices. The coatings described herein provide significant performance improvement of the various oil and gas well devices and operations disclosed herein. FIG. 1 illustrates the overall oil and gas well production system, for which the application of coatings to certain sleeved production devices as described herein may provide improved performance of these devices. FIG. 1A is a schematic of a land based drilling rig 10. FIG. 1B is a schematic of drilling rigs 10 drilling directionally through sand 12, shale 14, and water 16 into oil fields 18. FIGS. 1C and 1D are schematics of producing wells 20 and injection wells 22. FIG. 1E is a schematic of a perforating gun 24. FIG. 1F is a schematic of gravel packing 26 and screen liner 28. With no loss of generality, different inventive coatings may be preferred for different well production devices, and different types of sleeves may be appropriate for different well production devices. A broad overview of production operations in its entirety shows the extent of the possible field applications for coated sleeve devices to mitigate friction, wear, erosion, corrosion, and deposits.

The method of coating such sleeved devices disclosed herein includes applying a suitable coating to a portion of the inner sleeve surface, outer sleeve surface, or a combination thereof that will be subject to friction, wear, corrosion, erosion, and/or deposits. A coating is applied to at least a portion of the sleeve surface that is exposed to contact with another solid or with a fluid flowstream, wherein: the coefficient of friction of the coating is less than or equal to 0.15; the hardness of the coating is greater than 400 VHN; the wear resistance of the coated sleeved device is at least 3 times that of the uncoated device; and/or the surface energy of the coating is less than 1 $J/m^2$. There is art to choosing the appropriate coating from the disclosed coatings and designing the appropriate sleeve element for the specific application to maximize the technical and economic advantages of this technology.

U.S. patent application Ser. No. 12/583,292 filed on Aug. 18, 2009, herein incorporated by reference in its entirety, discloses the use of ultra-low friction coatings on drill stem assemblies used in oil and gas drilling applications. U.S. patent application Ser. No. 12/583,302 filed on Aug. 18, 2009, herein incorporated by reference in its entirety, discloses the use of coatings on oil and gas well production devices.

A drill stem assembly is one example of a production device that may benefit from the use of coatings. The geometry of an operating drill stem assembly is one example of a class of applications comprising a cylindrical body. In the case of the drill stem, the actual drill stem assembly is an inner cylinder that is in sliding contact with the casing or open hole, an outer cylinder. These devices may have varying radii and alternatively may be described as comprising multiple contiguous cylinders of varying radii. As described below, there are several other instances of cylindrical bodies in oil and gas well production operations, either in sliding contact due to relative motion or stationary subject to contact by fluid flowstreams. The inventive coatings may be used advantageously for each of these applications by considering the relevant problem to be addressed, by evaluating the contact or flow problem to be solved to mitigate friction, wear, corrosion, erosion, or deposits, and by judicious consideration of how to design a sleeve into the device configuration and apply such coatings to these sleeve elements for maximum utility and benefit to achieve an advantageous coated sleeved oil and gas production device.

There are many more examples of oil and gas well production devices that provide opportunities for beneficial use of coated sleeved devices, as described in the background, including: stationary sleeved devices with coated sleeve elements for low friction on initial installation, and for resistance to wear, corrosion and erosion, and resistance to deposits on external or internal surfaces; and sleeved bearings, bushings, and other geometries wherein the sleeve element is coated for friction and wear reduction and resistance to corrosion and erosion.

In each case, there may be primary and secondary motivations for the use of coated sleeved devices to mitigate friction, wear, corrosion, erosion, and deposits. The same device may include more than one sleeve element with different coatings applied to address different coatings design aspects, including the problem to be addressed, the technology available for application of the coatings to the sleeve elements, and the economics associated with each type of coating. There will likely be many tradeoffs and compromises that govern the ultimate design of the sleeve element and selection of the coating to be applied.

Overview of Use of Coated Sleeved Devices and Associated Benefits:

In the wide range of operations and equipment that are required during the various stages of preparing for and producing hydrocarbons from a wellbore, there are several prototypical applications that appear in various contexts. These applications may be seen as various geometries of bodies in sliding mechanical contact and fluid flows interacting with the surfaces of solid objects. The designs of these components may be adapted to incorporate coated sleeve elements to reduce friction, wear, erosion, corrosion, and deposits. In this sense, the components then become "coated sleeved oil and gas well production devices." Several specific geometries and exemplary applications are enumerated below, but a person skilled in the art will understand the broad scope of the applications of coated sleeve devices and this list does not limit the range of the inventive methods disclosed herein:

A. Coated Sleeved Cylindrical Bodies in Sliding Contact Due to Relative Motion:

In an application that is ubiquitous throughout production operations, two cylindrical bodies are in contact, and friction and wear occur as one body moves relative to the other. The bodies may be comprised of multiple cylindrical sections that are placed contiguously with varying radii, and the cylinders may be placed coaxially or non-coaxially. The component design may be adapted to place a sleeve element at the point of contact between the two cylindrical bodies. This sleeve element may be coated on at least a portion of the inner sleeve surface, outer sleeve surface, or some combination thereof to beneficially reduce the contact friction and wear. The sleeve element may optionally be removable and may be subsequently serviced or replaced, as necessary and appropriate for the device application.

For example, devising a sleeve element for the tool joints of drill pipe or workstring and coating such sleeve elements may be an effective means to utilize coatings to reduce the contact friction between drill stem and casing or open-hole. For casing, tubing, and sucker rod strings, the pipe coupling is a sleeve element that may have coatings applied to a portion of the inner or outer surface area, or a combination thereof. In yet another application, plunger-type artificial lift devices, it may be advantageous to adapt the tool to have one or more coated sleeve elements comprising the maximum outer diameter of the device to reduce wear and friction due to contact with the tubing string.

Figure 2A:
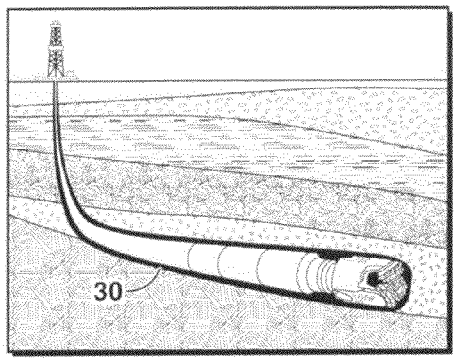
FIG. 2 depicts exemplary application of a coating applied to a sleeved drill stem assembly for subterreaneous drilling applications.
Figure 2B:
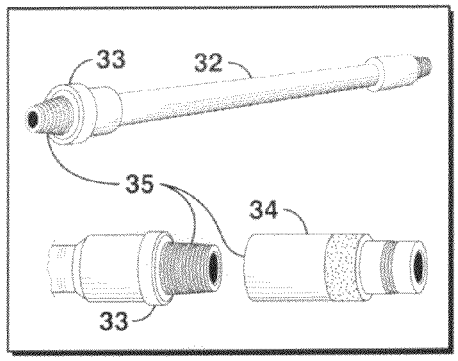
Figure 2C:
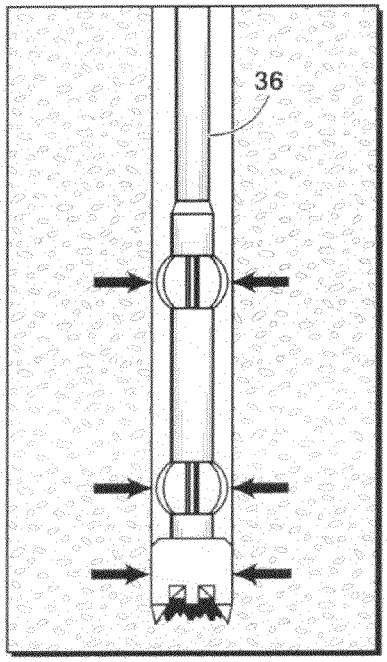
Figure 2D:
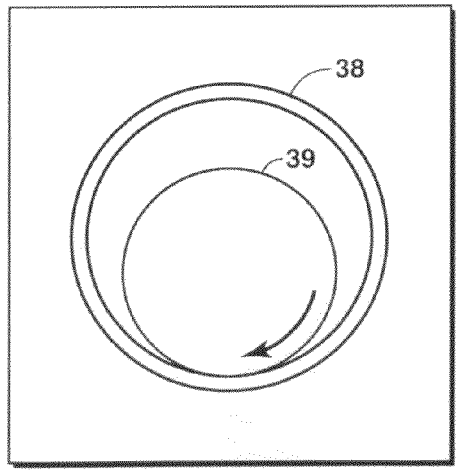

An Exemplary List of Such Applications is as Follows:

Drill pipe may be picked up or slacked off causing longitudinal motion and may be rotated within casing or open hole. Friction forces and device wear increase as the well inclination increases, as the local wellbore curvature increases, and as the contact loads increase. These friction loads cause significant drilling torque and drag which must be overcome by the rig and drill string devices (see FIG. 2). FIG. 2A exhibits deflection occurring in a drill string assembly 30 in a directional or horizontal well. FIG. 2B is a schematic of a drill pipe 32 and a tool joint 34, with threaded connection 35. A coated sleeve element 33 at the pin connection is illustrated in this figure. FIG. 2C is a schematic of a bit and bottom hole assembly 36. FIG. 2D is a schematic of a casing 38 and a tool joint 39 to show the contact that occurs between the two cylindrical bodies. Friction reducing coatings applied to sleeve elements disclosed herein may be used to reduce the friction and wear between the two components as the tool joint 39 rotates within the casing 38, also reducing the torque required to turn the tool joint 39 for drilling lateral wells.

Figure 3A:
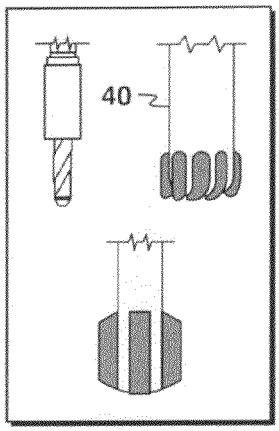
FIG. 3 depicts exemplary application of coatings applied to bottomhole assembly devices that may be adapted to use coated sleeves, in this case reamers, stabilizers, mills, and hole openers.
Figure 3B:
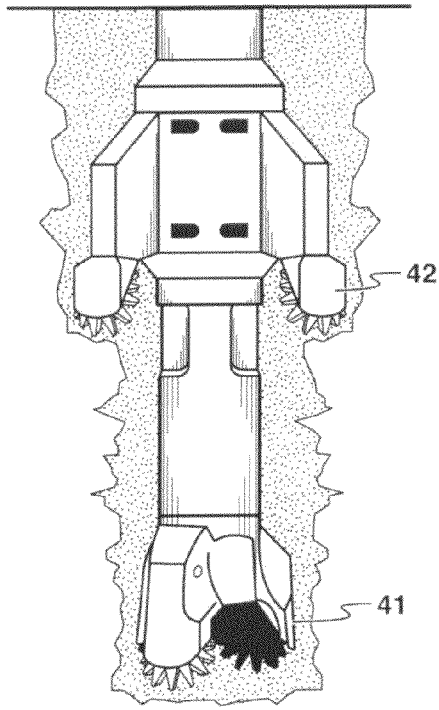
Figure 3C:
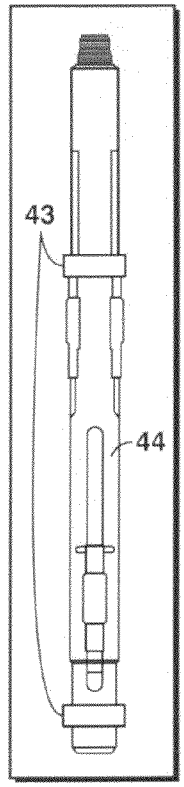
Figure 3D:
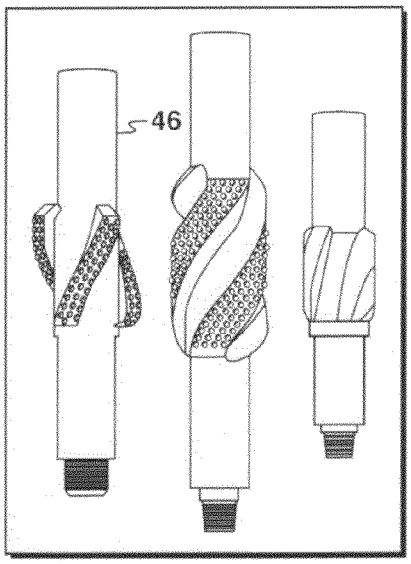
Figure 3E:
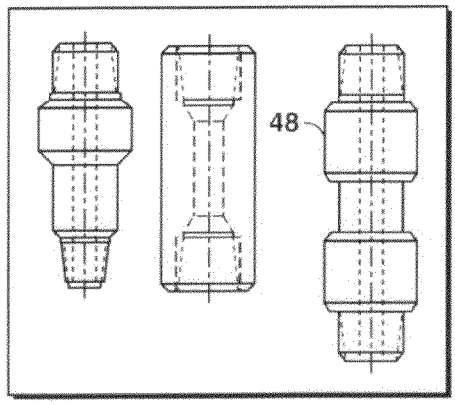

Bottomhole assembly (BHA) devices are located below the drill pipe on the drill stem assembly and may be subjected to similar friction and wear, and thus the coatings disclosed herein may provide a reduction in these mechanical problems (see FIG. 3). In particular, the coatings disclosed herein applied to the BHA devices may reduce friction and wear at contact points with the open hole and lengthen the tool life. Low surface energy of the coatings disclosed herein may also inhibit sticking of formation cuttings to the tools and corrosion and erosion limits may also be extended. It may also reduce the tendency for differential sticking. FIG. 3A is a schematic of mills 40 used in bottomhole assembly devices. FIG. 3B is a schematic of a bit 41 and a hole opener 42 used in bottomhole assembly devices. FIG. 3C is a schematic of a reamer 44 used in bottomhole assembly devices. Coated sleeve elements 43 are illustrated in this figure. FIG. 3D is a schematic of stabilizers 46 used in bottomhole assembly devices. FIG. 3E is a schematic of subs 48 used in bottomhole assembly devices.

Figure 4:
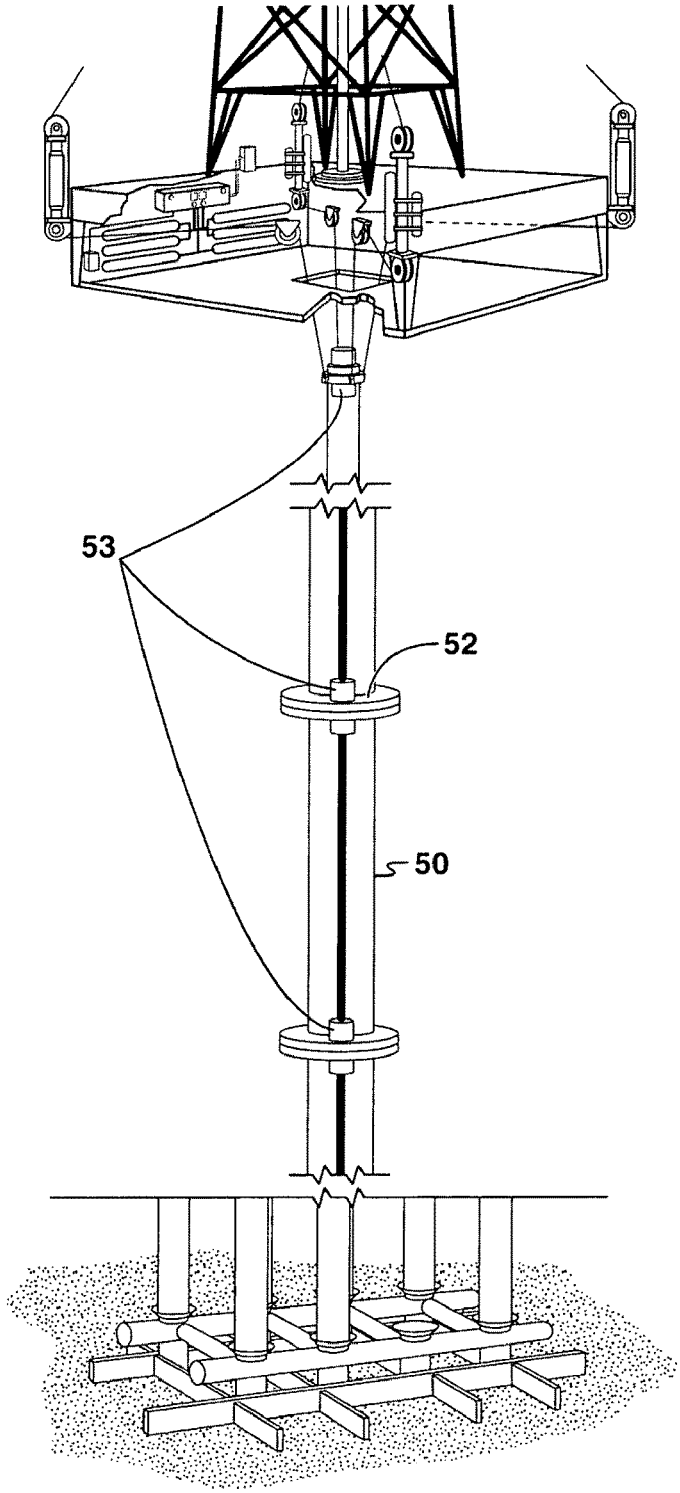
FIG. 4 depicts exemplary application of a coating applied to a marine riser system with coated sleeve wear bushings.

Drill strings are operated within marine riser systems and may cause wear to the riser as a result of the drilling operation. The vibrations of the riser due to ocean currents may be mitigated by coatings, and marine growth may also be inhibited, further reducing the drag associated with flowing currents. Referring to FIG. 4, use of the coatings disclosed herein on the riser pipe exterior 50 may be used to reduce friction and vibrations due to ocean currents. In addition, the use of the coatings disclosed herein on sleeved internal bushings 52 and other contact points which may be protected by coated sleeved devices may be used to reduce friction and wear. Coated sleeve elements 53 may be adapted to the riser connection and are illustrated in this figure.

Plunger lifts remove water from a well by running up and down within a tubing string. Both the plunger lift outer diameter and the tubing inner diameter may be affected by wear, and the efficiency of the plunger lift decreases with wear and contact friction. Reducing friction will increase the maximum allowable deviation for plunger lift operation and increase the range of applicability of this technology. Reducing the wear of both tubing and plunger lift will increase the time interval between required servicing. From an operations perspective, reducing the wear of the tubing inner diameter is highly desirable. Furthermore, coating the internal surface of a plunger lift may be beneficial. Coated sleeve elements may be banded to the outside of the plunger lift tool, wherein the outer diameter of the sleeve elements would be nearly equal to the inner diameter of the tubing in which the device is operated, minus some tolerance to allow the plunger to slide within the tubing string. Depending on the plunger lift design, these sleeve elements could be replaced in the field and the tool returned to service. Alternatively, the entire surface area of the plunger lift device could be coated to reduce friction and wear. In the bypass state, fluid will flow through the tool more easily if the flow resistance is reduced by coatings on the internal portions of the tool, allowing the tool to drop faster.

Completion sliding sleeves may be moved axially, for example by stroking coiled tubing to displace the cylindrical sleeve up or down relative to the tool body that may also be cylindrical. These sleeves become susceptible to friction, wear, erosion, corrosion, and sticking due to damage from formation materials and buildup of scale and deposits. Coating portions of sleeve elements to enable movement within these sliding sleeve systems will help to ensure that the sliding sleeve device will not stick when it is required to be moved.

Figure 5A:
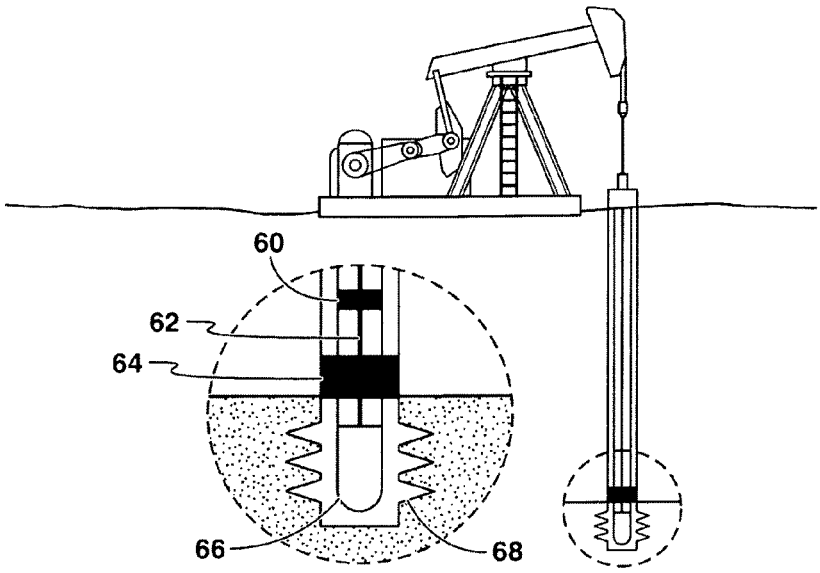
FIG. 5 depicts exemplary application of coated sleeves applied to polished rods, sucker rods, and pumps used in downhole pumping operations.
Figure 5B:
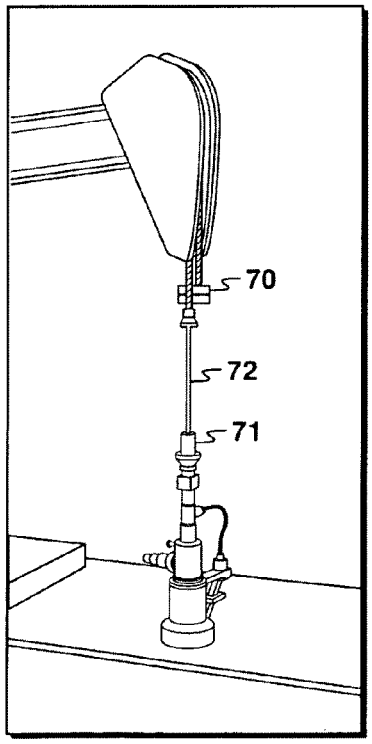
Figure 5C:
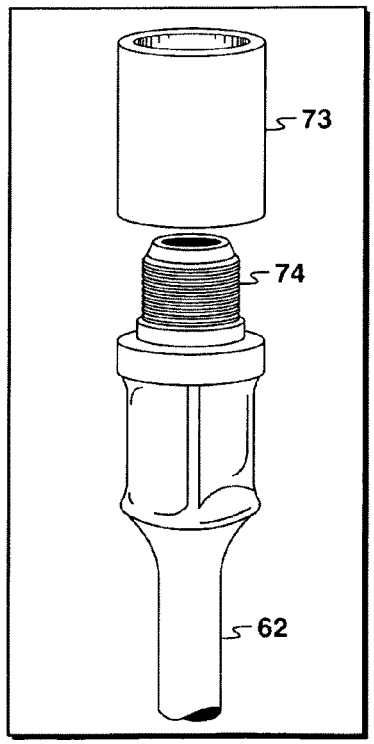

Sucker rods and Corod™ tubulars are used in pumping jacks to pump oil to the surface in low pressure wells, and they may also be used to pump water out of gas wells. Friction and wear occur continuously as the rods move relative to the tubing string. A reduction in friction may enable selection of smaller pumping jacks and reduce the power requirements for well pumping operations (see FIG. 5). Referring to FIG. 5A, the coated sleeves disclosed herein may be used at the contact points of rod pumping devices, including, but not limited to, the sucker rod coupling, which is a sleeve device attached to the sucker rod 62, the sucker rod guide 60, the sucker rod 62, the tubing packer 64, the downhole pump 66, and the perforations 68. Referring to FIG. 5B, the coatings disclosed herein may be used on polished rod clamp 70 and the polished rod 72 to provide smooth durable surfaces as well as good seals. A coated sleeve element 71 is illustrated at the sucker rod pack-off to provide a low-friction tight seal. FIG. 5C is a schematic of a sucker rod 62 wherein the coatings disclosed herein may be used to prevent friction and wear and on the threaded connections 74. A sucker rod coupling 73 may be coated as a sleeve element in its own right, or it may be adapted for use with an external coated sleeve, to provide a low-friction durable surface in contact with the tubing string in which it reciprocates.

Sleeve devices in pistons and/or piston liners in pumps for drilling fluids on drilling rigs and in pumps for stimulation fluids in well stimulation activities may be coated to reduce friction and wear, enabling improved pump performance and longer device life. Since certain equipment is used to pump acid, the coated sleeve liners may also reduce corrosion and erosion damage to these devices.

Expandable tubulars are typically run in hole, supported with a hanging assembly, and then expanded by running a mandrel through the pipe. Coating the surface of the mandrel may greatly reduce the mandrel load and enable expandable tubular applications in higher inclination wells or at higher expansion ratios than would otherwise be possible. The mandrel may be configured to have coated sleeve devices at the locations of highest contact stress. If removable, these coated sleeves would enable longer mandrel tool life and possible redressing in the field. The speed and efficiency of the expansion operation may be improved by significant friction reduction. The mandrel is a tapered cylinder and may be considered to be comprised of contiguous cylinders of varying radii; alternatively, a tapered mandrel may be considered to have a complex geometry.

Control lines and conduits may be internally coated for reduced flow resistance and corrosion/erosion benefits. Glass filament fibers may be pumped down internally coated conduits and turnaround subs with reduced resistance.

Figure 6A:
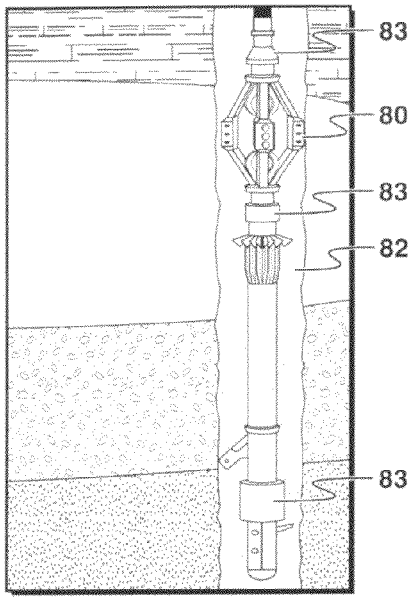
FIG. 6 depicts exemplary application of coated sleeves applied to perforating guns, packers, and logging tools.
Figure 6B:
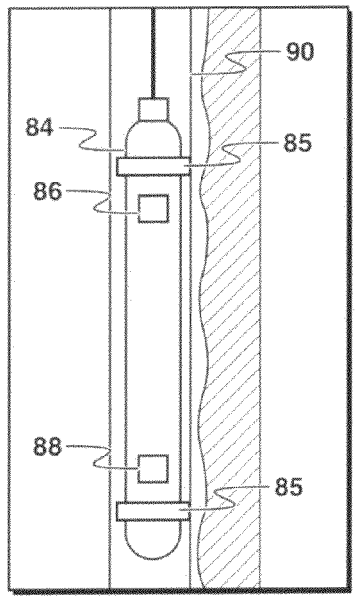
Figure 6C:
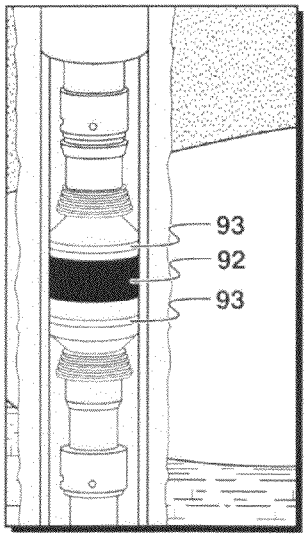
Figure 6D:
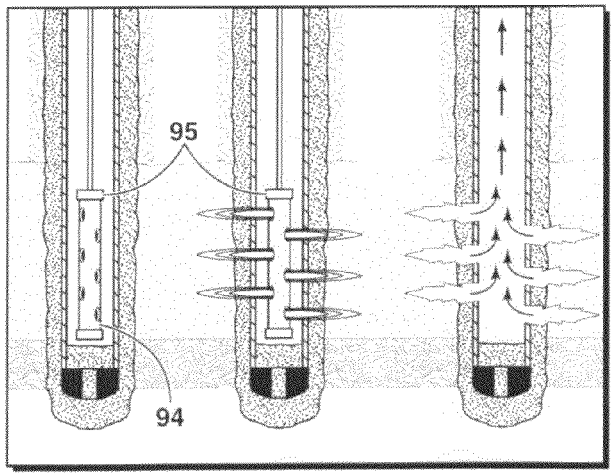

Tools operated in wellbores are typically cylindrical bodies or bodies comprised of contiguous cylinders of varying radii that are operated in casing, tubing, and open hole, either on wireline or rigid pipe. Friction resistance increases as the wellbore inclination increases or local wellbore curvature increases, rendering operation of such tools to be unreliable on wireline. Coated sleeve devices at the contact surfaces may enable such tools to be reliably operated on wireline at higher inclinations or reduce the force to push tools down a horizontal well using coiled tubing, tractors, or pump-down devices. A list of such tools includes but is not limited to: logging tools, perforating guns, and packers (see FIG. 6). Referring to FIG. 6A, the coatings disclosed herein may be used on the external surfaces of a caliper logging tool 80 to reduce friction and wear with the open hole 82 or casing (not shown). The components with maximum diameter 83 may be sleeved with low-friction coating sleeves to enable the tool to run in hole with less resistance and wear. Referring to FIG. 6B, the coatings disclosed herein may be used on the external sleeved surfaces 85 of an acoustic logging sonde 84, including, but not limited to, the signal transmitter 86 and signal receiver 88 to reduce friction and wear with the casing 90 or in open hole. Referring to FIGS. 6C and 6D, the coatings disclosed herein may be used on the external coated sleeved surfaces 93 of packer tools 92 and on sleeves 95 of perforating gun 94 to reduce friction and wear with the open hole. Low surface energy of the coatings will inhibit sticking of formation to the tools, and corrosion and erosion limits may also be extended.

Figure 7A:
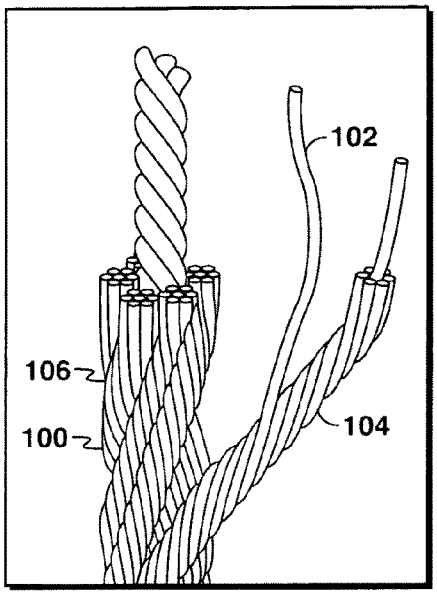
FIG. 7 depicts exemplary application of coatings applied to wire rope and wire line and bundles of stranded cables. Coated sleeves may be used in the bushings to facilitate smooth wireline operations.
Figure 7B:
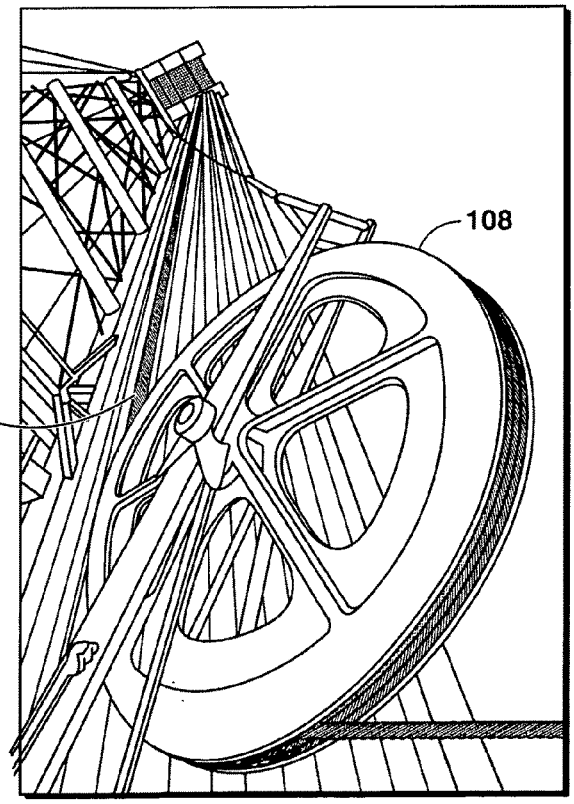

Wireline is a slender cylindrical body that is operated within casing, tubing, and open hole. At a higher level of detail, each strand is a cylinder, and the twisted strands are a bundle of non-coaxial cylinders that together comprise the effective cylinder of the wireline. Friction forces are present at the contact points between wireline and wellbore, and therefore coating the wireline with low-friction coatings will enable operation with reduced friction and wear. Braided line, multi-conductor, single conductor, and slickline may all be beneficially coated with low-friction coatings (see FIG. 7). Referring to FIG. 7A, the coatings disclosed herein may be applied to the wire line 100 by application to the wire 102, the individual strands of wire 104 or to the bundle of strands 106. A pulley type device 108 as seen in FIG. 7B may be used to run logging tools conveyed by wireline 100 into casing, tubing and open hole. The pulley device may use coated sleeves advantageously in the areas of the pulley and bearings that are subject to load and wear due to friction.

Casing centralizers and contact rings for downhole tools are sleeve devices that may be coated to reduce the friction resistance of placing these devices in a wellbore and providing movement downhole, particularly in high wellbore inclination angles.

B. Coated Cylindrical Bodies that are Primarily Stationary:

There are diverse applications for coating sleeved portions of the exterior, interior, or both of cylindrical bodies (e.g., pipe or modified pipe), primarily for erosion, corrosion, and wear resistance, but also for friction reduction of fluid flow. The cylindrical bodies may be coaxial, contiguous, non-coaxial, non-contiguous or any combination thereof, with sleeves in proximal location to the inner or outer surface of a cylindrical body. In these applications, the coated sleeved cylindrical device may be essentially stationary for long periods of time, although perhaps a secondary benefit or application of the coated sleeve is to reduce friction loads when the production device is installed.

An Exemplary List of Such Applications is as Follows:

Perforated basepipe, slotted basepipe, or screen basepipe for sand control are often subject to erosion and corrosion damage during the completion and stimulation treatment (e.g., gravel pack or frac pack treatment) and during the well productive life. For example, a coating obtained with the inventive method will provide greater inner diameter for the flow and reduce the flowing pressure drop relative to thicker plastic coatings. In another example, corrosive produced fluids may attack materials and cause material loss over time. Furthermore, highly productive formation intervals may provide fluid velocities that are sufficiently high to cause erosion. These fluids may also carry solid particles, such as fines or formation sand with a tendency to fail the completion device. It is further possible for deposits of asphaltenes, paraffins, scale, and hydrates to form on the completion equipment such as basepipes. Coatings can provide benefits in these situations by reducing the effects of friction, wear, corrosion, erosion, and deposits. (See FIG. 8.) Certain coatings for screen applications have been disclosed in U.S. Pat. No. 6,742,586 B2. The use of coated sleeved devices in this application facilitates installation of the sand control device due to reduced friction and wear. Coated sleeved devices may also be used as "blast joints" where high sand and proppant particle velocities may be expected to reduce the useful life of the sand screen material.

Wash pipes, shunt tubes, and service tools used in gravel pack operations may be coated internally, externally, or both to reduce erosion and flow resistance. Fluids with entrained solids for the gravel pack are pumped at high rates through these devices. Sleeved devices may be used at specific locations in these tools to protect the main body of the device from erosion due to sand and proppant flow.

Blast joints may be advantageously coated for greater resistance to erosion resulting from impingement of fluids and solids at high velocity. Coated sleeved devices may be used advantageously on blast joints at the specific locations where the greatest amount of wear damage may be expected.

Figure 8A:
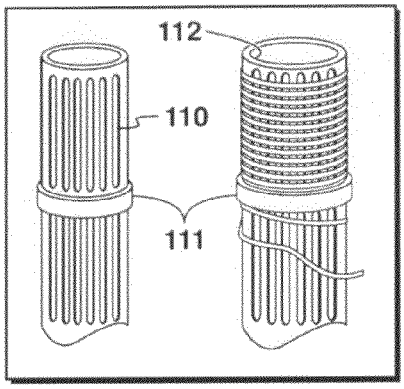
FIG. 8 depicts exemplary application of a coating applied to a basepipe and screen assembly used in gravel pack sand control operations and screens used in solids control equipment, illustrating coated sleeves that may be used to assist sliding of the screen into the wellbore.
Figure 8B:
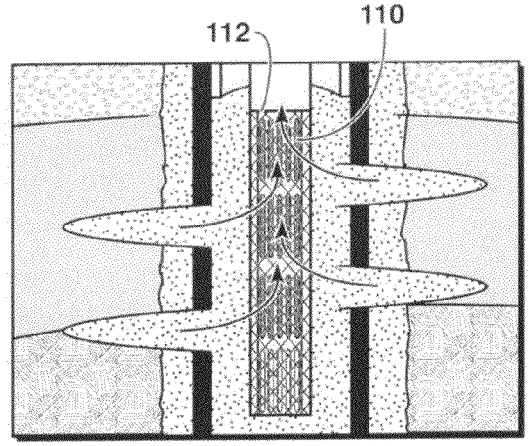
Figure 8C:
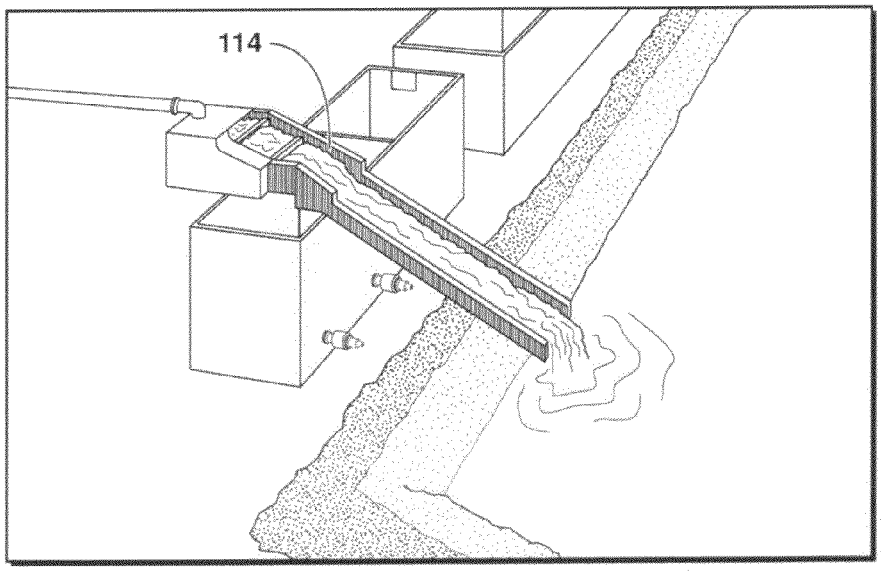

Thin metal meshes may be coated for friction reduction and resistance to corrosion and erosion. The coating process may be applied to individual cylindrical strands prior to weaving or to the collective mesh after the weave has been performed, or both, or in combination. A screen may be considered to be comprised of many cylinders. Wire strands may be drawn through a coating device to enable coating application of the entire surface area of the wire. The coating applications include but are not limited to: sand screens disposed within completion intervals, Mazeflo™ completion screens, sintered screens, wirewrap screens, shaker screens for solids control, and other screens used as oil and gas well production devices. The coating can be applied to at least a portion of filtering media, screen basepipe, or both. (See FIG. 8.) FIG. 8 depicts exemplary application of the coatings disclosed herein on screens and basepipe. In particular, the coatings disclosed herein may be applied to the slotted liner of screens 110 as well as basepipe 112 as shown in FIGS. 8A and 8B to prevent erosion, corrosion, and deposits thereon. The detailed closeup of FIG. 8A shows coated sleeve element 111 external to the screen to allow it to slide downhole with reduced friction resistance. The coatings disclosed herein may also be applied to screens in the shale shaker 114 of solids control equipment as shown in FIG. 8C. Coated sleeved devices may be used in a variety of ways with these devices as described above, to reduce friction at the wellbore contact during installation and to reduce erosion damage due to sand and proppant flow during stimulation and production at specific locations where the sleeve is applied.

Coated sleeve devices may reduce material hardness requirements and mitigate the effects of corrosion and erosion for certain devices and components, enabling lower cost materials to be used as substitute for stellite, tungsten carbide, MP35N, high alloy materials, and other costly materials selected for this purpose.

C. Plates, Disks, and Complex Geometries:

There are many coated sleeve device applications that may be considered for non-cylindrical devices such as plates and disks or for more complex geometries. One exemplary application of a disk geometry is a washer device that may be coated on one or both sides to reduce friction during operation of the device. The benefits of coatings may be derived from a reduction in sliding contact friction and wear resulting from relative motion with respect to other devices, or perhaps a reduction in erosion, corrosion, and deposits from the interaction with fluid streams, or in many cases by a combination of both. These applications may benefit from the use of coatings as described below.

Figure 9A:
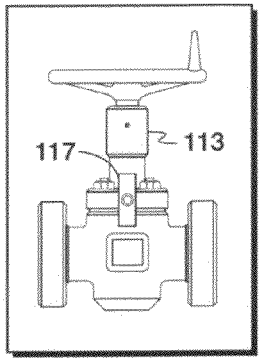
FIG. 9 depicts exemplary application of a coated sleeves applied to wellhead and valve assemblies, where the sleeve device may be used in valves to provide a seal at lower operating forces and loads.
Figure 9B:
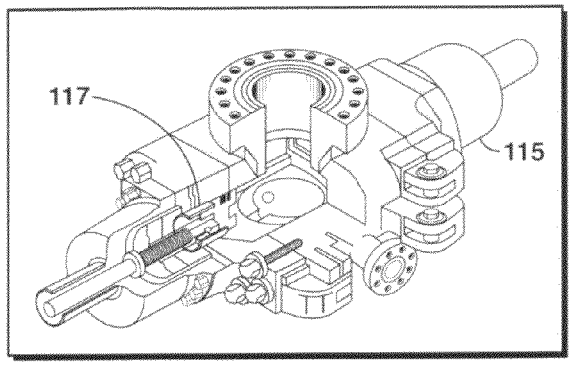
Figure 9C:
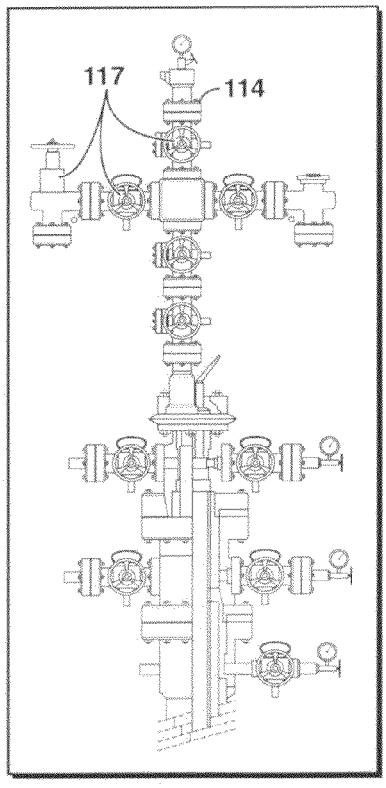
Figure 9D:
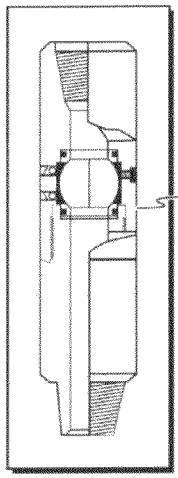
Figure 9E:
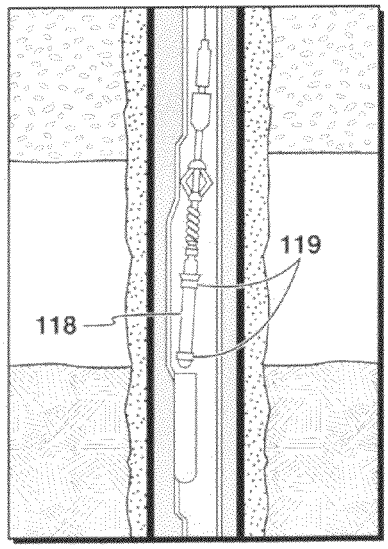
Figure 10A:
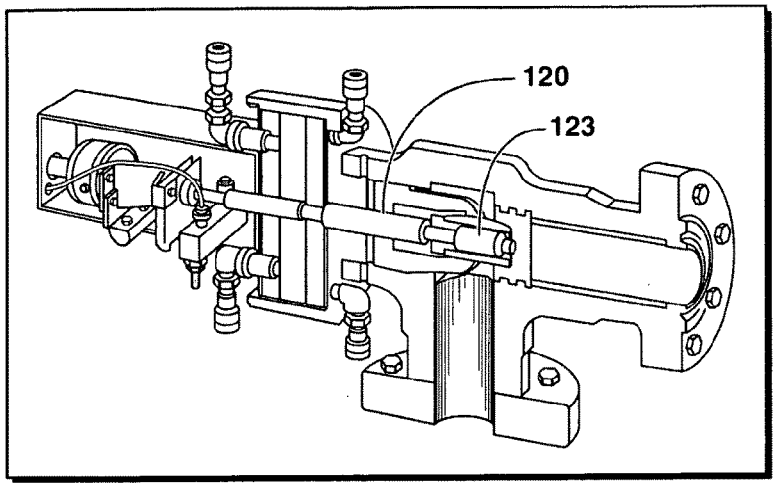
FIG. 10 depicts exemplary application of coated sleeves applied to an orifice meter, a choke, and a turbine meter.
Figure 10B:
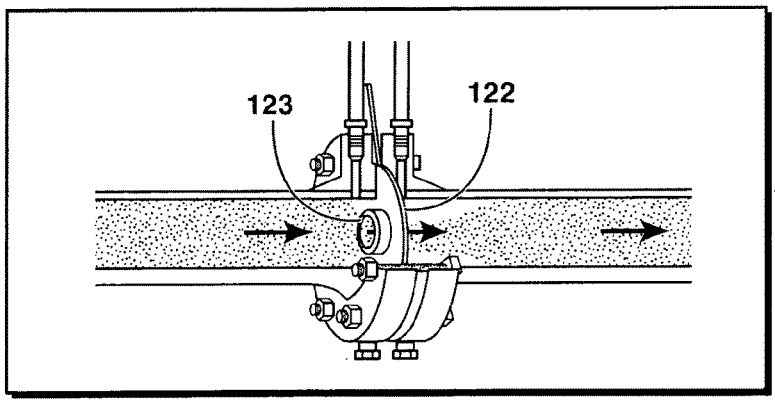
Figure 10C:
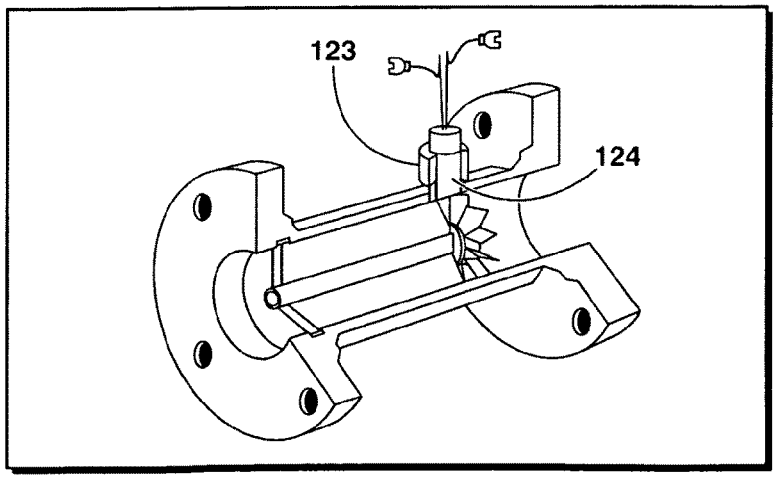

An Exemplary List of Such Applications is as Follows:

Chokes, valves, valve seats, seals, ball valves, inflow control devices, smart well valves, and annular isolation valves may beneficially use coated parts such as sleeves and washers to reduce friction, erosion, corrosion, and damage due to deposits. Many of these devices are used in wellhead equipment (see FIGS. 9 and 10). In particular, referring to FIGS. 9A, 9B, 9C, 9D and 9E, valves 113, blowout preventers 115, wellheads 114, lower Kelly cocks 116, and gas lift valves 118 may use coated sleeves and washers 117 with the coatings disclosed herein to provide resistance to friction, erosion, and corrosion in high velocity components, and the smooth surfaces of these coated devices provides enhanced sealability. In FIG. 9E, coated sleeves 119 may be used to ease entry of the gas lift device into the side pocket and to seal properly. In addition, referring to FIGS. 10A, 10B and 10C, chokes 120, orifice meters 122, and turbine meters 124 may have flow restrictions and other components (i.e. impellers and rotors) that use coated sleeves and washers 123 with the coatings disclosed herein to provide further resistance to friction, erosion, and corrosion. Other surface areas of the same production device may be protected by coated sleeves and washers for reduced friction and wear by using the same or different coating on a different portion of the production device.

Seats, nipples, valves, sidepockets, mandrels, packer slips, packer latches, etc. may beneficially use coated sleeve and washer devices with low-friction coatings.

Subsurface safety valves are used to control flow in the event of possible loss of containment at the surface. These valves are routinely used in offshore wells to increase operational integrity and are often required by regulation. Improvements in the reliability and effectiveness of subsurface safety valves provide substantial benefits to operational integrity and may avoid a costly workover operation in the event that a valve fails a test. Enhanced sealability, resistance to erosion, corrosion, and deposits, and reduced friction and wear in moving valve devices may be highly beneficial for these reasons. The use of coated sleeves and washers in subsurface safety valves will enhance their operability and obtain the benefits described above.

Gas lift and chemical injection valves are commonly used in tubing strings to enable injection of fluids, and coating portions of these devices will improve their performance. Gas lift is used to reduce the hydrostatic head and increase flow from a well, and chemicals are injected, for example, to inhibit formation of hydrates or scale in the well that would impede flow. The use of coated sleeves and washers in gas lift and chemical injection valves will enhance their operability and obtain the benefits described above.

Elbows, tees, and couplings may be internally coated for fluid flow friction reduction and the prevention of buildup of scale and deposits. Coated sleeve devices may be used in these applications at specific locations of high erosion, such as at bends, unions, tees, and other areas of fluid mixing and wall impingement of entrained solids.

The ball bearings, sleeve bearings, or journal bearings of rotating equipment may be coated to provide low friction and wear resistance, and to enable longer life of the bearing devices.

Wear bushings may utilize coated sleeve devices for reduced friction and wear, and for enhanced operability.

Coated sleeves in dynamic metal-to-metal seals may be used to enhance or replace elastomers in reciprocating and/or rotating seal assemblies.

Moyno™ and progressive cavity pumps comprise a vaned rotor turning within a fixed stator. Coated sleeve devices in these components will enable improved operation and increase the pump efficiency and durability.

Impellers and stators in rotating pump equipment may incorporate coated sleeve devices for erosion and wear resistance, and for durability where fine solids may be present in the flowstream. Such applications include submersible pumps.

Coated sleeve devices in a centrifuge device for drilling fluids solids control enhance the effectiveness of these devices by preventing plugging of the centrifuge discharge. The service life of the centrifuge may be extended by the erosion resistance provided by coated sleeve elements.

Springs in tools that are coated may have reduced contact friction and long service life reliability. Examples include safety valves, gas lift valves, shock subs, and jars.

Logging tool devices may use coated sleeve devices to improve operations involving deployment of arms, coring tubes, fluid sampling flasks, and other devices into the wellbore. Devices that are extended from and then retracted back into the tool may be less susceptible to jamming due to friction and solid deposits if coatings are applied.

Figure 11A:
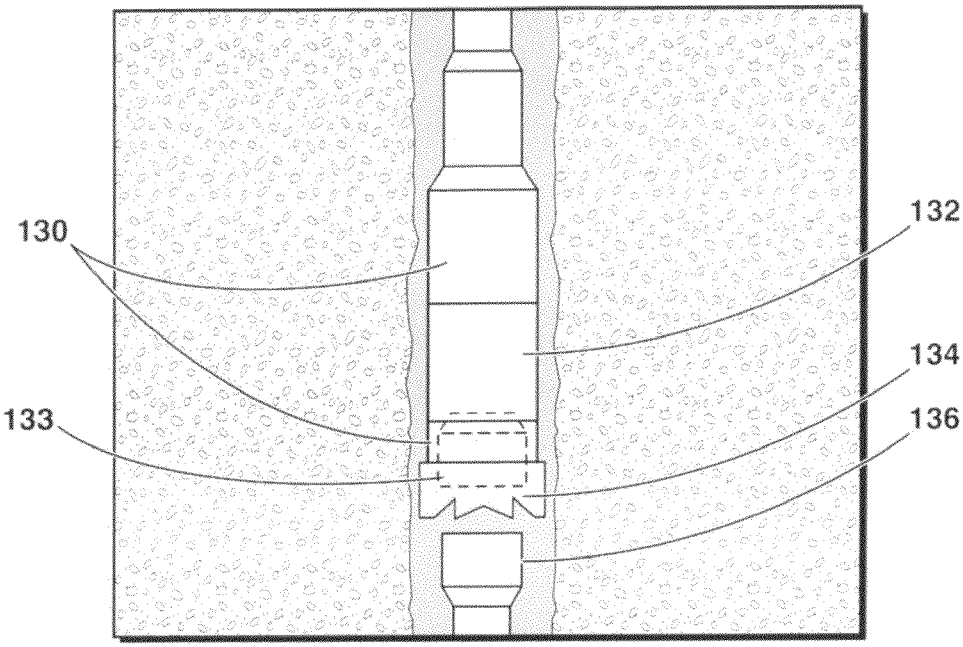
FIG. 11 depicts exemplary application of a coated sleeves applied to the grapple and overshot of a washover fishing tool.
Figure 11B:
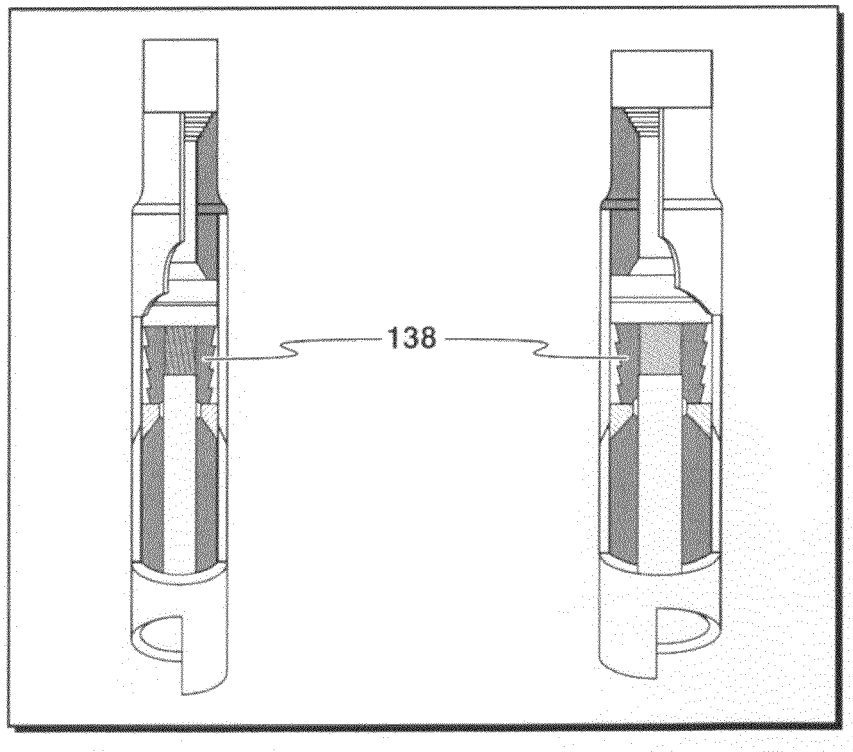

Fishing equipment, including but not limited to, washover pipe, grapple, and overshot, may beneficially use coated sleeves to facilitate latching onto and removing a disconnected piece of equipment, or "fish," from the wellbore. Low friction entry into the washover pipe may be facilitated by an internal coated sleeve, and a hard coating on the grapple sleeve may improve the bite of the tool. (See FIG. 11.) In particular, referring to FIG. 11A, the coatings disclosed herein may be applied to washover pipe 130, washover pipe connector sleeves 132, rotary shoes 134, and fishing devices to reduce friction of entry of fish 136 into the washover string. Tapered and coated sleeve 133 may be used to ease the fish into the washpipe. In addition, referring to FIG. 11B, the coatings disclosed herein may be applied to grapple sleeves 138 to maintain material hardness for good grip.

D. Threaded Connections:

High strength pipe materials and special alloys in oilfield applications may be susceptible to galling, and threaded connections may be beneficially coated so as to reduce friction and increase surface hardness during connection makeup and to enable reuse of pipe and connections without redressing the threads. Seal performance may be improved by enabling higher contact stresses without risk of galling.

Figure 12A:
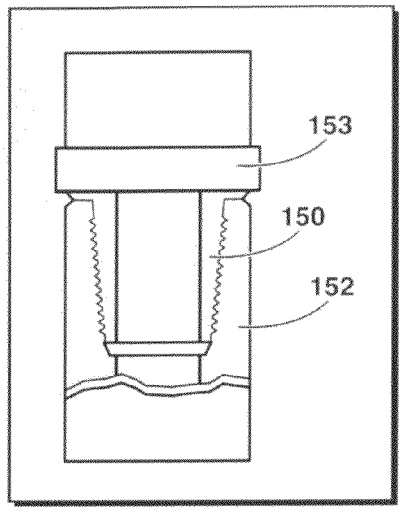
FIG. 12 depicts exemplary application of a coating applied to a threaded connection and illustrates thread galling.
Figure 12B:
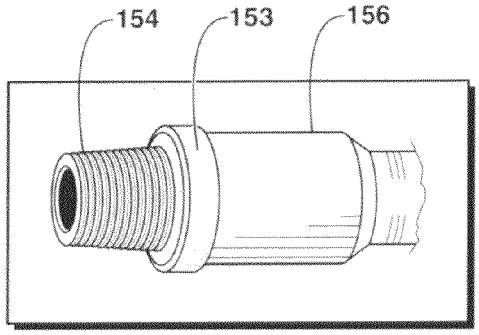
Figure 12C:
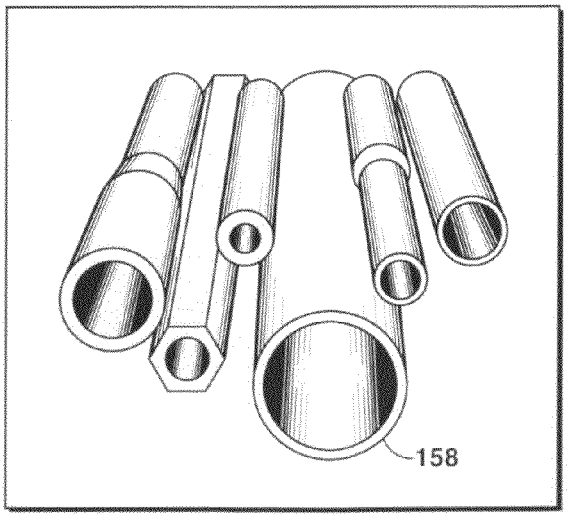
Figure 12D:
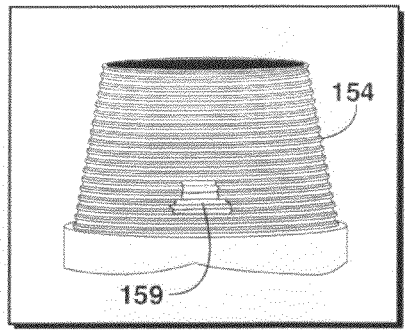

Pin and/or box threads of casing, tubing, drill pipe, drill collars, work strings, surface flowlines, stimulation treatment lines, threads used to connect downhole tools, marine risers, and other threaded connections involved in production operations may be beneficially coated with the low-friction coatings disclosed herein. Threads may be coated separately or in combination with current technology for improved connection makeup and galling resistance, including shot-peening and cold-rolling, and possibly but less likely, chemical treatments of the threads. (See FIG. 12.) Referring to FIG. 12A, the pin 150 and/or box 152 may be coated with the coatings disclosed herein. Referring to FIG. 12B, the threads 154 and/or shoulder 156 may be coated with the coatings disclosed herein. Coated sleeve elements 153 are illustrated at the connection pin. In FIG. 12C, the threaded connections (not shown) of threaded tubulars 158 may be coated with the coatings disclosed herein. In FIG. 12D, galling 159 of the threads 154 may be prevented by use of the coatings disclosed herein. Coatings in this instance could be applied to one or both sets of threads of a threaded connection.

E. Exemplary Sleeve Configuration for Drilling Application

Figure 13A:
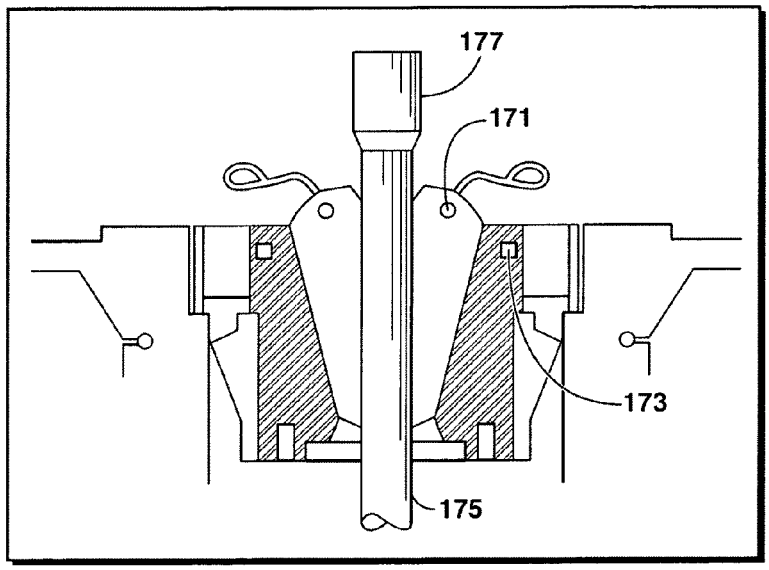
FIG. 13 illustrates the exemplary application of a coated sleeve element in a coated sleeved drill string connection, showing both pin-down and pin-up connection configurations and additional possible sleeve parameters.

When the drill string is extended or shortened during the drilling process, pieces of drill pipe are screwed together and unscrewed. Some modern drilling rigs use automated equipment for this operation, which is known as "making a connection." As shown in FIG. 13A, the slips 171 are set in the drill rig floor or rotary table 173 to hold the drill string 175, the pipe is unscrewed, and the connection is "broken." The detached pipe held by the rig elevators can be added to the string if running pipe in the hole, or removed if tripping pipe out of the hole. In FIG. 13A, the connection 177 held by the slips is the tool joint box connection.

Figure 13B:
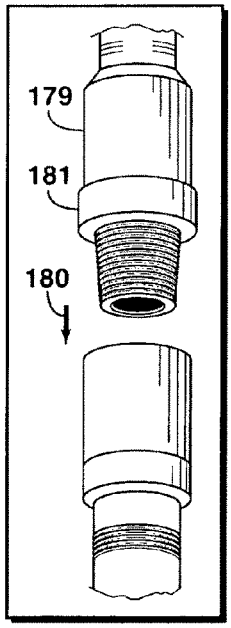

FIG. 13B shows a coated sleeve element 181 on the pin 179 of a connection that is oriented according to the standard "pin-down" convention. Note that the gravity vector 180 points downwards. It may be appreciated that this is inconvenient in the sense that when the connection is broken and the separated pipe is removed, the sleeve will fall to the ground or down the hole if not somehow attached. In U.S. Pat. No. 7,028,788, Strand resolved this problem by threading the sleeve and the pin connection so that the sleeve stays with the pin during connection makes and breaks.

It may be appreciated that there may be some problems with a threaded sleeve system in that, during the drilling process, the threads specified in U.S. Pat. No. 7,028,788 are exposed to the outside of the drill pipe and are in proximity to the formation and drilling fluids. The potential for these threads to be damaged or to have formation material packed in the threads would appear to be significant. Additionally, there will be extra costs associated with the manufacture and maintenance of the threads on both sleeve and pin. If the threads of the sleeve or pin connection are damaged, the corresponding piece of equipment must be repaired prior to subsequent use.

Figure 13C:
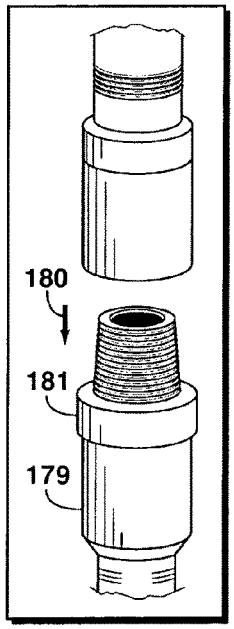

One exemplary alternative method is to use the "pin-up" configuration as shown in FIG. 13C. With the pin 179 facing up, the sleeve 181 may be placed over the pin directly when making the connection, and on breaking the connection the sleeve remains in place. Again, the gravity vector 180 points down in this figure. Optionally, if it is desired to prevent the sleeve from rotating freely relative to the drill pipe and if no alternative means of attaching the sleeve is used, then one means to prevent the sleeve from rotating is to use a key or slot, or perhaps provide an elliptically profiled inner sleeve surface area and corresponding cross-section area for the sleeve on the pin connection.

Figure 13D:
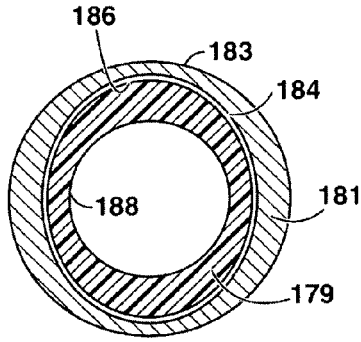
Figure 13E:
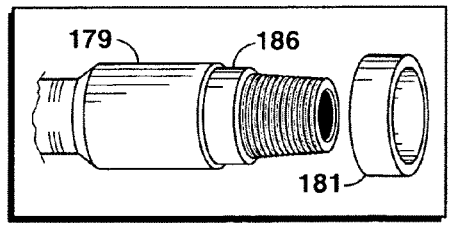

FIG. 13D illustrates an exaggerated view of the elliptical sleeve inner profile configuration. The outer sleeve surface 183 has a circular cross-section, as does the inner surface 188 of the pin connection. The pin threads are made on a tapered conical section as usual. However, in the lower-stress area of the pin above the threads, an elliptical cross-section 186 is machined to match the dimensions of the sleeve inner surface cross-section 184, with suitable tolerances to allow for slipping the sleeve over the threads onto the pin body. Careful analysis is required to ensure that there is sufficient material strength in the sleeve so that, with the expected torsional loads, it does not deform, and that the strength of the pin has not been compromised. Typically, material may be removed up to the bevel diameter without affecting pin strength. Recognizing that the pipe will be turned in one direction, an asymmetric profile may be considered, and other alternative cross-sectional profiles may be devised without departing from the spirit of the disclosure.

Alternative means of attaching sleeves to tool joints, using the pin connection, box connection, or other proximal areas of the drill pipe may be conceived, without departing from the basic concept of using coated sleeve elements to utilize advantageous low-friction materials while drilling.

Drilling Conditions, Application, and Benefits

A detailed examination of one important aspect of production operations, the drilling process, can help to identify several challenges and opportunities for the beneficial use of a specific application of coated sleeved devices in the well production process.

Deep wells for the exploration and production of oil and gas are drilled with a rotary drilling system which creates a borehole by means of a rock cutting tool, a drill bit. The torque driving the bit is often generated at the surface by a motor with mechanical transmission box. Via the transmission, the motor drives the rotary table or top drive unit. The medium to transport the energy from the surface to the drill bit is a drill string, mainly consisting of drill pipes. The lowest part of the drill string is the bottom hole assembly (abbreviated herein as BHA) consisting of bit, drill collars, stabilizers, measurement tools, under-reamers, motors, and other devices known to those skilled in the art. The combination of the drill string and the bottom hole assembly is referred to herein as a drill stem assembly. Alternatively, coiled tubing may replace the drill string, and the combination of coiled tubing and the bottom hole assembly is also referred to herein as a drill stem assembly. In still another configuration, cutting elements proximal to the bottom end of the casing comprise a "casing-while-drilling" system. The coated sleeved oil and gas well production devices disclosed herein provide particular benefit in such downhole drilling operations.

With today's advanced directional drilling technology, multiple lateral wellbores may be drilled from the same starter wellbore. This may mean drilling over far longer depths and the use of directional drilling technology, e.g., through the use of rotary steerable systems (abbreviated herein as RSS). Although this gives major cost and logistical advantages, it also greatly increases wear on the drill string and casing. In some cases of directional or extended reach drilling, the degree of vertical deflection, inclination (angle from the vertical), can be as great as 90°, which are commonly referred to as horizontal wells. In drilling operations, the drill string assembly has a tendency to rest against the side wall of the borehole or the well casing. This tendency is much greater in directional wells due to the effect of gravity. As the drill string increases in length and/or degree of deflection, the overall frictional drag created by rotating the drill string also increases. To overcome this increase in frictional drag, additional power is required to rotate the drill string. The resultant friction and wear impact the drilling efficiency. The measured depth that can be achieved in these situations may be limited by the available torque capacity of the drilling rig and the torsional strength of the drill string. There is a need to find more efficient solutions to extend equipment lifetime and drilling capabilities with existing rigs and drive mechanisms to extend the lateral reach of these operations.

The deep drilling environment, especially in hard rock formations, induces severe vibrations in the drill stem assembly, which can cause reduced drill bit rate of penetration and premature failure of the equipment downhole. The drill stem assembly vibrates axially, torsionally, laterally or usually with a combination of these three basic modes, that is, coupled vibrations. The use of coated sleeve devices disclosed herein may reduce the required torque for drilling and also provide resistance to torsional vibration instability, including stick-slip vibration dysfunction of the drill string and bottom hole assembly. Reduced drill string torque may allow the drilling operator to drill wells at higher rate of penetration (ROP) than when using conventional drilling equipment. Coated sleeved devices in the drill string as disclosed herein may prevent or delay the onset of drill string buckling, including helical buckling, and may prevent vibration-related drill stem assembly failures and the associated non-productive time during drilling operations.

The drill string includes one or more devices chosen from drill pipe, tool joints, transition pipe between the drill string and bottom hole assembly including tool joints, heavy weight drill pipe including tool joints and wear pads, and combinations thereof. The bottom hole assembly includes one or more devices chosen from, but not limited to: stabilizers, variable-gauge stabilizers, back reamers, drill collars, flex drill collars, rotary steerable tools, roller reamers, shock subs, mud motors, logging while drilling (LWD) tools, measuring while drilling (MWD) tools, coring tools, under-reamers, hole openers, centralizers, turbines, bent housings, bent motors, drilling jars, acceleration jars, crossover subs, bumper jars, torque reduction tools, float subs, fishing tools, fishing jars, washover pipe, logging tools, survey tool subs, non-magnetic counterparts of any of these devices, and combinations thereof and their associated external connections.

The coated sleeved oil and gas well production devices disclosed herein may be used in drill stem assemblies with downhole temperature ranging from 20 to 400° F. with a lower limit of 20, 40, 60, 80, or 100° F., and an upper limit of 150, 200, 250, 300, 350 or 400° F. During rotary drilling operations, the drilling rotary speeds at the surface may range from 0 to 200 RPM with a lower limit of 0, 10, 20, 30, 40, or 50 RPM and an upper limit of 100, 120, 140, 160, 180, or 200 RPM. In addition, during rotary drilling operations, the drilling mud pressure may range from 14 psi to 20,000 psi with a lower limit of 14, 100, 200, 300, 400, 500, or 1000 psi, and an upper limit of 5000, 10000, 15000, or 20000 psi.

In one form, the coated sleeved oil and gas well production devices disclosed herein with the coating on at least a portion of the exposed outer surface provides at least 2 times, or 3 times, or 4 times, or 5 times greater wear resistance than an uncoated device. Additionally, the coated sleeved oil and gas well production device disclosed herein when used on a drill stem assembly with the coating on at least a portion of the surface provides reduction in casing wear as compared to when an uncoated drill stem assembly is used for rotary drilling. Moreover, the coated sleeved oil and gas well production devices disclosed herein when used on a drill stem assembly with the coating on at least a portion of the surface reduces casing wear by at least 2 times, or 3 times, or 4 times, or 5 times versus the use of an uncoated drill stem assembly for rotary drilling operations.

The coatings on drill stem assemblies disclosed herein may also eliminate or reduce velocity weakening of the friction coefficient. More particularly, rotary drilling systems used to drill deep boreholes for hydrocarbon exploration and production often experience severe torsional vibrations leading to instabilities referred to as "stick-slip" vibrations, characterized by (i) sticking phases where the bit or BHA slows down until it stops (relative sliding velocity is zero), and (ii) slipping phases where the relative sliding velocity of the downhole assembly rapidly accelerates to a value much larger than the rotary speed (RPM) imposed by the drilling rig at the surface. This problem is particularly acute with drag bits, which consist of fixed blades or cutters mounted on the surface of a bit body. Non-linearities in the constitutive laws of friction lead to the instability of steady frictional sliding against stick-slip oscillations. Therefore, this leads to a complex problem.

Velocity weakening behavior, which is indicated by a decreasing coefficient of friction with increasing relative sliding velocity, may cause torsional instability triggering stick-slip vibrations. Sliding instability is an issue in drilling since it is one of the primary founders which limits the maximum rate of penetration. In drilling applications, it is advantageous to avoid the stick-slip condition because it leads to vibrations and wear, including the initiation of damaging coupled vibrations. By reducing or eliminating the velocity weakening behavior, the coatings on drill string assemblies disclosed herein bring the system into the continuous sliding state, where the relative sliding velocity is constant and does not oscillate (avoidance of stick-slip) or display violent accelerations or decelerations in localized RPM. Even with the prior art method of avoiding stick-slip motion with the use of a lubricant additive or pills to drilling muds, at high normal loads and small sliding velocities stick-slip motion may still occur. The coatings on drill stem assemblies disclosed herein may provide for no stick-slip motion even at high normal loads.

In intervals that contain mostly shale formations, another drilling problem is common. "Bit balling" may occur when shale cuttings stick to the bit cutting face by differential fluid pressure, reducing drilling efficiencies and ROP significantly. Sticking of shale cuttings to BHA devices such as stabilizers leads to drilling inefficiencies. These problems are exacerbated by the use of water-based drilling fluids, which may be preferred for both cost and environmental reasons.

Figure 14:
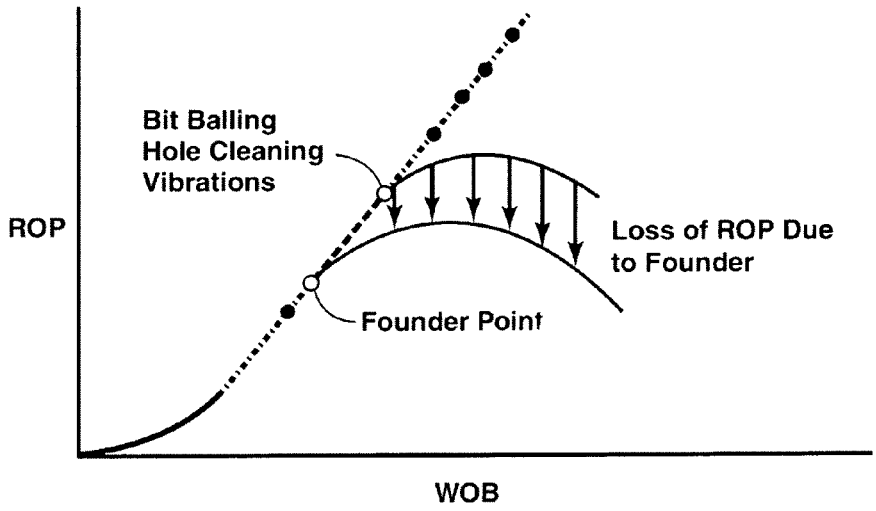
FIG. 14 depicts, schematically, the rate of penetration (ROP) versus weight on bit (WOB) during subterraneous rotary drilling.

Drilling vibrations and bit balling are two of the most common causes of drilling inefficiencies. These inefficiencies can manifest themselves as ROP limiters or "founder points" in the sense that the ROP does not increase linearly with weight on bit (abbreviated herein as WOB) and revolutions per minute (abbreviated herein as RPM) of the bit as predicted from bit mechanics. This limitation is depicted schematically in FIG. 14. It has been recognized in the drilling industry that drill stem vibrations and bit balling are two of the most challenging rate of penetration limiters. The coated sleeved devices disclosed herein may be applied to the drill stem assembly to help mitigate these ROP limitations.

Additionally, coated sleeved devices will improve the performance of drilling tools, particularly a bottom hole assembly, for drilling in formations containing clay and similar substances. These coating materials provide thermodynamically low energy surfaces, e.g., non-water wetting surface for bottom hole devices. The coatings disclosed herein are suitable for oil and gas drilling in gumbo-prone areas, such as in deep shale drilling with high clay content, using water-based muds (abbreviated herein as WBM) to prevent bottom hole assembly balling.

Furthermore, the coated sleeved devices disclosed herein when applied to the drill string assembly can simultaneously reduce contact friction, balling and reduce wear while not compromising the durability and mechanical integrity of casing. Thus, the coated sleeved devices disclosed herein are "casing friendly" in that they do not degrade the life or functionality of the casing. The coatings disclosed herein are characterized by low or no sensitivity to velocity weakening friction behavior. Thus, the drill stem assemblies provided with the coated sleeved devices disclosed herein provide low friction surfaces with advantages in both mitigating stick-slip vibrations and reducing parasitic torque to further enable ultra-extended reach drilling.

The coated sleeved devices disclosed herein for drill stem assemblies provide for the following exemplary non-limiting advantages: i) mitigating stick-slip vibrations, ii) reducing torque and drag for extending the reach of extended reach wells and iii) mitigating drill bit and other bottom hole assembly balling. These advantages, together with minimizing parasitic torque, may lead to significant improvements in drilling rate of penetration as well as durability of downhole drilling equipment, thereby also contributing to reduced non-productive time (abbreviated herein as NPT). The coatings disclosed herein not only reduce friction, but also withstand the aggressive downhole drilling environments requiring chemical stability, corrosion resistance, impact resistance, durability against wear, erosion and mechanical integrity (coating-substrate interface strength). The coatings disclosed herein are also amenable for application to complex geometries without damaging the substrate properties. Moreover, the coatings disclosed herein also provide low energy surfaces necessary to provide resistance to balling of bottom hole devices.

Exemplary Coated Sleeved Device Embodiments:

The discussion of the drilling process has focused on the friction and wear benefits of the coated sleeved devices, with primary application to cylinders in sliding contact, and it has also identified the benefits of low energy surfaces for reduced sticking of formation cuttings to bottom hole devices. These same technical discussions pertain to other instances of cylinders in sliding contact due to relative motion which may be adapted to use coated sleeved devices, with modified circumstances accordingly.

Friction and wear reduction are primary motivations for the application of coatings to bodies in sliding contact due to relative motion. For stationary devices, the incentives and benefits of coatings may be slightly different. Although friction and wear may be important secondary factors (for instance in the initial installation of the device), the primary benefit of coated sleeved devices may be their resistance to erosion, corrosion, and deposits, more akin to the problem of reducing the adhesion of shale formations to the BHA, and these factors then become major dimensions in their selection and use.

In one exemplary embodiment, a coated sleeved oil and gas well production device comprises an oil and gas well production device including one or more cylindrical bodies, one or more sleeves proximal to the outer diameter or the inner diameter of the one or more cylindrical bodies, and a coating on at least a portion of the inner sleeve surface, the outer sleeve surface, or a combination thereof of the one or more sleeves, wherein the coating is chosen from an amorphous alloy, a heat-treated electroless or electro plated nickel-phosphorous based composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof.

In another exemplary embodiment, the coated oil and gas well production device comprises an oil and gas well production device including one or more bodies with the proviso that the one or more bodies does not include a drill bit, one or more sleeves proximal to the outer surface or the inner surface of the one or more bodies, and a coating on at least a portion of the inner sleeve surface, the outer sleeve surface, or a combination thereof of the one or more sleeves, wherein the coating is chosen from an amorphous alloy, a heat-treated electroless or electro plated nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof.

The coefficient of friction of the coating may be less than or equal to 0.15, or 0.13, or 0.11, or 0.09 or 0.07 or 0.05. The friction force may be calculated as follows: Friction Force=Normal Force×Coefficient of Friction. In another form, the coated oil and gas well production device may have a dynamic friction coefficient of the coating that is not lower than 50%, or 60%, or 70%, or 80% or 90% of the static friction coefficient of the coating. In yet another form, the coated sleeved oil and gas well production device may have a dynamic friction coefficient of the coating that is greater than or equal to the static friction coefficient of the coating.

The coated sleeved oil and gas well production device may be fabricated from iron based steels, Al-base alloys, Ni-base alloys and Ti-base alloys. 4142 type steel is one non-limiting exemplary iron based steel used for sleeved oil and gas well production devices. The surface of the iron based steel substrate may be optionally subjected to an advanced surface treatment prior to coating application. The advanced surface treatment may provide one or more of the following benefits: extended durability, enhanced wear, reduced friction coefficient, enhanced fatigue and extended corrosion performance of the coating layer(s). Non-limited exemplary advanced surface treatments include ion implantation, nitriding, carburizing, shot peening, laser and electron beam glazing, laser shock peening, and combinations thereof. Such surface treatments may harden the substrate surface by introducing additional species and/or introduce deep compressive residual stress resulting in inhibition of the crack growth induced by fatigue, impact and wear damage.

The coating disclosed herein for coated sleeved devices may be chosen from an amorphous alloy, electroless and/or electro plating nickel-phosphorous based composite, graphite, $MoS_2$, $WS_2$, a fullerene based composite, a boride based cermet, a quasicrystalline material, a diamond based material, diamond-like-carbon (DLC), boron nitride, and combinations thereof. The diamond based material may be chemical vapor deposited (CVD) diamond or polycrystalline diamond compact (PDC). In one advantageous embodiment, the coated oil and gas well production device is coated with a diamond-like-carbon (DLC) coating, and more particularly the DLC coating may be chosen from tetrahedral amorphous carbon (ta-C), tetrahedral amorphous hydrogenated carbon (ta-C:H), diamond-like hydrogenated carbon (DLCH), polymer-like hydrogenated carbon (PLCH), graphite-like hydrogenated carbon (GLCH), silicon containing diamond-like-carbon (Si-DLC), metal containing diamond-like-carbon (Me-DLC), oxygen containing diamond-like-carbon (O-DLC), nitrogen containing diamond-like-carbon (N-DLC), boron containing diamond-like-carbon (B-DLC), fluorinated diamond-like-carbon (F-DLC) and combinations thereof.

Significantly decreasing the coefficient of friction (COF) of the coated sleeved oil and gas well production device will result in a significant decrease in the friction force. This translates to a smaller force required to slide the cuttings along the surface when the device is a coated drill stem assembly. If the friction force is low enough, it may be possible to increase the mobility of cuttings along the surface until they can be lifted off the surface of the drill stem assembly or transported to the annulus. It is also possible that the increased mobility of the cuttings along the surface may inhibit the formation of differentially stuck cuttings due to the differential pressure between mud and mud-squeezed cuttings-cutter interface region holding the cutting onto the cutter face. Lowering the COF on oil and gas well production device surfaces is accomplished by coating these surfaces with coatings disclosed herein. These coatings applied to the oil and gas well production device are able to withstand the aggressive environments of drilling including resistance to erosion, corrosion, impact loading, and exposure to high temperatures.

Figure 15:
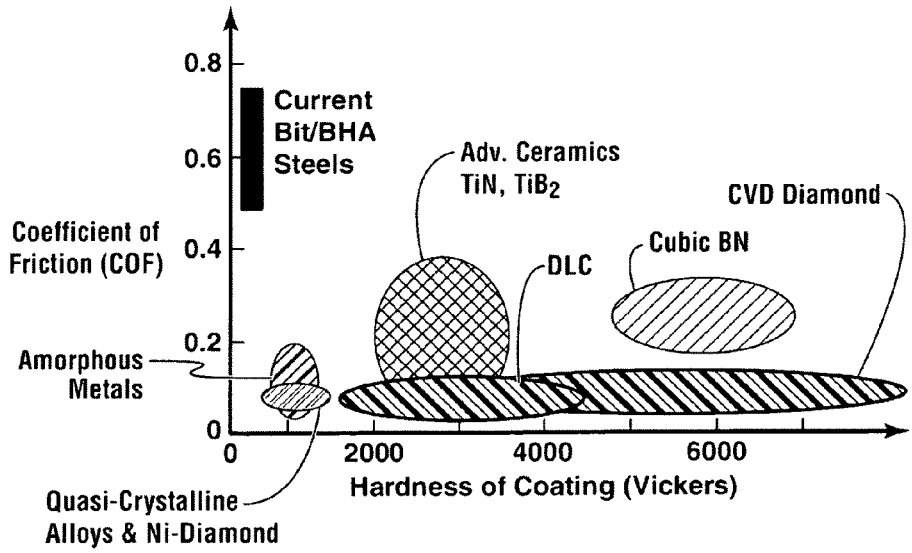
FIG. 15 depicts the relationship between coating COF and coating hardness for some of the coatings disclosed herein versus steel base case.

In addition to low COF, the coatings of the present disclosure are also of sufficiently high hardness to provide durability against wear during oil and gas well production operations. More particularly, the Vickers hardness or the equivalent Vickers hardness of the coatings on the oil and gas well production device disclosed herein may be greater than or equal to 400, 500, 600, 700, 800, 900, 1000, 1500, 2000, 2500, 3000, 3500, 4000, 4500, 5000, 5500, or 6000. A Vickers hardness of greater than 400 allows for the coated oil and gas well production device when used as a drill stem assembly to be used for drilling in shales with water based muds and the use of spiral stabilizers. Spiral stabilizers have less tendency to cause BHA vibrations than straight-bladed stabilizers. FIG. 15 depicts the relationship between coating COF and coating hardness for some of the coatings disclosed herein relative to the prior art drill string and BHA steels. The combination of low COF and high hardness for the coatings disclosed herein when used as a surface coating on the drill stem assemblies provides for hard, low COF durable materials for downhole drilling applications.

The coated sleeved oil and gas well production devices with the coatings disclosed herein also provide a surface energy less than 1, 0.9, 0.8, 0.7, 0.6, 0.5, 0.4, 0.3, 0.2, or 0.1 $J/m^2$. In subterraneous rotary drilling operations, this helps to mitigate sticking or balling by rock cuttings. Contact angle may also be used to quantify the surface energy of the coatings on the coated sleeved oil and gas well production devices disclosed herein. The water contact angle of the coatings disclosed herein is greater than 50, 60, 70, 80, or 90 degrees.

Figure 16:
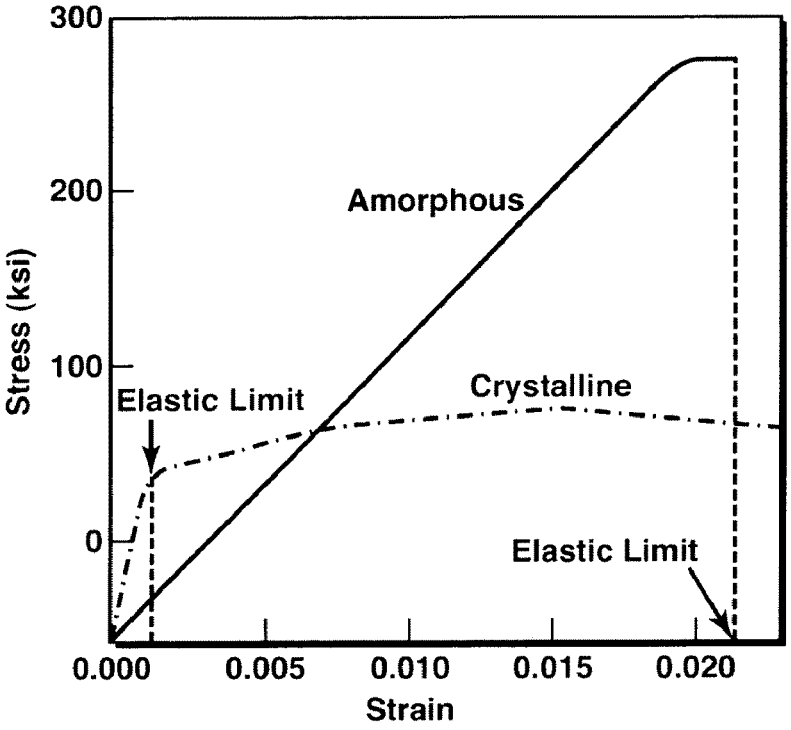
FIG. 16 depicts a representative stress-strain curve showing the high elastic limit of amorphous alloys compared to that of crystalline metals/alloys.

Further details regarding the coatings disclosed herein for use in coated sleeved oil and gas well production devices are as follows:

Amorphous Alloys:

Amorphous alloys as coatings for coated sleeved oil and gas well production devices disclosed herein provide high elastic limit/flow strength with relatively high hardness. These attributes allow these materials, when subjected to stress or strain, to stay elastic for higher strains/stresses as compared to the crystalline materials such as the steels used in drill stem assemblies. The stress-strain relationship between the amorphous alloys as coatings for drill stem assemblies and conventional crystalline alloys/steels is depicted in FIG. 16, and shows that conventional crystalline alloys/steels can easily transition into plastic deformation at relatively low strains/stresses in comparison to amorphous alloys. Premature plastic deformation at the contacting surfaces leads to surface asperity generation and the consequent high asperity contact forces and COF in crystalline metals. The high elastic limit of amorphous metallic alloys or amorphous materials in general can reduce the formation of asperities resulting also in significant enhancement of wear resistance. Amorphous alloys as coatings for sleeved oil and gas well production devices would result in reduced asperity formation during production operations and thereby reduced COF of the device.

Amorphous alloys as coatings for sleeved oil and gas well production devices may be deposited using a number of coating techniques including, but not limited to, thermal spraying, cold spraying, weld overlay, laser beam surface glazing, ion implantation and vapor deposition. Using a scanned laser or electron beam, a surface can be glazed and cooled rapidly to form an amorphous surface layer. In glazing, it may be advantageous to modify the surface composition to ensure good glass forming ability and to increase hardness and wear resistance. This may be done by alloying into the molten pool on the surface as the heat source is scanned. Hardfacing coatings may be applied also by thermal spraying including plasma spraying in air or in vacuum. Thinner, fully amorphous coatings as coatings for oil and gas well production devices may be obtained by thin film deposition techniques including, but not limited to, sputtering, chemical vapor deposition (CVD) and electrodeposition. Some amorphous alloy compositions disclosed herein, such as near equiatomic stoichiometry (e.g., Ni—Ti), may be amorphized by heavy plastic deformation such as shot peening or shock loading. The amorphous alloys as coatings for oil and gas well production devices disclosed herein yield an outstanding balance of wear and friction performance and require adequate glass forming ability for the production methodology to be utilized.

Ni—P Based Composite Coatings:

Electroless and electro plating of nickel-phosphorous (Ni—P) based composites as coatings for sleeved oil and gas well production devices disclosed herein may be formed by codeposition of inert particles onto a metal matrix from an electrolytic or electroless bath. The Ni—P composite coating provides excellent adhesion to most metal and alloy substrates. The final properties of these coatings depend on the phosphorous content of the Ni—P matrix, which determines the structure of the coatings, and on the characteristics of the embedded particles such as type, shape and size. Ni—P coatings with low phosphorus content are crystalline Ni with supersaturated P. With increasing P content, the crystalline lattice of nickel becomes more and more strained and the crystallite size decreases. At a phosphorous content greater than 12 wt %, or 13 wt %, or 14 wt % or 15 wt %, the coatings exhibit a predominately amorphous structure. Annealing of amorphous Ni—P coatings may result in the transformation of amorphous structure into an advantageous crystalline state. This crystallization may increase hardness, but deteriorate corrosion resistance. The richer the alloy in phosphorus, the slower the process of crystallization. This expands the amorphous range of the coating. The Ni—P composite coatings can incorporate other metallic elements including, but not limited to, tungsten (W) and molybdenum (Mo) to further enhance the properties of the coatings. The nickel-phosphorous (Ni—P) based composite coating disclosed herein may include micron-sized and sub-micron sized particles. Non-limiting exemplary particles include: diamonds, nanotubes, carbides, nitrides, borides, oxides and combinations thereof.

Other non-limiting exemplary particles include plastics (e.g., fluoro-polymers) and hard metals.

Layered Materials and Novel Fullerene Based Composite Coating Layers:

Layered materials such as graphite, $MoS_2$ and $WS_2$ (platelets of the 2H polytype) may be used as coatings for sleeved oil and gas well production devices. In addition, fullerene based composite coating layers which include fullerene-like nanoparticles may also be used as coatings for oil and gas well production devices. Fullerene-like nanoparticles have advantageous tribological properties in comparison to typical metals while alleviating the shortcomings of conventional layered materials (e.g., graphite, $MoS_2$). Nearly spherical fullerenes may also behave as nanoscale ball bearings. The main favorable benefit of the hollow fullerene-like nanoparticles may be attributed to the following three effects, (a) rolling friction, (b) the fullerene nanoparticles function as spacers, which eliminate metal to metal contact between the asperities of the two mating metal surfaces, and (c) three body material transfer. Sliding/rolling of the fullerene-like nanoparticles in the interface between rubbing surfaces may be the main friction mechanism at low loads, when the shape of nanoparticle is preserved. The beneficial effect of fullerene-like nanoparticles increases with the load. Exfoliation of external sheets of fullerene-like nanoparticles was found to occur at high contact loads (~1 GPa). The transfer of delaminated fullerene-like nanoparticles appears to be the dominant friction mechanism at severe contact conditions. The mechanical and tribological properties of fullerene-like nanoparticles can be exploited by the incorporation of these particles in binder phases of coating layers. In addition, composite coatings incorporating fullerene-like nanoparticles in a metal binder phase (e.g., Ni—P electroless plating) can provide a film with self-lubricating and excellent anti-sticking characteristics suitable for coatings for sleeved oil and gas well production devices.

Advanced Boride Based Cermets and Metal Matrix Composites:

Advanced boride based cermets and metal matrix composites as coatings for sleeved oil and gas well production devices may be formed on bulk materials due to high temperature exposure either by heat treatment or incipient heating during wear service. For instance, boride based cermets (e.g., $TiB_2$-metal), the surface layer is typically enriched with boron oxide (e.g, $B_2O_3$) which enhances lubrication performance leading to low friction coefficient.

Quasicrystalline Materials:

Quasicrystalline materials may be used as coatings for sleeved oil and gas well production devices. Quasicrystalline materials have periodic atomic structure, but do not conform to the 3-D symmetry typical of ordinary crystalline materials. Due to their crystallographic structure, most commonly icosahedral or decagonal, quasicrystalline materials with tailored chemistry exhibit unique combination of properties including low energy surfaces, attractive as a coating material for oil and gas well production devices. Quasicrystalline materials provide non-stick surface properties due to their low surface energy (~30 $mJ/m^2$) on stainless steel substrate in icosahedral Al—Cu—Fe chemistries. Quasicrystalline materials as coating layers for oil and gas well production devices may provide a combination of low friction coefficient (~0.05 in scratch test with diamond indentor in dry air) with relatively high microhardness (400~600 HV) for wear resistance. Quasicrystalline materials as coating layers for oil and gas well production devices may also provide a low corrosion surface and the coated layer has smooth and flat surface with low surface energy for improved performance. Quasicrystalline materials may be deposited on a metal substrate by a wide range of coating technologies, including, but not limited to, thermal spraying, vapor deposition, laser cladding, weld overlaying, and electrodeposition.

Super-Hard Materials (Diamond, Diamond Like Carbon, Cubic Boron Nitride):

Super-hard materials such as diamond, diamond-like-carbon (DLC) and cubic boron nitride (CBN) may be used as coatings for sleeved oil and gas well production devices. Diamond is the hardest material known to man and under certain conditions may yield ultra-low coefficient of friction when deposited by chemical vapor deposition (abbreviated herein as CVD) on the sleeve element. In one form, the CVD deposited carbon may be deposited directly on the surface of the sleeve. In another form, an undercoating of a compatibilizer material (also referred to herein as a buffer layer) may be applied to the sleeve element prior to diamond deposition. For example, when used on sleeves for drill stem assemblies, a surface coating of CVD diamond may provide not only reduced tendency for sticking of cuttings at the surface, but also function as an enabler for using spiral stabilizers in operations with gumbo prone drilling (such as for example in the Gulf of Mexico). Coating the flow surface of the spiral stabilizers with CVD diamond may enable the cuttings to flow past the stabilizer up hole into the drill string annulus without sticking to the stabilizer.

In one advantageous embodiment, diamond-like-carbon (DLC) may be used as coatings for sleeved oil and gas well production devices. DLC refers to amorphous carbon material that display some of the unique properties similar to that of natural diamond. The diamond-like-carbon (DLC) suitable for sleeved oil and gas well production devices may be chosen from ta-C, ta-C:H, DLCH, PLCH, GLCH, Si-DLC, Me-DLC, F-DLC and combinations thereof. DLC coatings include significant amounts of $sp^3$ hybridized carbon atoms. These $sp^3$ bonds may occur not only with crystals—in other words, in solids with long-range order—but also in amorphous solids where the atoms are in a random arrangement. In this case there will be bonding only between a few individual atoms, that is short-range order, and not in a long-range order extending over a large number of atoms. The bond types have a considerable influence on the material properties of amorphous carbon films. If the $sp^2$ type is predominant the DLC film may be softer, whereas if the $sp^3$ type is predominant, the DLC film may be harder.

Figure 17:
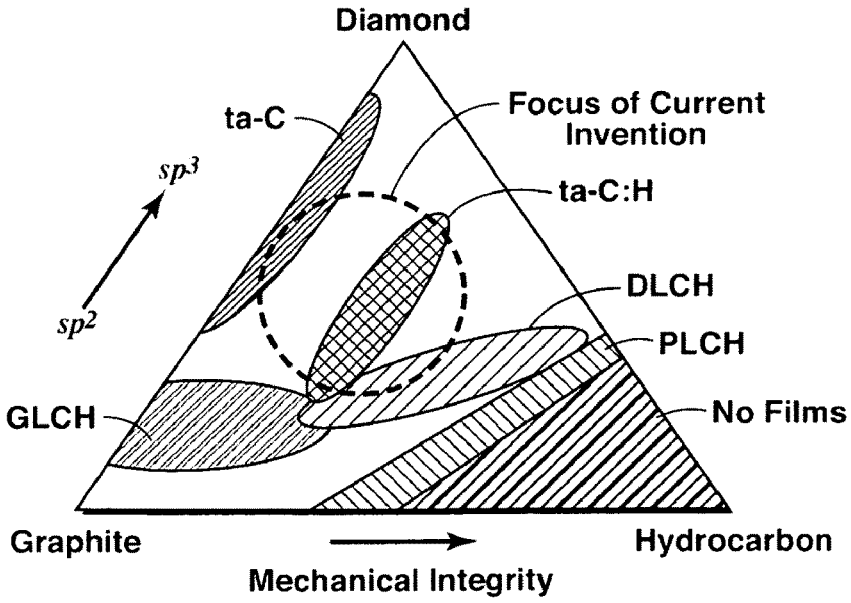
FIG. 17 depicts a ternary phase diagram of amorphous carbons.

DLC coatings may be fabricated as amorphous, flexible, and yet purely $sp^3$ bonded "diamond". The hardest is such a mixture, known as tetrahedral amorphous carbon, or ta-C (see FIG. 17). Such ta-C includes a high volume fraction (~80%) of $sp^3$ bonded carbon atoms. Optional fillers for the DLC coatings, include, but are not limited to, hydrogen, graphitic $sp^2$ carbon, and metals, and may be used in other forms to achieve a desired combination of properties depending on the particular application. The various forms of DLC coatings may be applied to a variety of substrates that are compatible with a vacuum environment and that are also electrically conductive. DLC coating quality is also dependent on the fractional content of alloying elements such as hydrogen. Some DLC coating methods require hydrogen or methane as a precursor gas, and hence a considerable percentage of hydrogen may remain in the finished DLC material. In order to further improve their tribological and mechanical properties, DLC films are often modified by incorporating other alloying elements. For instance, the addition of fluorine (F), and silicon (Si) to the DLC films lowers the surface energy and wettability. The reduction of surface energy in fluorinated DLC (F-DLC) is attributed to the presence of —CF2 and —CF3 groups in the film. However, higher F contents may lead to a lower hardness. The addition of Si may reduce surface energy by decreasing the dispersive component of surface energy. Si addition may also increase the hardness of the DLC films by promoting $sp^3$ hybridization in DLC films. Addition of metallic elements (e.g., W, Ta, Cr, Ti, Mo) to the film, as well as the use of such metallic interlayer can reduce the compressive residual stresses resulting in better mechanical integrity of the film upon compressive loading.

The diamond-like phase or $sp^3$ bonded carbon of DLC is a thermodynamically metastable phase while graphite with $sp^2$ bonding is a thermodynamically stable phase. Thus the formation of DLC coating films requires non-equilibrium processing to obtain metastable $sp^3$ bonded carbon. Equilibrium processing methods such as evaporation of graphitic carbon, where the average energy of the evaporated species is low (close to kT where k is Boltzmann's constant and T is temperature in absolute temperature scale), lead to the formation of 100% $sp^2$ bonded carbons. The methods disclosed herein for producing DLC coatings require that the carbon in the $sp^3$ bond length be significantly less than the length of the $sp^2$ bond. Hence, the application of pressure, impact, catalysis, or some combination of these at the atomic scale may force $sp^2$ bonded carbon atoms closer together into $sp^3$ bonding. This may be done vigorously enough such that the atoms cannot simply spring back apart into separations characteristic of $sp^2$ bonds. Typical techniques either combine such a compression with a push of the new cluster of $sp^3$ bonded carbon deeper into the coating so that there is no room for expansion back to separations needed for $sp^2$ bonding; or the new cluster is buried by the arrival of new carbon destined for the next cycle of impacts.

The DLC coatings disclosed herein may be deposited by physical vapor deposition, chemical vapor deposition, or plasma assisted chemical vapor deposition coating techniques. The physical vapor deposition coating methods include RF-DC plasma reactive magnetron sputtering, ion beam assisted deposition, cathodic arc deposition and pulsed laser deposition (PLD). The chemical vapor deposition coating methods include ion beam assisted CVD deposition, plasma enhanced deposition using a glow discharge from hydrocarbon gas, using a radio frequency (r.f.) glow discharge from a hydrocarbon gas, plasma immersed ion processing and microwave discharge. Plasma enhanced chemical vapor deposition (PECVD) is one advantageous method for depositing DLC coatings on large areas at high deposition rates. Plasma based CVD coating process is a non-line-of-sight technique, i.e. the plasma conformally covers the part to be coated and the entire exposed surface of the part is coated with uniform thickness. The surface finish of the part may be retained after the DLC coating application. One advantage of PECVD is that the temperature of the substrate part does not increase above about 150° C. during the coating operation. The fluorine-containing DLC (F-DLC) and silicon-containing DLC (Si-DLC) films can be synthesized using plasma deposition technique using a process gas of acetylene ($C_2H_2$) mixed with fluorine-containing and silicon-containing precursor gases respectively (e.g., tetra-fluoro-ethane and hexa-methyl-disiloxane).

Figure 18:
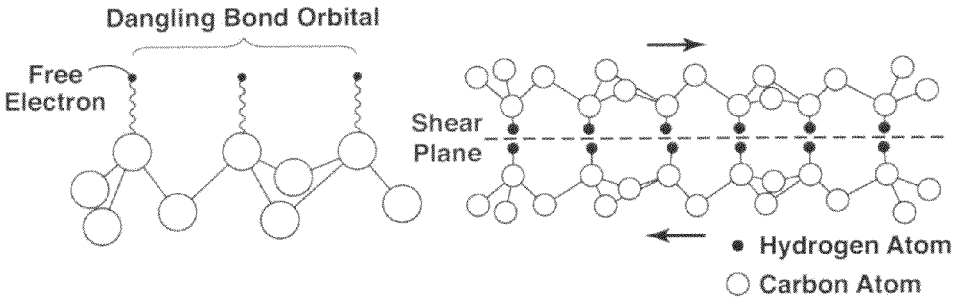
FIG. 18 depicts a schematic illustration of the hydrogen dangling bond theory.

The DLC coatings disclosed herein may exhibit coefficients of friction within the ranges earlier described. The ultra-low COF may be based on the formation of a thin graphite film in the actual contact areas. As $sp^3$ bonding is a thermodynamically unstable phase of carbon at elevated temperatures of 600 to 1500° C., depending on the environmental conditions, it may transform to graphite which may function as a solid lubricant. These high temperatures may occur as very short flash (referred to as the incipient temperature) temperatures in the asperity collisions or contacts. An alternative theory for the ultra-low COF of DLC coatings is the presence of hydrocarbon-based slippery film. The tetrahedral structure of a $sp^3$ bonded carbon may result in a situation at the surface where there may be one vacant electron coming out from the surface, that has no carbon atom to attach to (see FIG. 18), which is referred to as a "dangling bond" orbital. If one hydrogen atom with its own electron is put on such carbon atom, it may bond with the dangling bond orbital to form a two-electron covalent bond. When two such smooth surfaces with an outer layer of single hydrogen atoms slide over each other, shear will take place between the hydrogen atoms. There is no chemical bonding between the surfaces, only very weak van der Waals forces, and the surfaces exhibit the properties of a heavy hydrocarbon wax. As illustrated in FIG. 18, carbon atoms at the surface may make three strong bonds leaving one electron in the dangling bond orbital pointing out from the surface. Hydrogen atoms attach to such surface which becomes hydrophobic and exhibits low friction.

The DLC coatings for sleeved oil and gas well production devices disclosed herein also prevent wear due to their tribological properties. In particular, the DLC coatings disclosed herein are resistant to abrasive and adhesive wear making them suitable for use in applications that experience extreme contact pressure, both in rolling and sliding contact.

In addition to low friction and wear/abrasion resistance, the DLC coatings for sleeved oil and gas well production devices disclosed herein also exhibit durability and adhesive strength to the outer surface of the body assembly for deposition. DLC coating films may possess a high level of intrinsic residual stress (~1 GPa) which has an influence on their tribological performance and adhesion strength to the substrate (e.g., steel) for deposition. Typically DLC coatings deposited directly on steel surface suffer from poor adhesion strength. This lack of adhesion strength restricts the thickness and the incompatibility between DLC and steel interface, which may result in delamination at low loads. To overcome these problems, the DLC coatings disclosed herein may also include interlayers of various metallic (for example, but not limited to, Cr, W, Ti) and ceramic compounds (for example, but not limited to, CrN, SiC) between the outer surface of the oil and gas well production device and the DLC coating layer. These ceramic and metallic interlayers relax the compressive residual stress of the DLC coatings disclosed herein to increase the adhesion and load carrying capabilities. An alternative approach to improving the wear/friction and mechanical durability of the DLC coatings disclosed herein is to incorporate multilayers with intermediate buffering layers to relieve residual stress build-up and/or duplex hybrid coating treatments. In one form, the outer surface of the oil and gas well production device for treatment may be nitrided or carburized, a precursor treatment prior to DLC coating deposition, in order to harden and retard plastic deformation of the substrate layer which results in enhanced coating durability.

Multi-Layered Coatings and Hybrid Coatings:

Multi-layered coatings on sleeved oil and gas well production devices are disclosed herein and may be used in order to maximize the thickness of the coatings for enhancing their durability. The coated sleeved oil and gas well production devices disclosed herein may include not only a single layer, but also two or more coating layers. For example, two, three, four, five or more coating layers may be deposited on portions of the sleeve element. Each coating layer may range from 0.5 to 5000 microns in thickness with a lower limit of 0.5, 0.7, 1.0, 3.0, 5.0, 7.0, 10.0, 15.0, or 20.0 microns and an upper limit of 25, 50, 75, 100, 200, 500, 1000, 3000, or 5000 microns. The total thickness of the multi-layered coating may range from 0.5 to 30,000 microns. The lower limit of the total multi-layered coating thickness may be 0.5, 0.7, 1.0, 3.0, 5.0, 7.0, 10.0, 15.0, or 20.0 microns in thickness. The upper limit of the total multi-layered coating thickness may be 25, 50, 75, 100, 200, 500, 1000, 3000, 5000, 10000, 15000, 20000, or 30000 microns in thickness.

In another embodiment of the coated sleeved oil and gas well production devices disclosed herein, the body assembly of the oil and gas well production device may include hardbanding on at least a portion of the exposed outer surface to provide enhanced wear resistance and durability. Hence, the one or more coating layers are deposited on top of the hardbanding to form a hybrid type coating structure. The thickness of hardbanding layer may range from several times that of to equal to the thickness of the outer coating layer or layers. Non-limiting exemplary hardbanding materials include cermet based materials, metal matrix composites, nanocrystalline metallic alloys, amorphous alloys and hard metallic alloys. Other non-limiting exemplary types of hardbanding include carbides, nitrides, borides, and oxides of elemental tungsten, titanium, niobium, molybdenum, iron, chromium, and silicon dispersed within a metallic alloy matrix. Such hardbanding may be deposited by weld overlay, thermal spraying or laser/electron beam cladding.

The coatings for use in coated sleeved oil and gas well production devices disclosed herein may also include one or more buffer layers (also referred to herein as adhesive layers). The one or more buffer layers may be interposed between the outer surface of the body assembly and the single layer or the two or more layers in a multi-layer coating configuration. The one or more buffer layers may be chosen from the following elements or alloys of the following elements: silicon, titanium, chromium, tungsten, tantalum, niobium, vanadium, zirconium, and/or hafnium. The one or more buffer layers may also be chosen from carbides, nitrides, carbo-nitrides, oxides of the following elements: silicon, titanium, chromium, tungsten, tantalum, niobium, vanadium, zirconium, and/or hafnium. The one or more buffer layers are generally interposed between the hardbanding (when utilized) and one or more coating layers or between coating layers. The buffer layer thickness may be a fraction of or approach the thickness of the coating layer.

In yet another embodiment of the coated sleeved oil and gas well production devices disclosed herein, the body assembly may further include one or more buttering layers interposed between the outer surface of the body assembly and the coating or hardbanding layer on at least a portion of the exposed outer surface to provide enhanced toughness, to minimize any dilution from the substrate steel alloying into the outer coating or hardbanding, and to minimize residual stress absorption. Non-limiting exemplary buttering layers include stainless steel or a nickel based alloy. The one or more buttering layers are generally positioned adjacent to or on top of the body assembly of the oil and gas well production device for coating.

In one advantageous embodiment of the coated sleeved oil and gas well production devices disclosed herein, multilayered carbon based amorphous coating layers, such as diamond-like-carbon (DLC) coatings, may be applied to the device. The diamond-like-carbon (DLC) coatings suitable for oil and gas well production device may be chosen from ta-C, ta-C:H, DLCH, PLCH, GLCH, Si-DLC, Me-DLC, N-DLC, O-DLC, B-DLC, F-DLC and combinations thereof. One particularly advantageous DLC coating for such applications is DLCH or ta-C:H. The structure of multi-layered DLC coatings may include individual DLC layers with adhesion or buffer layers between the individual DLC layers. Exemplary adhesion or buffer layers for use with DLC coatings include, but are not limited to, the following elements or alloys of the following elements: silicon, titanium, chromium, tungsten, tantalum, niobium, vanadium, zirconium, and/or hafnium. Other exemplary adhesion or buffer layers for use with DLC coatings include, but are not limited to, carbides, nitrides, carbo-nitrides, oxides of the following elements: silicon, titanium, chromium, tungsten, tantalum, niobium, vanadium, zirconium, and/or hafnium. These buffer or adhesive layers act as toughening and residual stress relieving layers and permit the total DLC coating thickness for multi-layered embodiments to be increased while maintaining coating integrity for durability.

In yet another advantageous form of the coated sleeved oil and gas well production devices disclosed herein, to improve the durability, mechanical integrity and downhole performance of relatively thin DLC coating layers, a hybrid coating approach may be utilized wherein one or more DLC coating layers may be deposited on a state-of-the-art hardbanding. This embodiment provides enhanced DLC-hardbanding interface strength and also provides protection to the downhole devices against premature wear should the DLC either wear away or delaminate. In another form of this embodiment, an advanced surface treatment may be applied to the steel substrate prior to the application of DLC layer(s) to extend the durability and enhance the wear, friction, fatigue and corrosion performance of DLC coatings. Advanced surface treatments may be chosen from ion implantation, nitriding, carburizing, shot peening, laser and electron beam glazing, laser shock peening, and combinations thereof. Such surface treatment can harden the substrate surface by introducing additional species and/or introduce deep compressive residual stress resulting in inhibition of the crack growth induced by impact and wear damage. In yet another form of this embodiment, one or more buttering layers as previously described may be interposed between the substrate and the hardbanding with one or more DLC coating layers interposed on top of the hardbanding.

Figure 26:
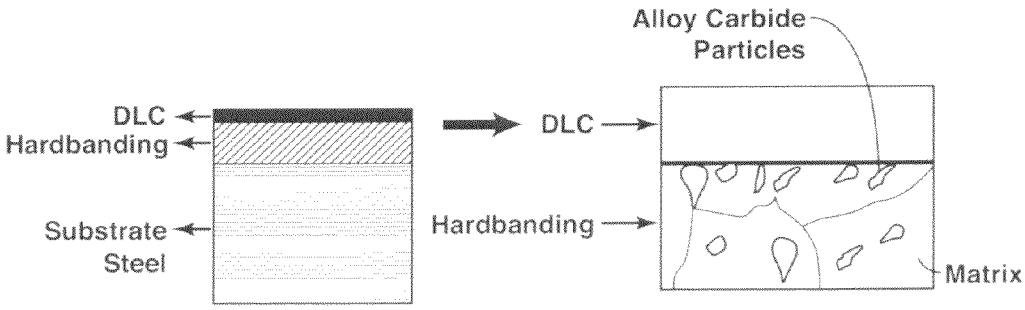
FIG. 26 depicts an exemplary schematic of hybrid DLC coating on hardbanding for drill stem assemblies.

FIG. 26 is an exemplary embodiment of a coating on a sleeved oil and gas well production device utilizing multi-layer hybrid coating layers, wherein a DLC coating layer is deposited on top of hardbanding on a steel substrate. In another form of this embodiment, the hardbanding may be post-treated (e.g., etched) to expose the alloy carbide particles to enhance the adhesion of DLC coatings to the hardbanding as also shown in FIG. 26. Such hybrid coatings can be applied to downhole devices such as the tool joints and stabilizers to enhance the durability and mechanical integrity of the DLC coatings deposited on these devices and to provide a "second line of defense" should the outer layer either wear-out or delaminate, against the aggressive wear and erosive conditions of the downhole environment in subterraneous rotary drilling operations. In another form of this embodiment, one or more buffer layers and/or one or more buttering layers as previously described may be included within the hybrid coating structure to further enhance properties and performance oil and gas well drilling, completions and production operations.

Application of these coating technologies to sleeves proximal to oil and gas well production devices provide potential benefits, including, but not limited to drilling, completions, stimulation, workover, and production operations. Efficient and reliable drilling, completions, stimulation, workover, and production operations may be enhanced by the application of such coatings to sleeved devices to mitigate friction, wear, erosion, corrosion, and deposits, as was discussed in detail above.

Exemplary Method of Using Coated Sleeved Device Embodiments:

In one exemplary embodiment, a coated sleeved oil and gas well production device comprises providing a coated oil and gas well production device including one or more cylindrical bodies with one or more sleeves proximal to the outer diameter or the inner diameter of the one or more cylindrical bodies, and a coating on at least a portion of the inner sleeve surface, the outer sleeve surface, or a combination thereof of the one or more sleeves, wherein the coating is chosen from an amorphous alloy, a heat-treated electroless or electro plated based nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof, and utilizing the coated sleeved oil and gas well production device in well construction, completion, or production operations.

In another exemplary embodiment, a coated sleeved oil and gas well production device comprises providing a coated oil and gas well production device including one or more bodies with the proviso that the one or more bodies does not include a drill bit, with one or more sleeves proximal to the outer surface or the inner surface of the one or more bodies, and a coating on at least a portion of the inner sleeve surface, the outer sleeve surface, or a combination thereof of the one or more sleeves, wherein the coating is chosen from an amorphous alloy, a heat-treated electroless or electro plated based nickel-phosphorous composite with a phosphorous content greater than 12 wt %, graphite, $MoS_2$, $WS_2$, a fullerene based composite, a boride based cermet, a quasicrystalline material, a diamond based material, diamond-like-carbon (DLC), boron nitride, and combinations thereof, and utilizing the coated sleeved oil and gas well production device in well construction, completion, or production operations.

Test Methods

Coefficient of friction was measured using ball-on-disk tester according to ASTM G99 test method. The test method requires two specimens—a flat disk specimen and a spherically ended ball specimen. A ball specimen, rigidly held by using a holder, is positioned perpendicular to the flat disk. The flat disk specimen slides against the ball specimen by revolving the flat disk of 2.7 inches diameter in a circular path. The normal load is applied vertically downward through the ball so the ball is pressed against the disk. The specific normal load can be applied by means of attached weights, hydraulic or pneumatic loading mechanisms. During the testing, the frictional forces are measured using a tension-compression load cell or similar force-sensitive devices attached to the ball holder. The friction coefficient can be calculated from the measured frictional forces divided by normal loads. The test was done at room temperature and 150° F. under various testing condition sliding speeds. Quartz or mild steel ball, 4 mm~5 mm diameter, was utilized as a counterface material.

Velocity strengthening or weakening was evaluated by measuring the friction coefficient at various sliding velocities using ball-on-disk friction tester by ASTM G99 test method described above.

Hardness was measured according to ASTM C 1327 Vickers hardness test method. The Vickers hardness test method consists of indenting the test material with a diamond indenter, in the form of a right pyramid with a square base and an angle of 136 degrees between opposite faces subjected to a load of 1 to 100 kgf. The full load is normally applied for 10 to 15 seconds. The two diagonals of the indentation left in the surface of the material after removal of the load are measured using a microscope and their average is calculated. The area of the sloping surface of the indentation is calculated. The Vickers hardness is the quotient obtained by dividing the kgf load by the square mm area of indentation. The advantages of the Vickers hardness test are that extremely accurate readings can be taken, and just one type of indenter is used for all types of metals and surface treatments. The hardness of thin coating layer (e.g., less than 100 μm) has been evaluated by nanoindentation wherein the normal load (P) is applied to a coating surface by an indenter with well-known pyramidal geometry (e.g., Berkovich tip, which has a three-sided pyramid geometry). In nanoindentation small loads and tip sizes are used to eliminate or reduce the effect from the substrate, so the indentation area may only be a few square micrometers or even nanometers. During the course of the nanoindentation process, a record of the depth of penetration is made, and then the area of the indent is determined using the known geometry of the indentation tip. The hardness can be obtained by dividing the load (kgf) by the area of indentation (square mm).

Wear performance was measured by the ball on disk geometry according to ASTM G99 test method. The amount of wear, or wear volume loss of the disk and ball is determined by measuring the dimensions of both specimens before and after the test. The depth or shape change of the disk wear track was determined by laser surface profilometry and atomic force microscopy. The amount of wear, or wear volume loss of the ball was determined by measuring the dimensions of specimens before and after the test. The wear volume in ball was calculated from the known geometry and size of the ball.

Water contact angle was measured according to ASTM D5725 test method. The method referred to as "sessile drop method" measures a liquid contact angle goniometer using an optical subsystem to capture the profile of a pure liquid on a solid substrate. A drop of liquid (e.g., water) was placed (or allowed to fall from a certain distance) onto a solid surface. When the liquid settled (has become sessile), the drop retained its surface tension and became ovate against the solid surface. The angle formed between the liquid/solid interface and the liquid/vapor interface is the contact angle. The contact angle at which the oval of the drop contacts the surface determines the affinity between the two substances. That is, a flat drop indicates a high affinity, in which case the liquid is said to "wet" the substrate. A more rounded drop (by height) on top of the surface indicates lower affinity because the angle at which the drop is attached to the solid surface is more acute. In this case the liquid is said to "not wet" the substrate. The sessile drop systems employ high resolution cameras and software to capture and analyze the contact angle.

EXAMPLES

Illustrative Example 1

Figure 19:
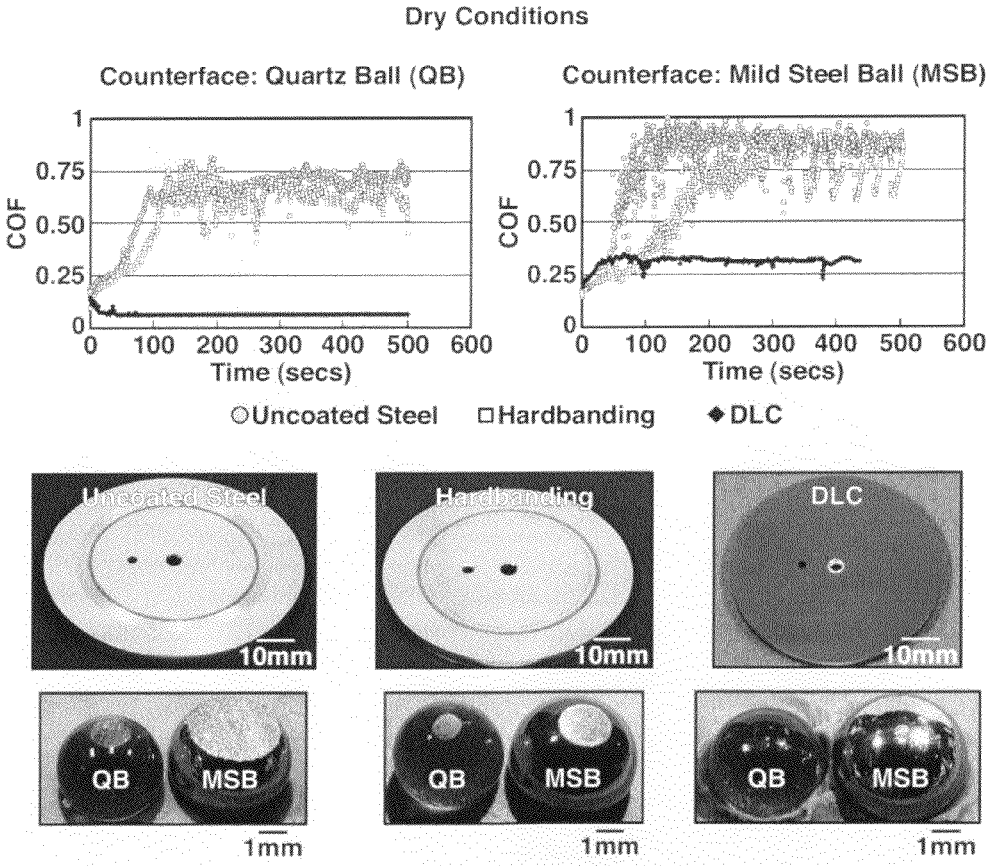
FIG. 19 depicts the friction and wear performance of DLC coating in a dry sliding wear test.

DLC coatings were applied on 4142 steel substrates by vapor deposition technique. DLC coatings had a thickness ranging from 1.5 to 25 micrometers. The hardness was measured to be in the range of 1,300 to 7,500 Vickers Hardness Number. Laboratory tests based on ball on disk geometry have been conducted to demonstrate the friction and wear performance of the coating. Quartz ball and mild steel ball were used as counterface materials to simulate open hole and cased hole conditions respectively. In one ambient temperature test, uncoated 4142 steel, DLC coating and commercial state-of-the-art hardbanding weld overlay coating were tested in "dry" or ambient air condition against quartz counterface material at 300 g normal load and 0.6 m/sec sliding speed to simulate an open borehole condition. Up to 10 times improvement in friction performance (reduction of friction coefficient) over uncoated 4142 steel and hardbanding could be achieved in DLC coatings as shown in FIG. 19.

In another ambient temperature test, uncoated 4142 steel, DLC coating and commercial state-of-the-art hardbanding weld overlay coating were tested against mild steel counterface material to simulate a cased hole condition. Up to three times improvement in friction performance (reduction of friction coefficient) over uncoated 4142 steel and hardbanding could be achieved in DLC coatings as shown in FIG. 19. The DLC coating polished the quartz ball due to higher hardness of DLC coating than that of counterface materials (i.e., quartz and mild steel). However, the volume loss due to wear was minimal in both quartz ball and mild steel ball. On the other hand, the plain steel and hardbanding caused significant wear in both the quartz and mild steel balls, indicating that these are not very "casing friendly".

Figure 20:
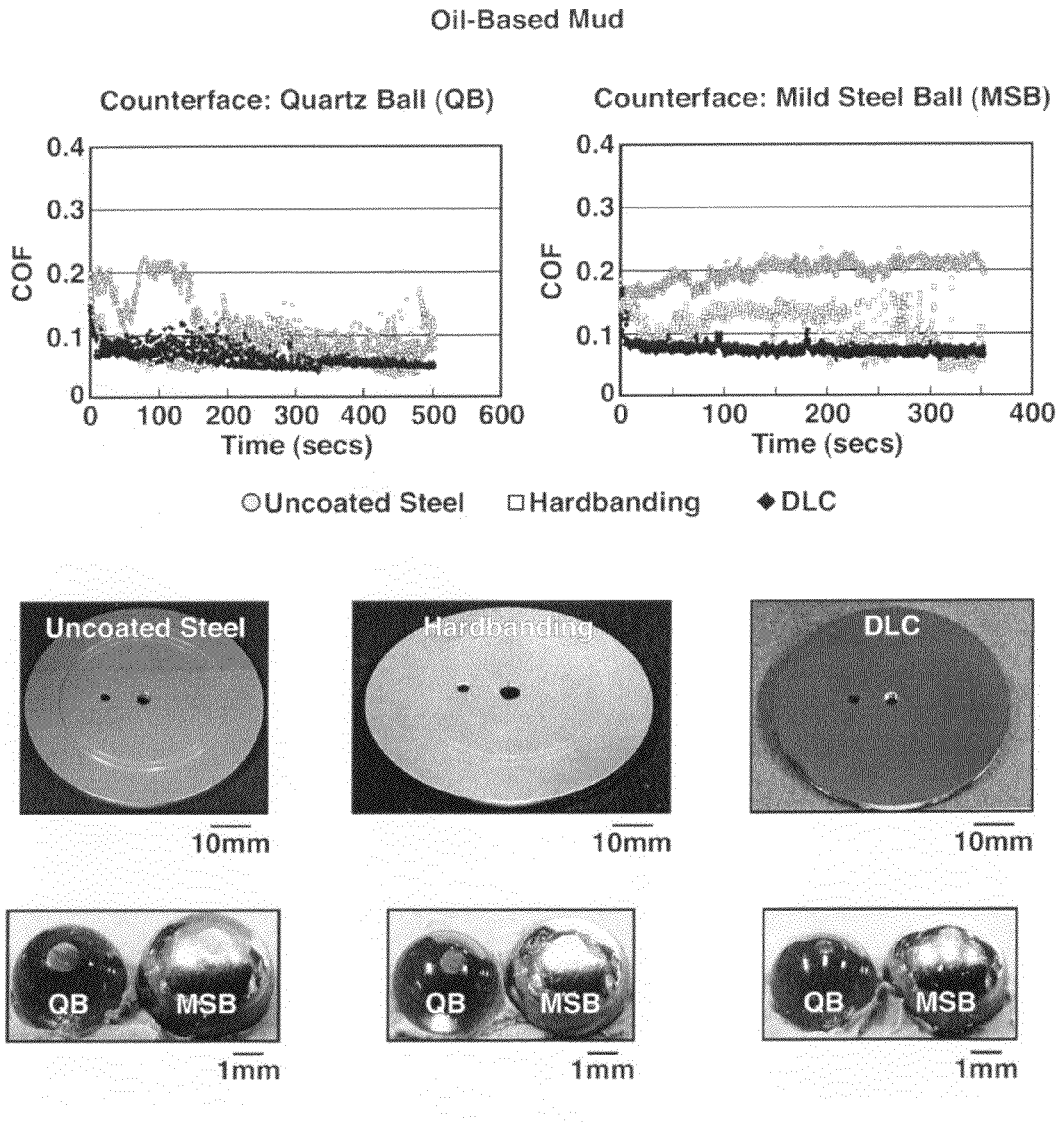
FIG. 20 depicts the friction and wear performance of the DLC coating in oil based mud.

Ball on disk wear and friction coefficient were also tested at ambient temperature in oil based mud. Quartz ball and mild steel balls were used as counterface materials to simulate open hole and cased hole respectively. The DLC coating exhibited significant advantages over commercial hardbanding as shown in FIG. 20. Up to 30% improvement in friction performance (reduction of friction coefficient) over uncoated 4142 steel and hardbanding could be achieved with DLC coatings. The DLC coating polished the quartz ball due to its higher hardness than that of quartz. On the other hand, for the case of uncoated steel disk, both the mild steel and quartz balls as well as the steel disc showed significant wear. For a comparable test, the wear behavior of hardbanded disk was intermediate to that of DLC coated disc and the uncoated steel disc.

Figure 21:
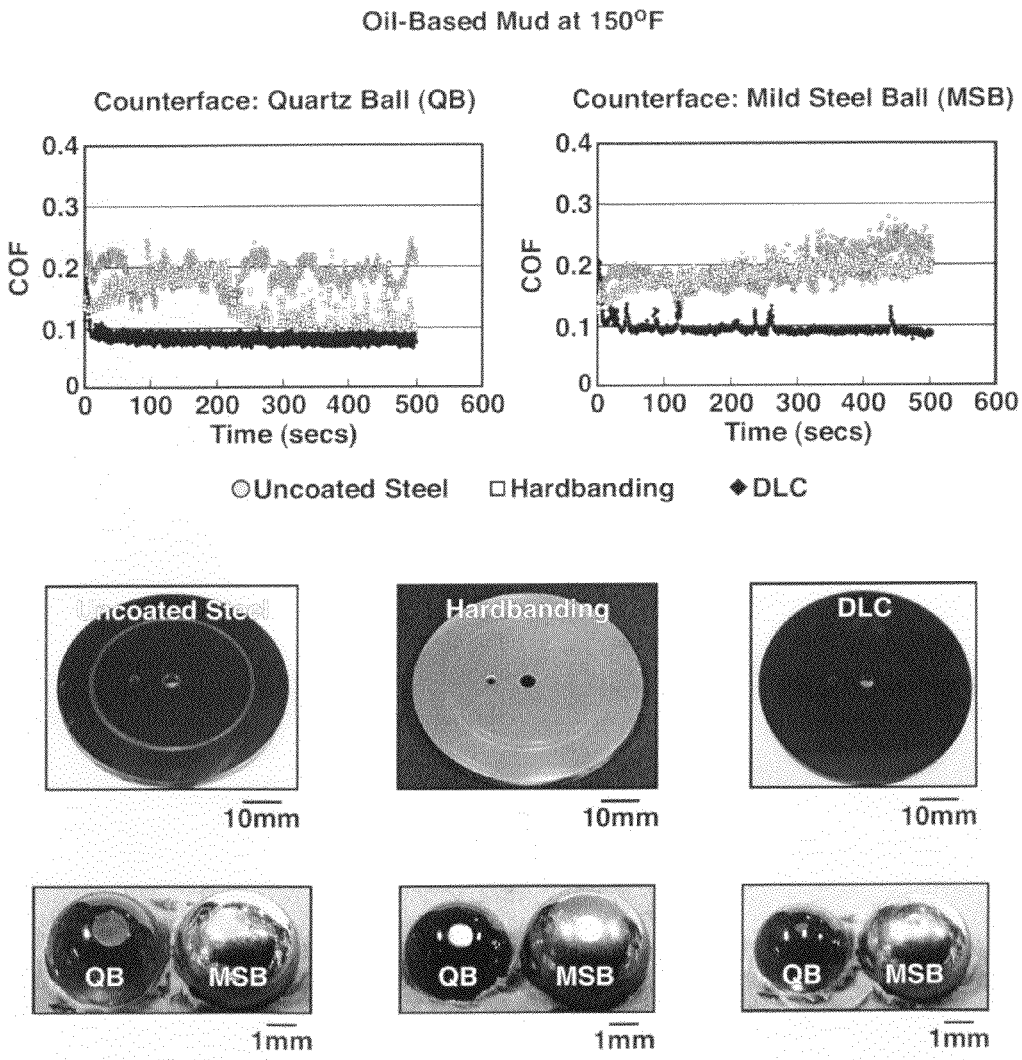
FIG. 21 depicts the friction and wear performance of DLC coating at elevated temperature (150° F.) sliding wear test in oil based mud.

FIG. 21 depicts the wear and friction performance at elevated temperatures. The tests were carried out in oil based mud heated to 150° F., and again the quartz ball and mild steel ball were used as counterface materials to simulate an open hole and cased hole condition respectively. DLC coatings exhibited up to 50% improvement in friction performance (reduction of friction coefficient) over uncoated 4142 steel and commercial hardbanding. Uncoated steel and hardbanding caused wear damage in the counterface materials of quartz and mild steel ball, whereas, significantly lower wear damage has been observed in the counterface materials rubbed against the DLC coating.

Figure 22:
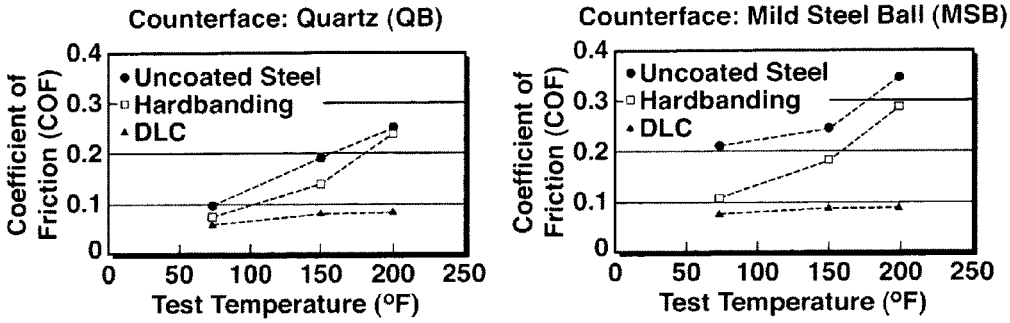
FIG. 22 depicts the friction performance of DLC coating at elevated temperatures (150° F. and 200° F.) in comparison to that of uncoated bare steel and hardbanding in oil based mud.

FIG. 22 shows the friction performance of DLC coating at elevated temperature (150° F. and 200° F.). In this test data, the DLC coatings exhibited low friction coefficient at elevated temperature up to 200° F. However, the friction coefficient of uncoated steel and hardbanding increased significantly with temperature.

Illustrative Example 2

Figure 23:
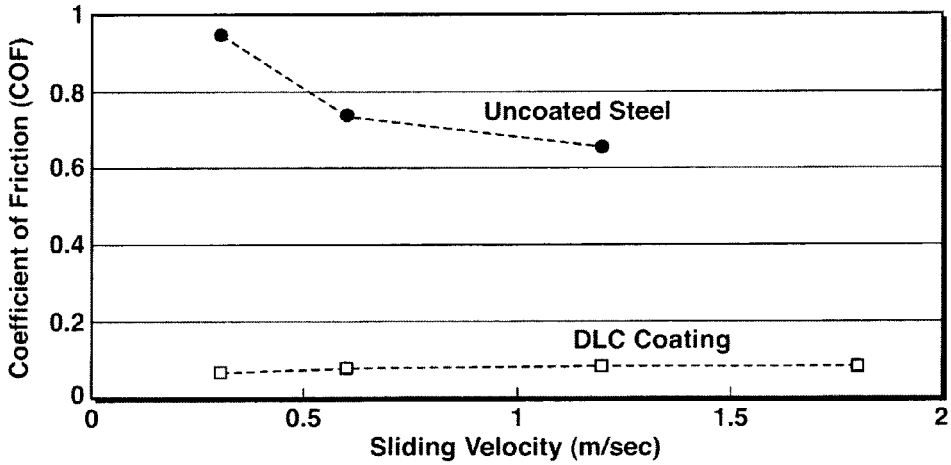
FIG. 23 depicts the velocity-weakening performance of DLC coating in comparison to an uncoated bare steel substrate.

In the laboratory wear/friction testing, the velocity dependence (velocity weakening or strengthening) of the friction coefficient for a DLC coating and uncoated 4142 steel was measured by monitoring the shear stress required to slide at a range of sliding velocity of 0.3 m/sec~1.8 m/sec. Quartz ball was used as a counterface material in the dry sliding wear test. The velocity-weakening performance of the DLC coating relative to uncoated steel is depicted in FIG. 23. Uncoated 4142 steel exhibits a decrease of friction coefficient with sliding velocity (i.e. significant velocity weakening), whereas DLC coatings show no velocity weakening and indeed, there seems to be a slight velocity strengthening of COF (i.e. slightly increasing COF with sliding velocity), which may be advantageous for mitigating torsional instability, a precursor to stick-slip vibrations.

Illustrative Example 3

Figure 24:
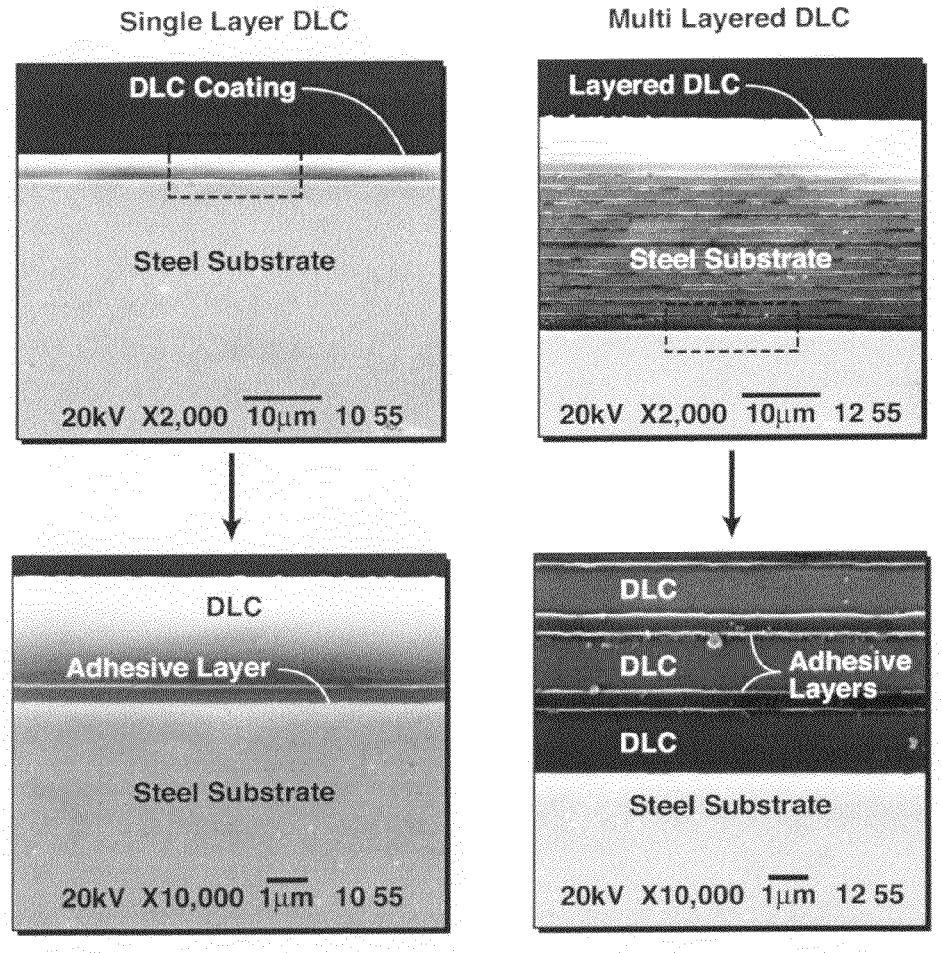
FIG. 24 depicts SEM cross-sections of single layer and multi-layered DLC coatings disclosed herein.

Multi-layered DLC coatings were produced in order to maximize the thickness of the DLC coatings for enhancing their durability for drill stem assemblies used in drilling operations. In one form, the total thickness of the multi-layered DLC coating varied from 6 μM to 25 μm. FIG. 24 depicts SEM images of both single layer and multilayer DLC coatings for drill stem assemblies produced via PECVD. An adhesive layer(s) used with the DLC coatings was a siliceous buffer layer.

Illustrative Example 4

Figure 25:
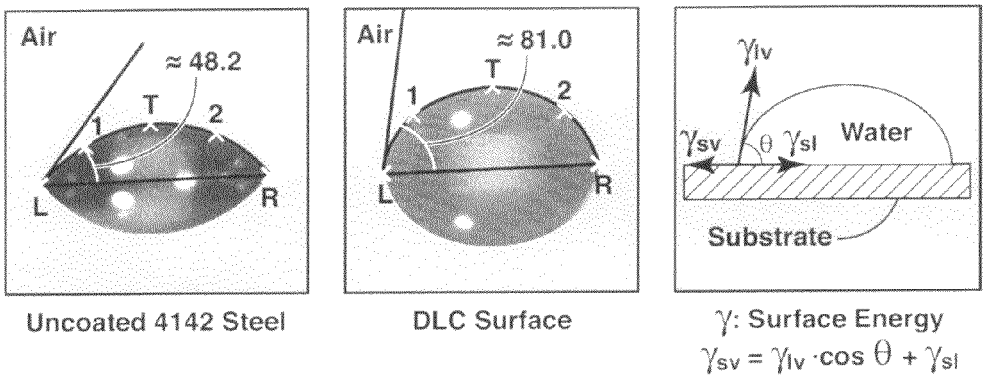
FIG. 25 depicts water contact angle for DLC coatings versus uncoated 4142 steel.

The surface energy of DLC coated substrates in comparison to an uncoated 4142 steel surface was measured via water contact angle. Results are depicted in FIG. 25 and indicate that a DLC coating provides a substantially lower surface energy in comparison to an uncoated steel surface. The lower surface energy may provide lower adherence surfaces for mitigating or reducing bit/stabilizer balling and to prevent formation of deposits of asphaltenes, paraffins, scale, and/or hydrates.

Applicants have attempted to disclose all embodiments and applications of the disclosed subject matter that could be reasonably foreseen. However, there may be unforeseeable, insubstantial modifications that remain as equivalents. While the present disclosure has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated.

What is claimed is:

1. A coated sleeved oil and gas well production device comprising:

one or more cylindrical bodies, one or more sleeves proximal to the outer diameter or inner diameter of the one or more cylindrical bodies, and a coating on at least a portion of the inner sleeve surface, the outer sleeve surface, or a combination thereof of the one or more sleeves, wherein the coating is chosen from a fullerene based composite, diamond-like-carbon (DLC), and combinations thereof, wherein the coefficient of friction of the coating is less than or equal to 0.15, and the coating provides a hardness greater than 1000 VHN.

2. The coated sleeved device of claim 1, wherein the one or more cylindrical bodies include two or more cylindrical bodies in relative motion to each other.

3. The coated sleeved device of claim 1, wherein the one or more cylindrical bodies include two or more cylindrical bodies that are static relative to each other.

4. The coated sleeved device of claim 1, wherein the two or more cylindrical bodies include two or more radii.

5. The coated sleeved device of claim 4, wherein the two or more cylindrical bodies include one or more cylindrical bodies substantially within one or more other cylindrical bodies.

6. The coated sleeved device of claim 4, wherein the two or more radii are of substantially the same dimensions or substantially different dimensions.

7. The coated sleeved device of claim 4, wherein the two or more cylindrical bodies are contiguous to each other.

8. The coated sleeved device of claim 4, wherein the two or more cylindrical bodies are not contiguous to each other.

9. The coated sleeved device of claim 7 or 8, wherein the two or more cylindrical bodies are coaxial or non-coaxial.

10. The coated sleeved device of claim 9, wherein the two or more cylindrical bodies have substantially parallel axes.

11. The coated sleeved device of claim 1, wherein the one or more cylindrical bodies are helical in inner surface, helical in outer surface or a combination thereof.

12. The coated sleeved device of claim 1, wherein the one or more cylindrical bodies are solid, hollow or a combination thereof.

13. The coated sleeved device of claim 1, wherein the one or more cylindrical bodies include at least one cylindrical body that is substantially circular, substantially elliptical, or substantially polygonal in outer cross-section, inner cross-section or inner and outer cross-section.

14. The coated sleeved device of claim 1, wherein the coefficient of friction of the coating is less than or equal to 0.10.

15. The coated sleeved device of claim 1, wherein the coating provides a hardness of greater than 1500 VHN.

16. The sleeved coated device of claim 1, wherein the coating provides at least 3 times greater wear resistance than an uncoated device.

17. The coated sleeved device of claim 1, wherein the water contact angle of the coating is greater than 60 degrees.

18. The coated sleeved device of claim 1, wherein the coating provides a surface energy less than 1 $J/m^2$.

19. The coated sleeved device of claim 18, wherein the coating provides a surface energy less than 0.1 $J/m^2$.

20. The coated sleeved device of claim 1, wherein the coating comprises a single coating layer or two or more coating layers.

21. The coated sleeved device of claim 20, wherein the two or more coating layers are of substantially the same or different coatings.

22. The coated sleeved device of claim 20, wherein the thickness of the single coating layer and of each layer of the two or more coating layers range from 0.5 microns to 5000 microns.

23. The coated sleeved device of claim 20, wherein the coating further comprises one or more buffer layers.

24. The coated sleeved device of claim 23, wherein the one or more buffer layers are interposed between the surface of the one or more cylindrical bodies and the single coating layer or the two or more coating layers.

25. The coated sleeved device of claim 23, wherein the one or more buffer layers are chosen from elements, alloys, carbides, nitrides, carbo-nitrides, and oxides of the following: silicon, titanium, chromium, tungsten, tantalum, niobium, vanadium, zirconium, or hafnium.

26. The coated sleeved device of claim 1, wherein the dynamic friction coefficient of the coating is not lower than 50% of the static friction coefficient of the coating.

27. The coated sleeved device of claim 1, wherein the dynamic friction coefficient of the coating is greater than or equal to the static friction coefficient of the coating.

28. The coated sleeved device of claim 1, wherein the one or more cylindrical bodies further includes hardbanding on at least a portion thereof.

29. The coated sleeved device of claim 28, wherein the hardbanding comprises a cermet based material, a metal matrix composite or a hard metallic alloy.

30. The coated sleeved device of claim 1 or 28 wherein the one or more cylindrical bodies further includes a buttering layer interposed between the surface of the one or more cylindrical bodies and the coating or hardbanding on at least a portion of the cylindrical bodies.

31. The coated sleeved device of claim 30, wherein the buttering layer comprises a stainless steel or a nickel based alloy.

32. The coated sleeved device of claim 1, wherein the one or more cylindrical bodies further include threads.

33. The coated sleeved device of claim 32, wherein at least a portion of the threads are coated.

34. The coated sleeved device of claim 32 or 33, further comprising a sealing surface, wherein at least a portion of the sealing surface is coated.

35. The coated sleeved device of any one of claim 1, 2 or 3, wherein the one or more cylindrical bodies are well construction devices.

36. The coated sleeved device of claim 35, wherein the well construction devices are chosen from drill stem, casing, tubing string, wireline/braided line/multi-conductor/single conductor/slickline; coiled tubing, vaned rotors and stators of Moyno™ and progressive cavity pumps, expandable tubulars, expansion mandrels, centralizers, contact rings, wash pipes, shaker screens for solids control, overshot and grapple, marine risers, surface flow lines, and combinations thereof.

37. The coated sleeved device of any one of claim 1, 2 or 3, wherein the one or more cylindrical bodies are completion and production devices.

38. The coated sleeved device of claim 37, wherein the completion and production devices are chosen from plunger lifts; completion sliding sleeve assemblies; coiled tubing; sucker rods; Corods™; tubing string; pumping jacks; stuffing boxes; packoffs and lubricators; pistons and piston liners; vaned rotors and stators of Moyno™ and progressive cavity pumps; expandable tubulars; expansion mandrels; control lines and conduits; tools operated in well bores; wireline/braided line/multi-conductor/single conductor/slickline; centralizers; contact rings; perforated basepipe; slotted basepipe; screen basepipe for sand control; wash pipes; shunt tubes; service tools used in gravel pack operations; blast joints; sand screens disposed within completion intervals; Mazeflo™ completion screens; sintered screens; wirewrap screens; shaker screens for solids control; overshot and grapple; marine risers; surface flow lines, stimulation treatment lines, and combinations thereof.

39. The coated sleeved device of claim 1 wherein the one or more cylindrical bodies are a pin or box connection of a pipe tool joint.

40. The coated sleeved device of claim 39 wherein the one or more cylindrical bodies are configured with a proximal cylindrical cross-section that is circular in cross-section.

41. The coated sleeved device of claim 39 wherein the one or more cylindrical bodies are configured with a proximal cylindrical cross-section that is non-circular in cross-section.

42. The coated sleeved device of claim 39 wherein the pin or box connection is oriented such that the pin is facing up and the box is facing down relative to the direction of gravity.

43. The coated sleeved device of claim 39 wherein the pin or box connection is oriented such that the pin is facing down and the box is facing up relative to the direction of gravity.

44. The coated sleeved device of claim 1, wherein the one or more sleeves comprise metals, metal alloys, ceramics, cermets, polymers, carbon steels, steel alloys, stainless steels, WC based hard metals, or combinations thereof.

45. A coated sleeved oil and gas well production device comprising:

an oil and gas well production device including one or more bodies with the proviso that the one or more bodies does not include a drill bit, one or more sleeves proximal to the outer surface or the inner surface of the one or more bodies, and a coating on at least a portion of the inner sleeve surface, the outer sleeve surface, or a combination thereof of the one or more sleeves, wherein the coating is chosen from a fullerene based composite, diamond-like-carbon (DLC), and combinations thereof, wherein the coefficient of friction of the coating is less than or equal to 0.15, and the coating provides a hardness greater than 1000 VHN.

46. The coated sleeved device of claim 45, wherein the one or more bodies include two or more bodies in relative motion to each other.

47. The coated sleeved device of claim 45, wherein the one or more bodies include two or more bodies that are static relative to each other.

48. The coated sleeved device of claim 45, wherein the one or more bodies include spheres and complex geometries.

49. The coated sleeved device of claim 48, wherein the complex geometries have at least a portion that is non-cylindrical in shape.

50. The coated sleeved device of claim 45 or 47, wherein the two or more bodies include one or more bodies substantially within one or more other bodies.

51. The coated sleeved device of claim 45 or 47, wherein the two or more bodies are contiguous to each other.

52. The coated sleeved device of claim 45 or 47, wherein the two or more bodies are not contiguous to each other.

53. The coated sleeved device of claim 45 or 47, wherein the two or more bodies are coaxial or non-coaxial.

54. The coated sleeved device of claim 45, wherein the one or more bodies are solid, hollow or a combination thereof.

55. The coated sleeved device of claim 45, wherein the one or more bodies include at least one body that is substantially circular, substantially elliptical, or substantially polygonal in outer cross-section, inner cross-section or inner and outer cross-section.

56. The coated sleeved device of claim 45, wherein the coefficient of friction of the coating is less than or equal to 0.10.

57. The coated sleeved device of claim 45, wherein the coating provides a hardness of greater than 1500 VHN.

58. The coated sleeved device of claim 45, wherein the coating provides at least 3 times greater wear resistance than an uncoated device.

59. The coated sleeved device of claim 45, wherein the water contact angle of the coating is greater than 60 degrees.

60. The coated sleeved device of claim 45, wherein the coating provides a surface energy less than 1 $J/m^2$.

61. The coated sleeved device of claim 60, wherein the coating provides a surface energy less than 0.1 $J/m^2$.

62. The coated sleeved device of claim 45, wherein the coating comprises a single coating layer or two or more coating layers.

63. The coated sleeved device of claim 62, wherein the two or more coating layers are of substantially the same or different coatings.

64. The coated sleeved device of claim 62, wherein the thickness of the single coating layer and of each layer of the two or more coating layers range from 0.5 microns to 5000 microns.

65. The coated sleeved device of claim 62, wherein the coating further comprises one or more buffer layers.

66. The coated sleeved device of claim 65, wherein the one or more buffer layers are interposed between the surface of the one or more bodies and the single coating layer or the two or more coating layers.

67. The coated sleeved device of claim 65, wherein the one or more buffer layers are chosen from elements, alloys, carbides, nitrides, carbo-nitrides, and oxides of the following: silicon, titanium, chromium, tungsten, tantalum, niobium, vanadium, zirconium, or hafnium.

68. The coated sleeved device of claim 45, wherein the dynamic friction coefficient of the coating is not lower than 50% of the static friction coefficient of the coating.

69. The coated sleeved device of claim 45, wherein the dynamic friction coefficient of the coating is greater than or equal to the static friction coefficient of the coating.

70. The coated sleeved device of claim 45, wherein the one or more bodies further includes hardbanding on at least a portion thereof.

71. The coated sleeved device of claim 70, wherein the hardbanding comprises a cermet based material, a metal matrix composite or a hard metallic alloy.

72. The coated sleeved device of claim 45 or 70 wherein the one or more bodies further includes a buttering layer interposed between the surface of the one or more bodies and the coating or hardbanding on at least a portion of the bodies.

73. The coated sleeved device of claim 72, wherein the buttering layer comprises a stainless steel or a nickel based alloy.

74. The coated sleeved device of claim 45, wherein the one or more bodies further include threads.

75. The coated sleeved device of claim 74, wherein at least a portion of the threads are coated.

76. The coated sleeved device of claim 74 or 75, further comprising a sealing surface, wherein at least a portion of the sealing surface is coated.

77. The coated sleeved device of any one of claim 45, 46 or 47, wherein the one or more bodies are well construction devices.

78. The coated sleeved device of claim 77, wherein the well construction devices are chosen from chokes, valves, valve seats, nipples, ball valves, annular isolation valves, subsurface safety valves, centrifuges, elbows, tees, couplings, blowout preventers, wear bushings, dynamic metal-to-metal seals in reciprocating and/or rotating seals assemblies, springs in safety valves, shock subs, and jars, logging tool arms, rig skidding equipment, pallets, and combinations thereof.

79. The coated sleeved device of any one of claim 45, 46 or 47, wherein the one or more bodies are completion and production devices.

80. The coated sleeved device of claim 79, wherein the completion and production devices are chosen from, chokes, valves, valve seats, nipples, ball valves, inflow control devices, smart well valves, annular isolation valves, subsurface safety valves, centrifuges, gas lift and chemical injection valves, elbows, tees, couplings, blowout preventers, wear bushings, dynamic metal-to-metal seals in reciprocating and/or rotating seals assemblies, springs in safety valves, shock subs, and jars, logging tool arms, sidepockets, mandrels, packer slips, packer latches, sand probes, wellstream gauges, non-cylindrical components of sand screens, and combinations thereof.

81. The coated sleeved device of claim 45, wherein the one or more sleeves comprise metals, metal alloys, ceramics, cermets, polymers, carbon steels, steel alloys, stainless steels, WC based hard metals, or combinations thereof.

82. A method of using a coated sleeved oil and gas ell production device comprising:

providing a coated oil and gas well production device including one or more cylindrical bodies with one or more sleeves proximal to the outer diameter or the inner diameter of the one or more cylindrical bodies, and a coating on at least a portion of the inner sleeve surface, the outer sleeve surface, or a combination thereof of the one or more sleeves, wherein the coating is chosen from a fullerene based composite, diamond-like-carbon (DLC), and combinations thereof, wherein the coefficient of friction of the coating is less than or equal to 0.15, and the coating provides a hardness greater than 1000 VHN, and utilizing the coated sleeved oil and gas well production device in well construction, completion, or production operations.

83. The method of claim 82, wherein the one or more cylindrical bodies include two or more cylindrical bodies in relative motion to each other.

84. The method of claim 82, wherein the one or more cylindrical bodies include two or more cylindrical bodies that are static relative to each other.

85. The method of claim 82, wherein the two or more cylindrical bodies include two or more radii.

86. The method of claim 85, wherein the two or more cylindrical bodies includes one or more cylindrical bodies substantially within one or more other cylindrical bodies.

87. The method of claim 85, wherein the two or more radii are of substantially the same dimensions or substantially different dimensions.

88. The method of claim 85, wherein the two or more cylindrical bodies are contiguous to each other.

89. The method of claim 85, wherein the two or more cylindrical bodies are not contiguous to each other.

90. The method of claim 88 or 89, wherein the two or more cylindrical bodies are coaxial or non-coaxial.

91. The method of claim 90, wherein the two or more non-coaxial cylindrical bodies have substantially parallel axes.

92. The method of claim 82, wherein the one or more cylindrical bodies are helical in inner surface, helical in outer surface or a combination thereof.

93. The method of claim 82, wherein the one or more cylindrical bodies are solid, hollow or a combination thereof.

94. The method of claim 82, wherein the one or more cylindrical bodies include at least one cylindrical body that is substantially circular, substantially elliptical, or substantially polygonal in outer cross-section, inner cross-section or inner and outer cross-section.

95. The method of claim 82, wherein the coefficient of friction of the coating is less than or equal to 0.10.

96. The method of claim 82, wherein the coating provides at least 3 times greater wear resistance than an uncoated device.

97. The method of claim 82, wherein the water contact angle of the coating is greater than 60 degrees.

98. The method of claim 82, wherein the coating provides a surface energy less than 1 $J/m^2$.

99. The method of claim 82, wherein the coating comprises a single coating layer or two or more coating layers.

100. The method of claim 99, wherein the two or more coating layers are of substantially the same or different coatings.

101. The method of claim 99, wherein the thickness of the single coating layer and of each layer of the two or more coating layers range from 0.5 microns to 5000 microns.

102. The method of claim 99, wherein the coating further comprises one or more buffer layers.

103. The method of claim 102, wherein the one or more buffer layers are interposed between the surface of the one or more cylindrical bodies and the single coating layer or the two or more coating layers.

104. The method of claim 102, wherein the one or more buffer layers are chosen from elements, alloys, carbides, nitrides, carbo-nitrides, and oxides of the following: silicon, titanium, chromium, tungsten, tantalum, niobium, vanadium, zirconium, or hafnium.

105. The method of claim 82, wherein the dynamic friction coefficient of the coating is not lower than 50% of the static friction coefficient of the coating.

106. The method of claim 82, wherein the dynamic friction coefficient of the coating is greater than or equal to the static friction coefficient of the coating.

107. The method of claim 82, wherein the one or more cylindrical bodies further includes hardbanding on at least a portion thereof.

108. The method of claim 107, wherein the hardbanding comprises a cermet based material, a metal matrix composite or a hard metallic alloy.

109. The method of claim 82 or 107, wherein the one or more cylindrical bodies further includes a buttering layer interposed between the surface of the one or more cylindrical bodies and the coating or hardbanding on at least a portion of the cylindrical bodies.

110. The method of claim 109, wherein the buttering layer comprises a stainless steel or a nickel based alloy.

111. The method of claim 82, wherein the one or more cylindrical bodies further include threads.

112. The method of claim 111, wherein at least a portion of the threads are coated.

113. The method of claim 111 or 112, further comprising a sealing surface, wherein at least a portion of the sealing surface is coated.

114. The method of any one of claim 82, 83, or 84; wherein the one or more cylindrical bodies are well construction devices.

115. The method of claim 114, wherein the well construction devices are chosen from drill stem, casing, tubing string, wireline/braided line/multi-conductor/single conductor/slickline; coiled tubing, vaned rotors and stators of Moyno™ and progressive cavity pumps, expandable tubulars, expansion mandrels, centralizers, contact rings, wash pipes, shaker screens for solids control, overshot and grapple, marine risers, surface flow lines, and combinations thereof.

116. The method of any one of claim 82, 83, or 84, wherein the one or more cylindrical bodies are completion and production devices.

117. The method of claim 116, wherein the completion and production devices are chosen from plunger lifts; completion sliding sleeve assemblies; coiled tubing; sucker rods; Corods™; tubing string; pumping jacks; stuffing boxes;

packoffs and lubricators; pistons and piston liners; vaned rotors and stators of Moyno™ and progressive cavity pumps; expandable tubulars; expansion mandrels; control lines and conduits; tools operated in well bores; wireline/braided line/multi-conductor/single conductor/slickline; centralizers; contact rings; perforated basepipe; slotted basepipe; screen basepipe for sand control; wash pipes; shunt tubes; service tools used in gravel pack operations; blast joints; sand screens disposed within completion intervals; Mazeflo™ completion screens; sintered screens; wirewrap screens; shaker screens for solids control; overshot and grapple; marine risers; surface flow lines, stimulation treatment lines, and combinations thereof.

118. The method of claim 82, wherein the diamond-like-carbon (DLC) is applied by physical vapor deposition, chemical vapor deposition, or plasma assisted chemical vapor deposition coating techniques.

119. The method of claim 118, wherein the physical vapor deposition coating method is chosen from RF-DC plasma reactive magnetron sputtering, ion beam assisted deposition, cathodic arc deposition and pulsed laser deposition.

120. The method of claim 82 wherein the one or more cylindrical bodies are a pin or box connection of a pipe tool joint.

121. The method of claim 120 wherein the one or more cylindrical bodies are configured with a proximal cylindrical cross-section that is circular in cross-section.

122. The method of claim 120 wherein the one or more cylindrical bodies are configured with a proximal cylindrical cross-section that is non-circular in cross-section.

123. The method of claim 120 wherein the pin or box connection is oriented such that the pin is facing up and the box is facing down relative to the direction of gravity.

124. The method of claim 120 wherein the pin or box connection is oriented such that the pin is facing down and the box is facing up relative to the direction of gravity.

125. The method of claim 82, wherein the one or more sleeves comprise metals, metal alloys, ceramics, cermets, polymers, carbon steels, steel alloys, stainless steels, WC based hard metals, or combinations thereof.

126. A method of using a coated sleeved oil and gas well production device comprising:

providing a coated oil and gas well production device including one or more bodies with the proviso that the one or more bodies does not include a drill bit, with one or more sleeves proximal to the outer surface or the inner surface of the one or more bodies, and a coating on at least a portion of the inner sleeve surface, the outer sleeve surface, or a combination thereof of the one or more sleeves, wherein the coating is chosen from a fullerene based composite, diamond-like-carbon (DLC), and combinations thereof, wherein the coefficient of friction of the coating is less than or equal to 0.15, and the coating provides a hardness greater than 1000 VHN, and utilizing the coated sleeved oil and gas well production device in well construction, completion, or production operations.

127. The method of claim 126, wherein the one or more bodies include two or more bodies in relative motion to each other.

128. The method of claim 126, wherein the one or more bodies include two or more bodies that are static relative to each other.

129. The method of claim 126, wherein the one or more bodies include spheres or complex geometries.

130. The method of claim 129, wherein the complex geometries have at least a portion that is non-cylindrical in shape.

131. The method of claim 127 or 128, wherein the two or more bodies include one or more bodies substantially within one or more other bodies.

132. The method of claim 127 or 128, wherein the two or more bodies are contiguous to each other.

133. The method of claim 127 or 128, wherein the two or more bodies are not contiguous to each other.

134. The method of claim 127 or 128, wherein the two or more bodies are coaxial or non-coaxial.

135. The method of claim 126, wherein the one or more bodies are solid, hollow or a combination thereof.

136. The method of claim 126, wherein the one or more bodies include at least one body that is substantially circular, substantially elliptical, or substantially polygonal in outer cross-section, inner cross-section or inner and outer cross-section.

137. The method of claim 126, wherein the coefficient of friction of the coating is less than or equal to 0.10.

138. The method of claim 126, wherein the coating provides at least 3 times greater wear resistance than an uncoated device.

139. The method of claim 126, wherein the water contact angle of the coating is greater than 60 degrees.

140. The method of claim 126, wherein the coating provides a surface energy less than 1 $J/m^2$.

141. The method of claim 126, wherein the coating comprises a single coating layer or two or more coating layers.

142. The method of claim 141, wherein the two or more coating layers are of substantially the same or different coatings.

143. The method of claim 141, wherein the thickness of the single coating layer and of each layer of the two or more coating layers range from 0.5 microns to 5000 microns.

144. The method of claim 141, wherein the coating further comprises one or more buffer layers.

145. The method of claim 144, wherein the one or more buffer layers are interposed between the surface of the one or more bodies and the single coating layer or the two or more coating layers.

146. The method of claim 144, wherein the one or more buffer layers are chosen from elements, alloys, carbides, nitrides, carbo-nitrides, and oxides of the following: silicon, titanium, chromium, tungsten, tantalum, niobium, vanadium, zirconium, or hafnium.

147. The method of claim 126, wherein the dynamic friction coefficient of the coating is not lower than 50% of the static friction coefficient of the coating.

148. The method of claim 126, wherein the dynamic friction coefficient of the coating is greater than or equal to the static friction coefficient of the coating.

149. The method of claim 126, wherein the one or more bodies further includes hardbanding on at least a portion thereof.

150. The method of claim 139, wherein the hardbanding comprises a cermet based material, a metal matrix composite or a hard metallic alloy.

151. The method of claim 126 or 149 wherein the one or more bodies further includes a buttering layer interposed between the surface of the one or more bodies and the coating or hardbanding on at least a portion of the bodies.

152. The method of claim 151, wherein the buttering layer comprises a stainless steel or a nickel based alloy.

153. The method of claim 126, wherein the one or more bodies further include threads.

154. The method of claim 153, wherein at least a portion of the threads are coated.

155. The method of claim 153 or 154, further comprising a sealing surface, wherein at least a portion of the sealing surface is coated.

156. The method of any one of claim 126, 127, or 128, wherein the one or more bodies are well construction devices.

157. The method of claim 156, wherein the well construction devices are chosen from chokes, valves, valve seats, nipples, ball valves, annular isolation valves, subsurface safety valves, centrifuges, elbows, tees, couplings, blowout preventers, wear bushings, dynamic metal-to-metal seals in reciprocating and/or rotating seals assemblies, springs in safety valves, shock subs, and jars, logging tool arms, rig skidding equipment, pallets, and combinations thereof.

158. The method of any one of claim 126, 127, or 128, wherein the one or more bodies are completion and production devices.

159. The method of claim 158, wherein the completion and production devices are chosen from chokes, valves, valve seats, nipples, ball valves, inflow control devices, smart well valves, annular isolation valves, subsurface safety valves, centrifuges, gas lift and chemical injection valves, elbows, tees, couplings, blowout preventers, wear bushings, dynamic metal-to-metal seals in reciprocating and/or rotating seals assemblies, springs in safety valves, shock subs, and jars, logging tool arms, sidepockets, mandrels, packer slips, packer latches, sand probes, wellstream gauges, non-cylindrical components of sand screens, and combinations thereof.

160. The method of claim 126, wherein the diamond-like-carbon (DLC) is applied by physical vapor deposition, chemical vapor deposition, or plasma assisted chemical vapor deposition coating techniques.

161. The method of claim 160, wherein the physical vapor deposition coating method is chosen from RF-DC plasma reactive magnetron sputtering, ion beam assisted deposition, cathodic arc deposition and pulsed laser deposition.

162. The method of claim 126, wherein the one or more sleeves comprise metals, metal alloys, ceramics, cermets, polymers, carbon steels, steel alloys, stainless steels, WC based hard metals, or combinations thereof.

* * * * *